US007181156B2

(12) United States Patent
Kabata et al.

(10) Patent No.: US 7,181,156 B2
(45) Date of Patent: Feb. 20, 2007

(54) IMAGE FORMING APPARATUS USING A CLEANING MEMBER FOR PREVENTING NOISES AND PROCESS CARTRIDGE THEREFOR

(75) Inventors: Toshiyuki Kabata, Kanagawa (JP); Michio Kimura, Shizuoka (JP); Jun Aoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 154 days.

(21) Appl. No.: 10/897,202

(22) Filed: Jul. 23, 2004

(65) Prior Publication Data

US 2005/0069357 A1 Mar. 31, 2005

(30) Foreign Application Priority Data

Jul. 25, 2003 (JP) ..... 2003-201903
Jul. 29, 2003 (JP) ..... 2003-202847
Sep. 17, 2003 (JP) ..... 2003-324747
Sep. 19, 2003 (JP) ..... 2003-327777

(51) Int. Cl.
*G03G 21/00* (2006.01)

(52) U.S. Cl. ..... 399/351; 399/123

(58) Field of Classification Search ..... 399/351, 399/350, 123, 343, 99, 100, 101; 15/1.51, 15/256.5, 256.51
See application file for complete search history.

(56) References Cited

U.S. PATENT DOCUMENTS 4,772,525 A 9/1988 Badesha et al. ..... 430/58.2
4,830,942 A 5/1989 Fukagai et al. ..... 430/59.2
4,886,572 A 12/1989 Kimura et al. ..... 216/6
4,948,685 A 8/1990 Ohsawa et al. ..... 429/213
4,999,263 A 3/1991 Kabata et al. ..... 429/131
5,011,751 A 4/1991 Yoneyama et al. ..... 429/306
5,037,713 A 8/1991 Yoshino et al. ..... 429/311
5,077,152 A 12/1991 Yoshino et al. ..... 429/209
5,099,285 A 3/1992 Hirano et al. ..... 399/286
5,100,437 A 3/1992 Yoshino et al. ..... 148/535
5,105,222 A 4/1992 Ohta et al. ..... 399/159
5,142,330 A 8/1992 Hirano et al. ..... 399/284
5,162,178 A 11/1992 Ohsawa et al. ..... 429/213
5,168,312 A 12/1992 Aoto et al. ..... 399/284
5,223,353 A 6/1993 Ohsawa et al. ..... 429/307
5,225,296 A 7/1993 Ohsawa et al. ..... 429/213
5,266,436 A 11/1993 Aoto et al. ..... 430/120
5,348,818 A 9/1994 Asami et al. ..... 429/213
5,379,097 A 1/1995 Aoto et al. ..... 399/222
5,436,092 A 7/1995 Ohtsuka et al. ..... 429/218.1
5,437,943 A 8/1995 Fujii et al. ..... 429/312
5,489,492 A 2/1996 Asami et al. ..... 429/212
5,655,199 A 8/1997 Yamashita et al. ..... 399/302
5,741,616 A 4/1998 Hirano et al. ..... 430/101

(Continued)

FOREIGN PATENT DOCUMENTS

JP 50-82056 7/1975

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes a photoconductor, a cleaning blade for cleaning the photoconductor, and a blade holder holding the cleaning blade and having a first bent portion for increasing its rigidity. In the apparatus, blade holder has at least one of a protrusion and a second bent portion.

37 Claims, 14 Drawing Sheets

U.S. PATENT DOCUMENTS

| | | | | |
|---|---|---|---|---|
| 5,761,594 | A | 6/1998 | Seto et al. | 399/302 |
| 5,774,775 | A | 6/1998 | Aoto et al. | 399/308 |
| 5,871,876 | A | 2/1999 | Ikuno et al. | 430/58.2 |
| 5,873,018 | A | 2/1999 | Aoto et al. | 399/302 |
| 5,885,733 | A | 3/1999 | Ohsawa et al. | 429/309 |
| 5,900,336 | A | 5/1999 | Kabata et al. | 429/231.4 |
| 6,013,393 | A | 1/2000 | Taniuchi et al. | 429/303 |
| 6,136,483 | A | 10/2000 | Suzuki et al. | 430/58.7 |
| 6,183,930 | B1 * | 2/2001 | Ueda et al. | 399/350 X |
| 6,311,037 | B1 * | 10/2001 | Hisakuni et al. | 399/350 |
| 6,521,388 | B2 | 2/2003 | Kabata et al. | 430/60 |
| 6,534,227 | B2 | 3/2003 | Kabata et al. | 430/30 |
| 6,640,081 | B2 * | 10/2003 | Sato | 399/350 |
| 6,649,313 | B2 | 11/2003 | Kabata et al. | 430/60 |
| 6,699,631 | B2 | 3/2004 | Miyamoto et al. | 430/56 |
| 6,778,802 | B2 | 8/2004 | Kabata et al. | 399/303 |
| 6,816,691 | B2 | 11/2004 | Kabata et al. | 399/165 |
| 6,821,694 | B2 | 11/2004 | Kabata et al. | 430/56 |
| 2003/0138711 | A1 | 7/2003 | Kabata et al. | 430/56 |
| 2004/0141781 | A1 * | 7/2004 | Suda | 399/350 |

FOREIGN PATENT DOCUMENTS

| | | | |
|---|---|---|---|
| JP | 51-73888 | | 6/1976 |
| JP | 54-9632 | | 1/1979 |
| JP | 54-11737 | | 1/1979 |
| JP | 56-150749 | | 11/1981 |
| JP | 57-78402 | | 5/1982 |
| JP | 61-20953 | | 1/1986 |
| JP | 61-296358 | | 12/1986 |
| JP | 63-285552 | | 11/1988 |
| JP | 64-1728 | | 1/1989 |
| JP | 64-13061 | | 1/1989 |
| JP | 64-19049 | | 1/1989 |
| JP | 64-88461 | | 4/1989 |
| JP | 1-134456 | | 5/1989 |
| JP | 1-134457 | | 5/1989 |
| JP | 1-179164 | | 7/1989 |
| JP | 2-282264 | | 11/1990 |
| JP | 2-304456 | | 12/1990 |
| JP | 3-50555 | | 3/1991 |
| JP | 3-109406 | | 5/1991 |
| JP | 3-180851 | | 8/1991 |
| JP | 3-180852 | | 8/1991 |
| JP | 4-11627 | | 1/1992 |
| JP | 4-133065 | | 5/1992 |
| JP | 4-133066 | | 5/1992 |
| JP | 4-175337 | | 6/1992 |
| JP | 4-183719 | | 6/1992 |
| JP | 4-225014 | | 8/1992 |
| JP | 4-230767 | | 8/1992 |
| JP | 4-264130 | | 9/1992 |
| JP | 4-264131 | | 9/1992 |
| JP | 4-264132 | | 9/1992 |
| JP | 4-264133 | | 9/1992 |
| JP | 4-289867 | | 10/1992 |
| JP | 4-320420 | | 11/1992 |
| JP | 5-40350 | | 2/1993 |
| JP | 5-188833 | | 7/1993 |
| JP | 5-202135 | | 8/1993 |
| JP | 5-232727 | | 9/1993 |
| JP | 5-310904 | | 11/1993 |
| JP | 5-341701 | | 12/1993 |
| JP | 06-019246 | | 1/1994 |
| JP | 06-175549 | A * | 6/1994 |
| JP | 6-234836 | | 8/1994 |
| JP | 6-234837 | | 8/1994 |
| JP | 6-234840 | | 8/1994 |
| JP | 6-234841 | | 8/1994 |
| JP | 7-56374 | | 3/1995 |
| JP | 08-211740 | | 8/1996 |
| JP | 9-127713 | | 5/1997 |
| JP | 9-211877 | | 8/1997 |
| JP | 9-222740 | | 8/1997 |
| JP | 9-265194 | | 10/1997 |
| JP | 9-265197 | | 10/1997 |
| JP | 9-304956 | | 11/1997 |
| JP | 10-161426 | | 6/1998 |
| JP | 2001-005361 | | 1/2001 |
| JP | 2001-235971 | | 8/2001 |
| JP | 2001-265039 | | 9/2001 |
| JP | 2002-072636 | | 3/2002 |
| JP | 2002-116661 | | 4/2002 |
| JP | 2002-244521 | | 8/2002 |
| JP | 2002-258713 | | 9/2002 |
| WO | WO 00/49466 | | 8/2000 |

* cited by examiner

IMAGE FORMING APPARATUS USING A CLEANING MEMBER FOR PREVENTING NOISES AND PROCESS CARTRIDGE THEREFOR

BACKGROUND OF THE INVENTION

1. Field of the Invention

The present invention relates to image forming apparatus and process cartridges for such image forming apparatus.

2. Description of the Related Art

Image forming apparatuses such as copiers, printers and facsimile machines are widely used in offices. For effectively utilizing the space of such an office and for the sake of convenience, these image forming apparatuses are often placed not in a dedicated room but in the office in the vicinity of users. In the latter case, some users feel the noise from the image forming apparatus unpleasant. Sounds caused by sheet feeding or rotation of motors upon image formation in the image forming apparatus are trivial as noise, unless they are excessively loud. In contrast, noise occurring after image formation and immediately before the photoconductor stops has a frequency of 400 Hz to 1500 Hz, which is significantly lower than those of sounds occurring upon the operation of the image forming apparatus. Thus, some users may misunderstand that the image forming apparatus produces trouble. The noise has a sound level lower than those of sounds occurring during the sheet feeding and rotation of motors, but the users often feel this noise relatively loud, because it occurs after the sounds caused by image formation reduce.

The noise produced after image formation and immediately before the photoconductor comes to a stop is caused by friction between the photoconductor and a cleaning blade. When the photoconductor rotates at a low rate immediately before stop, the friction between the photoconductor and the cleaning blade increases and the increased friction causes vibration of the cleaning blade. The vibration, in turn, causes vibration of a metallic holder or sheet metal holding the cleaning blade to thereby make the noise The cleaning blade typically made of urethane rubber becomes contorted by the action of friction with the photoconductor. At the time when the stress in the cleaning blade becomes larger than the friction force with the photoconductor, the cleaning blade rapidly returns to its original state by the action of restoring force and cleaning blade and releases the stress caused by the strain. When the cleaning blade returns to its original state, significantly large, uneven and irregular friction occurs between the cleaning blade and the photoconductor. Thus, a fluttering or chattering sound occurs in the image forming apparatus.

When the cleaning blade held by a metallic holder becomes distorted by the increased friction with the photoconductor, the metallic holder holding the cleaning blade also bends. The restoring force caused by the stress in the metallic holder adds to the restoring force of the cleaning blade upon the restoring of the cleaning blade. Thus, the friction force and friction space (length) between the cleaning blade and the photoconductor increase, and the chattering sound in the image forming apparatus becomes very loud.

The noise is trivial immediately after power-on of the image forming apparatus. However, after repetitive image formation, the temperature in the image forming apparatus elevates, and the cleaning blade becomes soft. Thus, the amplitude of the vibration of the cleaning blade increases, and the noise increases.

Certain cleaning members have the function of preventing the noise occurring upon the use of such image forming apparatuses. For example, a cleaning member comprises a metallic holder 20 having an L-shaped profile and holding a cleaning blade 17 (FIG. 1). The cleaning member has one bent portion 23. Thus, the metallic holder 20 is resistant to deformation and exhibits less distortion. The cleaning member comprising the metallic holder 20 having an L-shaped profile and the cleaning blade 17 is arranged in an image forming apparatus as shown in FIG. 2 so that the cleaning blade 17 is in contact with a photoconductor 11. The use of the cleaning member somewhat reduces the noise caused by the friction between the photoconductor 11 and the cleaning blade 17.

Japanese Patent Application Laid-Open (JP-A) No. 05-341701 (paragraphs [0004] to [0009]) discloses an image forming apparatus having a cleaning member comprising a cleaning blade for cleaning a photoconductive drum, and a vibration absorption section made of a vibration damper. The apparatus may reduce sounds caused between a charger and the photoconductive drum, which charger is of contact electrification system and works to come in contact with the photoconductive drum and thereby charges the same.

However, the image forming apparatus must have the vibration absorption section in the cleaning member, has complex configuration of the cleaning member, requires complex procedures for preparing the cleaning member and thus invites high production cost.

Image forming apparatuses to be placed in the vicinity of users and photoconductors used therein must be miniaturized and slimed down. When down-sized photoconductors having a small outer diameter and being held by a down-sized support are used in image forming apparatuses for the size and weight reduction, the image forming apparatuses often have a small heat capacity. Thus, the photoconductor and cleaning blade often have elevated temperatures. The image forming apparatuses having such miniaturized photoconductors often produce loud fluttering or chattering sounds at early stages of image formation. When the photoconductor has a large length, it often induces irregular rotation and thus induces irregular friction with the cleaning blade, thus inviting louder fluttering or chattering sounds.

In addition, demands have been made to simplify or omit various devices conventionally used in image forming apparatuses for lower cost thereof.

Examples of other conventional techniques for noise reduction in image forming apparatuses are shown below.

JP-A No. 2002-244521 (paragraphs [0005] and [0006]) discloses an image forming method and apparatus. The method includes the steps of forming a latent electrostatic image on an organic photoconductor, developing the latent electrostatic image by a developer containing a toner to form a visible toner image, transferring the visible toner image from the organic photoconductor to an image transfer member, and removing a residual toner on the organic photoconductor using a cleaning device, in which the organic photoconductor has a siloxane resin layer as a surface layer, the cleaning device includes a cleaning blade and a supporting member for the cleaning blade, the supporting member is partially bonded to the cleaning blade in parallel, and the cleaning blade is bonded to a vibration damper. The method and apparatus are intended to lo maintain good cleaning ability over a long period of time and to produce satisfactory electrophotographic images without image defects.

However, the cleaning blade has increased rigidity due to the bonded vibration damper, thus producing increased chattering sounds.

JP-A No. 05-188833 (paragraphs [0003] and [0006]) discloses a cleaning device for image forming apparatus, comprising a blade for coming in intimate contact with a photoconductor and cleaning residues on the photoconductor, a blade holder for holding the blade, and a holder bracket for holding the blade holder, in which the blade holder or holder bracket has a magnet. The cleaning device is intended to provide an image forming apparatus that avoids reduction in the rigidity of the holder bracket, changes of the intimate contact between the cleaning blade and the photoconductor, and extra vibration of the image forming apparatus.

However, it is impossible to bring the magnet into completely intimate contact with the holder bracket, and small vibration occurs at the contact area between the two members.

JP-A No. 2001-235971 (paragraphs [0008], [0012] and [0014]) discloses a photoconductive drum to be housed in a process cartridge of an image forming apparatus, which comprises a drum cylinder and a vibration damper arranged in the drum cylinder, the vibration damper includes a metallic cylindrical member, an elastic material covering at least part of the outer surface of the cylindrical member, and a coating layer covering the elastic material in intimate contact with the outer surface of the cylindrical member. The vibration damper is intended to absorb the vibration of the photoconductive drum occurring upon the rotation of the photoconductive drum and to increase the adhesion between the vibration damper and the photoconductive drum to thereby reduce noise.

However, the noise cannot be completely prevented and loud noise often occurs when the vibration damper is placed inside the photoconductor.

JP-A No. 2002-116661 (paragraphs [0005] to [0015]) discloses an electrophotographic photoconductor comprising a conductive cylindrical support having an outer diameter of 50 mm or less, a photoconductive layer arranged on the support, and a vibration damper arranged inside the cylindrical support, in which the electrophotographic photoconductor has a cylindricity of 0.03 mm or less. The electrophotographic photoconductor is intended to reduce vibration sounds occurring in contact charging system and vibration sounds of the cleaning blade and to thereby produce high-quality images without irregularity.

The photoconductor is effective to reduce the noise in charging using an alternating voltage, because substantially uniform vibration occurs in the entire photoconductor. However, the friction between the photoconductor and the cleaning blade not always occurs uniformly in the entire photoconductor, and the vibration of the photoconductor in the image forming apparatus often becomes much larger than the level measured in terms of the cylindricity, and the noise is not effectively reduced.

International Publication No. WO 00/49466 discloses an image forming apparatus, in which a silencer formed of pellets for molding a vibration-damping resin containing a base resin, an active component for increasing the dipole moment of the base resin, and an inorganic filler is applied to the inner or outer periphery surface of a photosensitive drum of an image forming apparatus. The vibration of the photoconductive drum is damped and eliminated, realizing high-quality image and low noise.

However, the image forming apparatus does not so effectively work against noise at relatively low frequency, such as one caused by the friction between the vibrating photoconductive drum and the cleaning blade, although it effectively reduces noise produced in contact charging using alternating voltage of several kilohertz.

JP-A No. 10-161426 discloses an image forming apparatus, in which a toner is supplied to a photoconductor at a low rotation of the photoconductor immediately before stop. Noise caused by the friction between the photoconductor and the cleaning blade occurs at a low rotation rate of the photoconductor immediately before stop. Thus, by supplying the toner at this time, the friction between the photoconductor and the cleaning blade is reduced to thereby reduce the noise.

However, the image forming apparatus requires such an extra toner feeding mechanism, which invites higher cost.

JP-A No. 2001-265039 discloses an electrophotographic photoconductor comprising a protective layer made of a curable resin having a torque T50 and a torque T40 with respect to a urethane cleaning blade at a surface temperature of 50° C. and 40° C., respectively, wherein the torque ratio Tr of the torque T50 to the torque T40 is 1.0 to 2.0. This technique is intended to avoid cleaning failure and scratch of the photoconductor.

However, this technique fails to teach effects on the vibration sounds of the cleaning blade, although it is effective to avoid cleaning failure and scratch of the photoconductor.

Another possible solution to reduce the noise is arrangement of a braking mechanism for stopping a photoconductor after image formation to shorten the time period of rotation of the photoconductor at low rate. Thus, the time period of the noise occurrence is shortened, and users may not notice the noise. However, the braking mechanism (control mechanism) is high in cost, because the rotation speed of such photoconductors becomes higher and higher for high-speed image formation, thus the resulting image forming apparatus becomes high in cost.

The noise caused by the increased friction between a photoconductor and a cleaning blade upon stop of the photoconductor occurs after the completion of image formation. Thus, the noise can be avoided by releasing the contact between the photoconductor and the cleaning bade immediately after the completion of image formation. However, such a mechanism for releasing the contact between the photoconductor and the cleaning blade after image formation invites upsizing and higher cost of the image forming apparatus.

If the temperature in the vicinity of the cleaning blade is reduced, the noise caused by the friction between the photoconductor and the cleaning blade can be inhibited. However, such a mechanism for reducing the temperature in the image forming apparatus is adverse to downsizing of the image forming apparatus.

A regular image forming apparatuses comprises a photoconductor and a charger for charging the photoconductor. When the distance between the photoconductor and the charger is short, the image forming apparatus can be miniaturized and reduces ozone and NOx formation in the apparatus. However, the ozone and NOx once formed often build up in such a narrow space between the photoconductor and the charger. The ozone and NOx are oxidative, deteriorate the photoconductive layer of the photoconductor and lead to lower resolution and blur of images.

To avoid the migration of the ozone and NOx formed in a space between the charger and the photoconductor to thereby avoid deterioration of the photoconductive layer, a substance selected from biphenyl compounds and compounds represented by following Formula (I) is incorporated into a photoconductive layer (JP-A No. 09-265194):

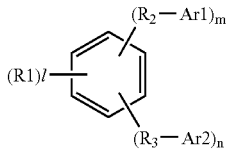

wherein $R_1$ is a lower alkyl group; $R_2$ and $R_3$ are the same as or different from each other and are each a substituted or unsubstituted methylene or ethylene group; $Ar_1$ and $Ar_2$ are the same as or different from each other and are each a substituted or unsubstituted aryl group; l is an integer of 0 to 4; m is an integer of 0 to 2; and n is an integer of 0 to 2, wherein l, m and n satisfy the following conditions: $m+n \geqq 2$, and $l+m+n \leqq 6$, and wherein unsubstituted positions in the benzene ring are hydrogen atoms.

However, the incorporation of a substance selected from the biphenyl compounds and compounds of Formula (I) into the photoconductive layer induces increased noise caused by the friction between the photoconductor and the cleaning blade.

SUMMARY OF THE INVENTION

After intensive investigations of how the noise caused by the friction between the photoconductor and the cleaning blade occurs, the present inventors have gained the following findings.

When the photoconductor rotates at a low speed immediately before stop and the friction between the photoconductor and the cleaning blade increases, the photoconductor pushes and presses the cleaning blade made typically of a urethane rubber to thereby deform the cleaning blade. At the time when the energy of the distortion or strain overcomes the friction force, the cleaning blade rapidly returns to its original state and releases the strain energy.

When the cleaning blade returns to its original state, significantly large, uneven and irregular friction occurs between the cleaning blade and the photoconductor. Thus, fluttering or chattering sounds occur in the image forming apparatus. When the cleaning blade is held by a metallic holder and becomes distorted by the increased friction with the photoconductor, the metallic holder holding the cleaning blade also bends. The restoring force caused by the stress in the metallic holder adds to the restoring force of the cleaning blade upon the restoring of the cleaning blade. Thus, the friction force and friction space (length) between the cleaning blade and the photoconductor increase, and the chattering sound in the image forming apparatus becomes very loud.

Certain cleaning members have an L-shaped metallic plate which holds a cleaning blade to thereby reduce the distortion or bending of the metallic plate.

For example, a cleaning member includes an L-shaped metallic holder 20 and a cleaning blade 17 held by the metallic holder (FIG. 1). If the distance between the bent portion and an edge which does not hold the cleaning blade of the L-shaped metallic holder is large, a space therebetween easily vibrates by the action of the friction between the cleaning member and the photoconductor. The resulting vibration travels to a space between the bent portion and the other edge which holds the cleaning blade, thus causing very loud fluttering or chattering sounds. The cleaning blade works to remove residual toner remained on the photoconductor. To recover the removed toner to a used toner bottle or to recycle it to the developer, the apparatus requires a toner recovering device for recovering and conveying the toner. It is preferred that the metallic plate (metallic holder) is bent into L-shape, one flat portion constituting L-shape is allowed to hold the cleaning blade, and the other flat portion is used as a lid of the toner recovering device. Thus, the device occupies less space and can be composed of parts in a less number.

To use the other flat portion as a lid of the toner recovering device, the other flat portion must have a specific width. The present inventors have found that if the other flat portion has a large width, the other flat portion which does not hold the cleaning blade vibrates, and the vibration travels to the one flat portion which holds the cleaning blade, thus causing very loud fluttering or chattering lo sounds. They also have found that, if the other flat portion which does not hold the cleaning blade has a large width, the other flat portion itself must have such a shape that does not vibrate to reduce fluttering or chattering sounds. The present invention has been accomplished based on these findings.

Accordingly, an object of the present invention is to provide an image forming apparatus and a process cartridge therefor, which have a simple configuration, invites less noise, are down-sized and are available at low cost.

The present invention to achieve the above objects is as follows.

Specifically, the present invention provides an image forming apparatus at least including a photoconductor and a cleaning member, the cleaning member including a cleaning blade for cleaning the photoconductor, and a blade holder for holding the cleaning blade, wherein the blade holder includes a first flat portion, an L shaped bent portion and a second flat portion and the cleaning blade is fixed on the plate of the first flat portion, and wherein the second flat portion of the blade holder includes a configuration for increasing the rigidity. The image forming apparatus has a simple configuration, reduces the noise, is down-sized and is available at low cost.

In a first preferred aspect, the blade holder has the second bent portion for increasing its rigidity and holds the cleaning blade at a position nearer to the first bent portion than the second bent portion. Thus, the image forming apparatus has a simple configuration, reduces the noise, is down-sized and is available at low cost.

The second bent portion may be formed by folding or bending.

Thus, image forming apparatus has a simple configuration, further reduces the noise, is down-sized and is available at low cost.

Preferably, the blade holder has a first edge and a second edge, the first and second edges extending in a longitudinal direction and residing in the first and second bent portions, respectively, and the distance between the line of bend of the second bent portion and the second edge is from 2 mm to 15 mm.

Thus, the image forming apparatus has a simple configuration that does not require so strict accuracy of finishing, reduces the noise, is down-sized and is available at low cost.

The angle which the second bent portion forms is preferably 140 degrees or less.

Thus, the image forming apparatus has a simple configuration, more effectively reduces the noise, is down-sized and is available at low cost.

The blade holder may further have one or more protrusions between the first bent portion and the second bent portion. The protrusions herein include structures having a convex or concave profile and being arranged between the first bent portion and the second bent portion.

Thus, the image forming apparatus more reliably reduces the noise.

The protrusions may be formed by drawing.

Thus, image forming apparatus further reduces the noise.

The blade holder preferably has a thickness of 1.0 mm or more and 2.5 mm or less.

Thus, the image forming apparatus has a sufficient strength and can be easily processed.

The angle which the first bent portion forms is preferably from 70 degrees to 135 degrees.

Thus, the blade holder has a sufficient strength and the cleaning unit can be easily held in the image forming apparatus.

The distance between the first bent portion and the second bent portion is preferably 10 mm or more.

Thus, the cleaning unit can be more easily and reliably held in lo the image forming apparatus.

The image forming apparatus may further include a developer-recovering device for recovering a developer on the photoconductor, and the blade holder may serve as a lid of the developer-recovering device.

Thus, the image forming apparatus has a simpler structure, reduces the noise, is down-sized and is available at low cost.

The present invention further provides a process cartridge integrally comprising at least cleaning unit and being attachable to and detachable from a main body of the image forming apparatus, wherein a cleaning member comprises a cleaning blade for cleaning a photoconductor; and a blade holder for holding the cleaning blade, wherein the blade holder comprises a first flat portion, an L shaped bent portion and a second flat portion and the cleaning blade is fixed on the plate of the first flat portion, wherein the second flat portion of the blade holder comprises a configuration for increasing the rigidity.

Thus, the process cartridge can constitute an image forming apparatus that has a simple configuration, reduces the noise, is down-sized and is available at low cost.

In a second preferred aspect, the blade holder has at least one protrusion. In the image forming apparatus, the photoconductor includes a cylindrical electroconductive support and a photoconductive layer arranged on or above the electroconductive support, the blade holder has the first and second flat portions formed by bending a metallic plate member into an L shape, the cleaning blade has a contact site to be in contact with the photoconductor along the axial direction of the photoconductor, the configuration for increasing the rigidity is at least one protrusion being protruded from the second flat portion of the blade holder and continuously extending in parallel with the contact site, the image forming apparatus comprises a toner-recovering device having an opening and working to recover a toner removed from the photoconductor by the action of the cleaning blade, the opening being to be covered by the second flat portion of the blade holder, the second flat portion of the blade holder has a size in a direction perpendicular to the contact site of 10 mm or more, and the at least one protrusion protrudes 0.5 mm or more from the second flat portion.

Thus, the blade holder can hold the cleaning blade, cover the opening of the toner-recovering device, reduce the vibration of the second flat portion and thereby reduce the friction between the cleaning blade and the photoconductor caused by traveling of the vibration of the second flat portion. The image forming apparatus lo can thereby reduce the noise caused by the friction between the cleaning blade and the photoconductor.

The electroconductive support preferably has an outer diameter of 60 mm or less, a thickness of 0.3 to 2 mm and a length in an axial direction of 310 mm or more.

Thus, using the photoconductor which is suitable for miniaturization, the image forming apparatus exhibits the above advantages.

The blade holder may be formed by bending a plate or sheet member having a thickness of 1.0 to 2.5 mm into an L shape.

Thus, the blade holder can maintain its satisfactory strength, and the image forming apparatus can avoid streaky irregular images due to cleaning failure or band-shaped irregular images due to irregular abrasion of the photoconductor after repetitive image formation procedures and thereby prevent the noise caused by irregular abrasion. In addition, the blade holder can be easily prepared by pressing or punching and is available at lower cost.

The at least one protrusion may extend and reach at least one short side of the second flat portion of the blade holder.

The image forming apparatus may further include a flexible member, the flexible member being arranged on the second flat portion of the blade holder, facing the opening of the toner-recovering device, and containing a flexible material.

Thus, the opening can be reliably covered, preventing the toner recovered by the toner-recovering device from scattering.

The flexible material constituting the flexible member may be at least one selected from a urethane foam, a Moltoprene (black light-shielding material), a felt, a film or a flexible plastic.

Thus, the opening can be more practically easily covered by the lid.

The flexible member preferably has a size of 1.5 to 5 mm in a thickness direction of the second flat portion of the blade holder.

Thus, the opening can be more reliably covered by the lid, preventing the toner recovered by the toner-recovering device from scattering more reliably.

The area ratio of the at least one protrusion to a flat area of the second flat portion of the blade holder is preferably 15 to 70 percent.

Thus, the blade holder can reduce the vibration of the second flat portion to thereby more reliably reduce the friction between the cleaning blade and the photoconductor caused by travelling of the vibration of the second flat portion. The image forming apparatus can thereby more reliably reduce the noise caused by the friction between the cleaning blade and the photoconductor.

The image forming apparatus may further include a unit for controlling the rotation of the photoconductor so that the time period during which the number of revolutions of the photoconductor before stop falls within a range from 1 to 10 rpm is 0.2 second or longer.

Thus, the image forming apparatus can exhibit the above advantages without requiring an extra stopping mechanism for rapidly stopping the rotation of the photoconductor.

The image forming apparatus may further include a control device controlling a temperature so that the highest temperature of the photoconductor during image formation procedures is from 38° C. to 56° C.

Thus, the image forming apparatus can exhibit the above advantages without requiring an extra cooling mechanism for rapidly cooling the photoconductor.

The photoconductive layer of the photoconductor may contain a biphenyl derivative and a compound represented by following Formula (I):

(I)

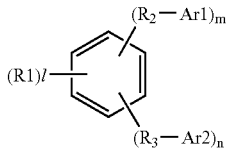

wherein $R_1$ is a lower alkyl group; $R_2$ and $R_3$ are the same as or different from each other and are each a substituted or unsubstituted methylene or ethylene group; $Ar_1$ and $Ar_2$ are the same as or different from each other and are each a substituted or unsubstituted aryl group; l is an integer of 0 to 4; m is an integer of 0 to 2; and n is an integer of 0 to 2, wherein l, m and n satisfy the following conditions: $m+n \geqq 2$, and $l+m+n \leqq 6$, and wherein unsubstituted positions in the benzene ring represent hydrogen Thus, the image forming apparatus can reduce the noise caused by the friction between the cleaning blade and the photoconductor even though the photoconductor includes the compound of Formula (I) in its photoconductive layer. In this connection, it is believed that, if the photoconductive layer includes the compound of Formula (I) alone, the resulting image forming apparatus may produce noise caused by the friction between the cleaning blade and the photoconductor louder than one in which the photoconductive layer includes neither the biphenyl derivative nor the compound of Formula (I).

Preferably, the compound represented by Formula (I) is a bisbenzylbenzene derivative, and the photoconductive layer of the photoconductor contains 0.5 to 7 percent by weight of the bisbenzylbenzene derivative.

Thus, the image forming apparatus can exhibit the advantages more effectively in practice.

The image forming method may further include a charger for charging a surface of the photoconductor, and the distance between the photoconductor and the charger may be set at 100 μm or less.

Thus, the image forming apparatus can reduce oxidative substances such as ozone and NOx and can exhibit the above advantages.

The image forming apparatus may further include a process cartridge housing the photoconductor, the cleaning blade and the blade holder in a cartridge casing.

Thus, these members and parts can be handled as a unit of the process cartridge, and the image forming apparatus can be more conveniently handled.

The present invention further provides, in yet another aspect, a copier including an image reading device for reading an original image, and the above-mentioned image forming apparatus for carrying out image formation based on the image read out by the image reading device.

Thus, the copier can exhibit the above advantages.

In a third preferred aspect of the image forming apparatus, the blade holder has at least one protrusion and has a flat outer periphery. More specifically, in the image forming apparatus the photoconductor includes a cylindrical support having an outer diameter of 60mm or less, a thickness of 0.3 to 2 mm and a length of 310 mm or more, and a photoconductive layer arranged on the cylindrical support, a cleaning blade is in contact with the photoconductor even when no image formation is carrying out, the blade holder is a metallic blade holder, has an L-shaped profile, has a thickness of 1.0 to 2.5 mm and has first and second flat portions, and the second flat portion of the blade holder has a width of 10 mm or more, has a flat outer periphery and includes at least one protrusion protruding 0.5 mm or more from the level of the flat outer periphery as the configuration for increasing the rigidity.

The at least one protrusion preferably continuously extends inside the flat outer periphery in the second flat portion.

The area ratio of the at least one protrusion to the second flat portion of the blade holder is preferably 15 to 70 percent. Thus, the image forming apparatus can further reduce the noise caused by the lo friction between the photoconductor and the cleaning blade.

The image forming apparatus may further include a toner-recovering device for recovering a toner removed from the photoconductor by the action of the cleaning blade, and the second flat portion of the blade holder may serve as a lid of the toner-recovering device. The image forming apparatus can effectively reuse the used toner without scattering and can reduce the noise caused by the friction between the photoconductor and the cleaning blade.

The image forming apparatus may be so configured that the time period during which the number of revolutions of the photoconductor after image formation and before stop falls within a range from 1 to 10 rpm is 0.2 second or longer. Thus, the image forming apparatus can reduce the noise caused by the friction between the photoconductor and the cleaning blade without requiring an extra mechanism for rapidly stopping the rotation of the photoconductor after image formation.

The image forming apparatus may be so configured that the highest temperature of the photoconductor during image formation is from 38° C. to 53° C. Thus, the image forming apparatus can reduce the noise caused by the friction between the photoconductor and the cleaning blade without requiring an extra cooling mechanism for rapidly cooling the photoconductor.

The photoconductive layer of the photoconductor may contain a biphenyl compound and a compound represented by following Formula (I):

(I)

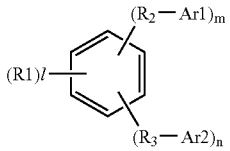

wherein $R_1$ is a lower alkyl group; $R_2$ and $R_3$ are the same as or different from each other and are each a substituted or unsubstituted methylene or ethylene group; $Ar_1$ and $Ar_2$ are the same as or different from each other and are each a substituted or unsubstituted aryl group; l is an integer of 0 to 4; m is an integer of 0 to 2; and n is an integer of 0 to 2, wherein l, m and n satisfy the following conditions: $m+n \geqq 2$, and $l+m+n \leqq 6$, and wherein unsubstituted positions in the benzene ring represent hydrogen atoms.

Preferably, the compound represented by Formula (I) is a bisbenzylbenzene derivative, and the photoconductive layer of the photoconductor includes 0.5 to 7 percent by weight of the bisbenzylbenzene derivative.

The image forming apparatus may further include a charger for charging the photoconductor, and the distance between the charger and the photoconductor may be set at 100 μm or less. Thus, the image forming apparatus can reduce the noise caused by the friction between the photoconductor and the cleaning blade, without inviting irregular images at high humidity.

In the process cartridge according to the present invention, the blade holder is a metallic blade holder, has an L-shaped profile, has a thickness of 1.0 to 2.5 mm and has first and second flat portions, the second flat portion of the blade holder has a width of 10 mm or more, has a flat outer periphery and includes at least one protrusion protruding 0.5 mm or more from the level of the flat outer periphery. Thus, the process cartridge can reduce the noise caused by the friction between the photoconductor and the cleaning blade.

According to a fourth preferred aspect, the image forming apparatus has a process cartridge integrally including a photoconductive drum serving as the photoconductor, and around the photoconductive drum; a contact charging unit which charges the photoconductive drum using a direct-current voltage; a light-irradiating unit applying laser beams; a developing unit for reversal development; a transfer unit for carrying out contact transfer; the cleaning unit having a cleaning blade as the blade member; and a charge-eliminating unit, the process cartridge being attachable to and detachable from a main body of the image forming apparatus, wherein the image forming apparatus is so configured that the time period during which the number of revolutions of the photoconductor after image formation and before stop falls within a range from 1 to 10 rpm is 0.2 second or longer, the cleaning unit comprises the cleaning blade and a blade holder serving as the holding member, the blade holder is fixed at two edges in a longitudinal direction to the process cartridge, the two edges are positioned outside the photoconductive drum, and the blade holder is reinforced in its longitudinal direction. Thus, the cleaning blade can be more easily replaced, and the process cartridge can be down-sized and have a less thickness. In addition, the blade holder being reinforced in its longitudinal direction can reduce the torque with respect to the photoconductive drum, thus reducing the vibration sounds upon stop of the photoconductive drum.

Preferably, the image forming apparatus is so configured that the highest temperature of the photoconductor during image formation is from 40° C. to 55° C., and the cleaning blade exhibits a torque per unit length with respect to the photoconductive drum of 0.95 cN or less at 40° C. to 55° C. at a number of revolutions of the photoconductive drum of 1 to 10 rpm. Thus, the image forming apparatus can reduce the vibration sounds (noise) of the photoconductive drum and reduce the abrasion of the photoconductive layer.

The blade holder is preferably reinforced by beading and L-shaped bending in its longitudinal direction. Thus, the blade holder less deforms in its longitudinal direction, and the image forming apparatus can reduce the vibration sounds (noise) of the photoconductor drum even after repetitive image formation procedures.

The image forming apparatus preferably further includes a vibration damper, wherein the vibration damper is attached to the inner surface of the photoconductive drum, has a C-shaped profile in a direction perpendicular to the rotation axis of the photoconductive drum, and the slit width of the C-shaped profile is 0.5 to 3 percent of the circumferential length of the inner surface of the photoconductive drum. Thus, the image forming apparatus can reduce the vibration sounds (noise) of the photoconductor drum even when the highest temperature of the photoconductive drum during image formation is 40° C. to 55° C.

The vibration damper preferably has a tapered edge. Thus, the vibration damper can be smoothly and satisfactorily placed into the photoconductor drum, and the image forming apparatus has good productivity.

The image forming apparatus preferably includes two or more plies of the vibration damper. Thus, the image forming apparatus can further reduce the vibration sounds (noise) of the photoconductor drum.

The photoconductive layer of the photoconductive drum may contain a biphenyl compound and a compound represented by following Formula (I):

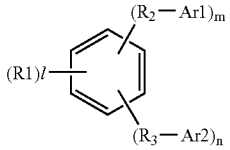

(I)

wherein $R_1$ is a lower alkyl group; $R_2$ and $R_3$ are the same as or different from each other and are each a substituted or unsubstituted methylene or ethylene group; $Ar_1$ and $Ar_2$ are the same as or different from each other and are each a substituted or unsubstituted aryl group; l is an integer of 0 to 4; m is an integer of 0 to 2; and n is an integer of 0 to 2, wherein l, m and n satisfy the following conditions: $m+n \geqq 2$, and $l+m+n \leqq 6$, and wherein unsubstituted positions in the benzene ring represent hydrogen atoms.

Thus, the image forming apparatus can avoid deterioration in images, even when oxidative substances such as ozone and NOx invade the photoconductive layer.

Further objects, features and advantages of the present invention will become apparent from the following description of the preferred embodiments with reference to the attached drawings.

DESCRIPTION OF THE PREFERRED EMBODIMENTS

The outlines of the image forming apparatus and process cartridge therefor according to the present invention will be illustrated with reference to FIG. 3.

Figure 1:
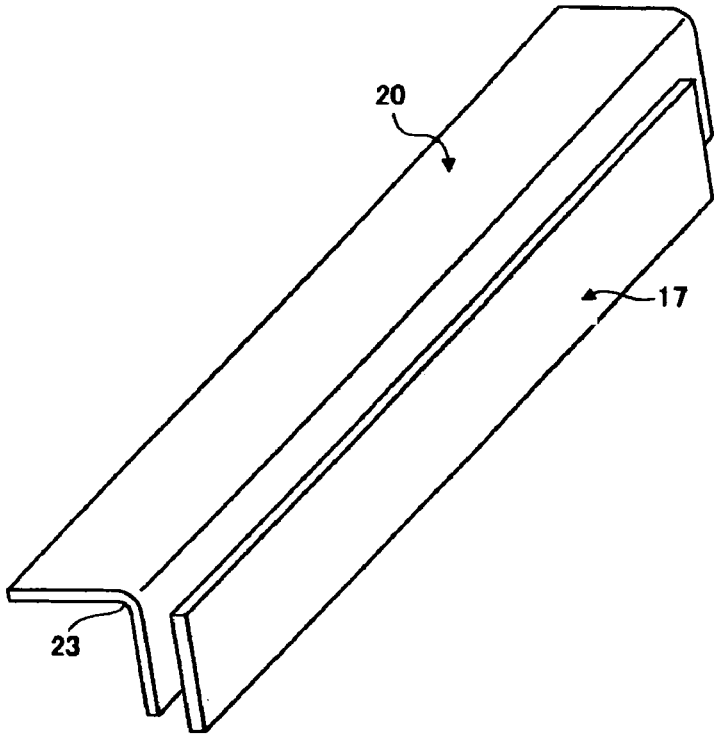
FIG. 1 PRIOR ART
FIG. 1 is a schematic diagram illustrating a cleaning member for use in conventional image forming apparatuses.
Figure 2:
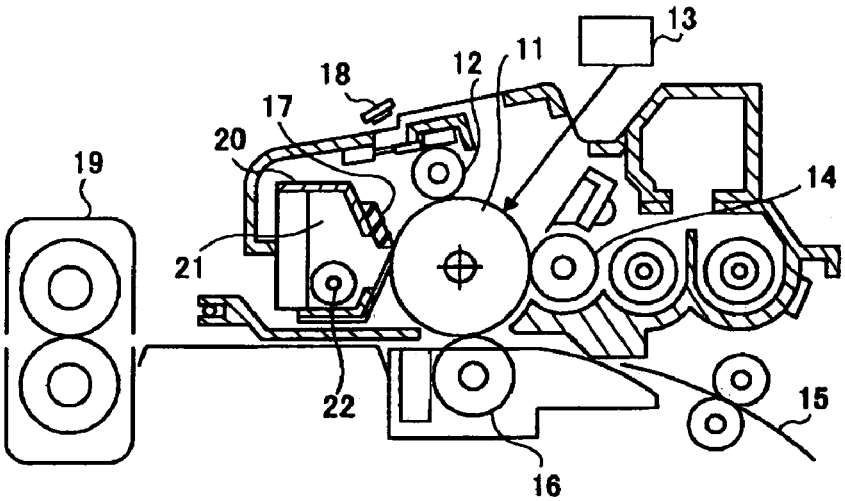
FIG. 2 PRIOR ART
FIG. 2 is a schematic sectional view illustrating a conventional image forming apparatus.
Figure 3:
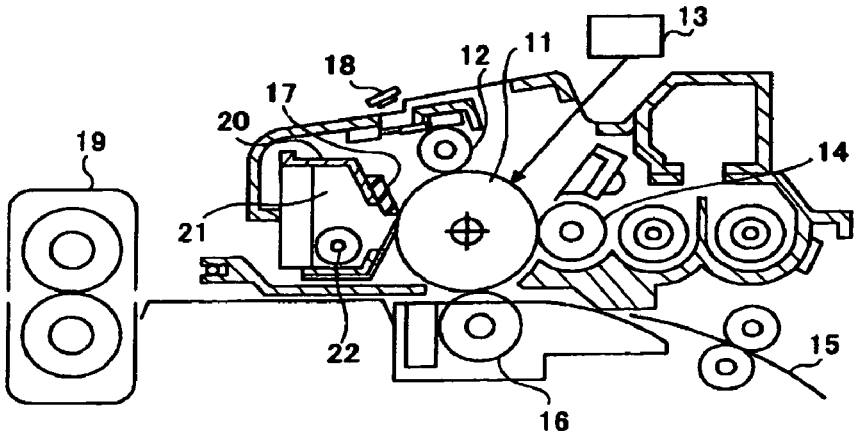
FIG. 3 is a schematic sectional view of an image forming apparatus according to the present invention.

FIG. 3 is a schematic sectional view of an image forming apparatus as an embodiment of the present invention. The image forming apparatus comprises a photoconductor 11; a contact charger 12 for charging the surface of the photoconductor 11; a light irradiator 13 for applying laser light based on information of an image to be formed; an image-developing roll 14 for developing a latent electrostatic image with a developer formed on the photoconductor 11 by the action of the contact charger 12 and the laser light; an image-transfer roll 16 for transferring the developed image from the photoconductor 11 to an image-transfer member such as a recording sheet (paper) 15; an image-fixing device 19 for fixing the transferred developer image on the image-transfer member such as the recording sheet 15; and a cleaning member for removing the residual developer from the photoconductor 11. The cleaning member includes a cleaning blade 17 for scraping off the residual developer from the photoconductor 11; and a metallic holder 20 for holding the cleaning blade 17. The image forming apparatus further comprises a developer-recovering device 21 for recovering the used developer removed from the photoconductor 11. The developer-recovering device 21 further includes a screw 22 for conveying the developer typically to a developing section to thereby recycle the developer. The image forming apparatus also comprises a charge-eliminator 18 for eliminating the residual charge from the photoconductor 11.

With reference to FIG. 3, the contact charger 12 charges the photoconductor 11, and the charged photoconductor 11 is irradiated image wise with the laser light having the information of image to be formed. Thus, exposed portions of the photoconductor 11 are electrified to thereby form a latent electrostatic image on the photoconductor 11. Next, the image-developing roll 14 feeds a developer containing a toner to the latent electrostatic image on the photoconductor 11, the latent electrostatic image is developed by coming in contact with the developer containing the toner to thereby form a toner image. The image-transfer roll 16 then transfers the toner image from the photoconductor 11 to the image-transfer member such as the recording sheet 15. The image-fixing device 19 fixes the toner image onto the recording sheet 15 when the recording sheet 15 passes through the image-fixing device 19 to thereby form a hard copy. Thus, a desired image can be formed on the recording sheet 15.

The residual developer on the photoconductor 11 is removed therefrom by the cleaning blade 17 held by the metallic holder 20. The residual charge on the photoconductor 11 is removed by the charge-eliminator 18. Then, another image forming procedure is repeated. The used developer removed from the photoconductor 11 by the cleaning member is recovered into the developer-recovering device 21, is conveyed to the developing section by the screw 22 in the developer-recovering device 21 and is reused.

The process cartridge for image forming apparatus according to the present invention will be illustrated. The process cartridge comprises at least a photoconductor and a cleaning member which are integrated. The process cartridge may further integrally comprise one or more of constitutional elements in the image forming apparatus, such as a charger, light irradiator, image-developing device, and image transferer, in addition to the photoconductor and the cleaning member, if required.

By integrating a plurality of constitutional elements of the image forming apparatus as a process cartridge for, the image forming apparatus can be down-sized. In addition, the process cartridge is easily and conveniently attached to or detached from the image forming apparatus.

Figure 4A:
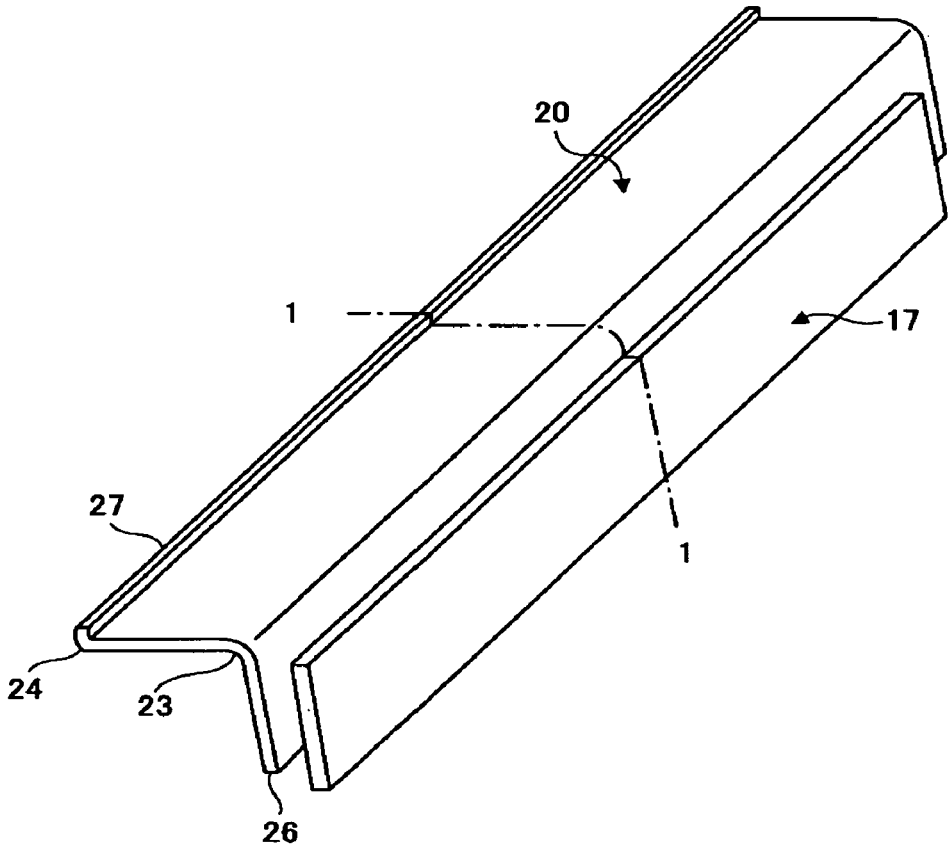
FIGS. 4A and 4B are a perspective view and a sectional view, taken along the line 1—1, respectively, of a cleaning member for use in the image forming apparatus of the present invention.

The configuration of the cleaning member for use in the image forming apparatus and process cartridge therefor will be schematically illustrated with reference to FIG. 4A. FIG. 4A is a schematic perspective view of the cleaning member which works to remove the residual developer containing a toner on the photoconductor. The cleaning member includes a cleaning blade 17 for scraping off the residual developer from the photoconductor; and a metallic holder 20 for holding the cleaning blade 17. The metallic holder 20 has a first bent portion 23 and a second bent portion 24. The cleaning blade 17 is held at the midpoint between the first bent portion 23 and a first edge 26 of the metallic holder. With reference to FIG. 4A, the first edge 26 and a second edge 27 are arranged with the interposition of the first bend portion 23 and the second bent portion 24. The metallic holder 20 is made of a metal, and the cleaning blade 17 is made typically of a urethane rubber.

By arranging the second bent portion 24 in addition to the first bent portion 23, the rigidity of a portion between the first bent portion 23 and the second bent portion 24 increases to thereby reduce the vibration of a portion between the first bent portion 23 and the first edge 26. Thus, the arrangement of the second bent portion 24 can significantly reduce the noise (fluttering or chattering sounds) caused by the friction between the photoconductor and the cleaning blade, even if the distance between the first bent portion 23 and the second bent portion 24 is large.

The cleaning member having such a simple configuration can reduce the noise caused by the friction between the photoconductor and the cleaning blade even in an image forming apparatus in which the photoconductor and the cleaning blade are in contact even after the completion of image formation. Thus, the image forming apparatus can be miniaturized and available at low cost. Using the cleaning member having the metallic holder 20 in an image forming apparatus can reduce the noise caused by the friction between the photoconductor and the cleaning blade without an extra device for rapidly stopping the rotation of the photoconductor and an extra cooling mechanism, even when the image forming apparatus is small in size.

The metallic holder 20 can be prepared by bending or folding a metallic plate to form the first bent portion 23 and second bent portion 24 or by bending or folding a metallic holder having an L-shaped profile and having the first bent portion 23 to form the second bent portion 24. The metallic holder 20 may be prepared by casting but is preferably prepared by bending a metallic sheet to form the first bent portion 23 and second bent portion 24 for more effectively reducing the noise caused by the friction between the cleaning blade 17 and the photoconductor 11. This is because, by bending, the metal in the first bent portion 23 and second bent portion 24 has a structure different from that of the metal in a portion between the first bent portion 23 and second bent portion 24, and the deformation of the metallic holder 20 is thus reduced.

Figure 4B:
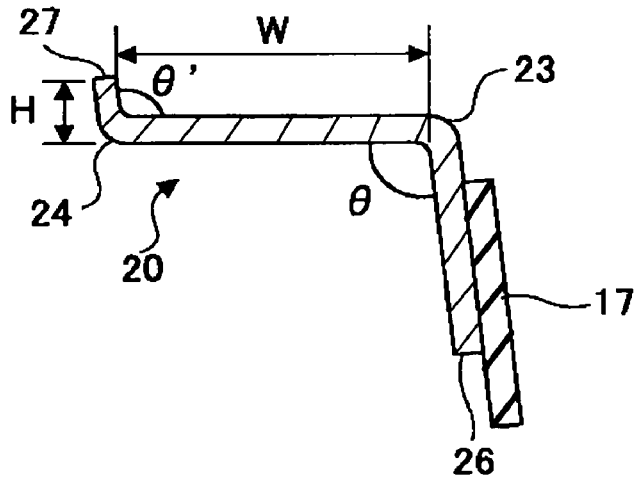

A more preferred embodiment of the cleaning member for use in the image forming apparatus and process cartridge therefor will be illustrated with reference to FIG. 4B. FIG. 4B is a sectional view of the cleaning member taken along the alternate long and short dash lines in FIG. 4A.

In the cleaning member for use in the present invention, the distance H between the line of bend of the second bent portion 24 and the second edge 27 is preferably from 2 mm to 15 mm, and more preferably from 4 mm to 12 mm (FIG. 4B). If the distance H is larger than 15 mm, the noise caused by the friction between the photoconductor and the cleaning member may not be effectively reduced, and additional vibration may occur in a portion between the second bent portion 24 and the second edge 27, causing noise of additional frequencies. In contrast, if the distance H is less than 2 mm, the portion between the second bent portion 24 and the second edge 27 may not be formed with a satisfactory accuracy of finishing, and thus a portion between the first bent portion 23 and the first edge 26 which holds the cleaning blade may have a decreased accuracy of finishing. As a result, streaky irregular images may be formed due to cleaning failure of the developer.

The angle θ' which the second bent portion 24 forms is preferably from 0 degree to 140 degrees, more preferably from 10 degrees to 120 degrees, and further preferably from 50 degrees to 100 degrees (FIG. 4B). If the angle θ' is larger than 140 degrees, the second bent portion 24 may not so effectively work to increase the rigidity of a portion between the first bent portion 23 and the first edge 26, and thus the noise caused by the friction between the photoconductor and the cleaning member may not be reduced so effectively.

The width w between the line of bend of the first bent portion 23 and the line of bent of the second bent portion 24 is preferably 10 mm or more, more preferably 12 mm or more, and further preferably from 14 mm to 20 mm (FIG. 4B). The metallic holder 20 can be used as the lid of the developer-recovering device 21. For this purpose, the width w must be at a specific level or more. The developer-recovering device 21 must include the screw 22 for conveying the developer and other necessary parts. If the width w is less than 10 mm, these parts of the developer-recovering device 21 may not be formed.

The angle θ which the first bent portion 23 forms is preferably from 70 degrees to 135 degrees, more preferably from 80 degrees to 120 degrees, and further preferably from 85 degrees to 110 degrees (FIG. 4B). If the angle θ is less than 70 degrees, the developer-recovering device 21 and/or a casing for holding the metallic holder 20 may have a complex shape in order to control the contact angle formed between the cleaning blade 17 and the photoconductor 11 at an optimal level and to use the metallic holder 20 as the lid of the developer-recovering device 21. In contrast, if the angle θ is larger than 135 degrees, the metallic holder 20 may not have sufficient strength, thus causing streaky irregular images due to cleaning failure of the developer. Upon repetitive image formation, the photoconductor 11 may be worn unevenly by the cleaning blade, thus often causing band-shaped irregular images. In addition, the noise immediately before stop of the photoconductor 11 after image formation may become relatively loud.

The thickness of the metallic holder 20 is preferably from 1.0 mm to 2.5 mm, more preferably from 1.2 mm to 2.2 mm, and further preferably from 1.4 mm to 2.0 mm. If the thickness of the metallic holder 20 is less than 1.0 mm, the metallic holder 20 may not have sufficient strength, thus often causing streaky irregular images due to cleaning failure of the developer. Upon repetitive image formation, the photoconductor 11 may be worn unevenly by the cleaning blade, thus often causing band-shaped irregular images. In addition, the noise immediately before stop of the photoconductor 11 after image formation may become relatively loud. In contrast, if the thickness is larger than 2.5 mm, the metallic holder may not be satisfactorily prepared by pressing or punching.

Figure 5A:
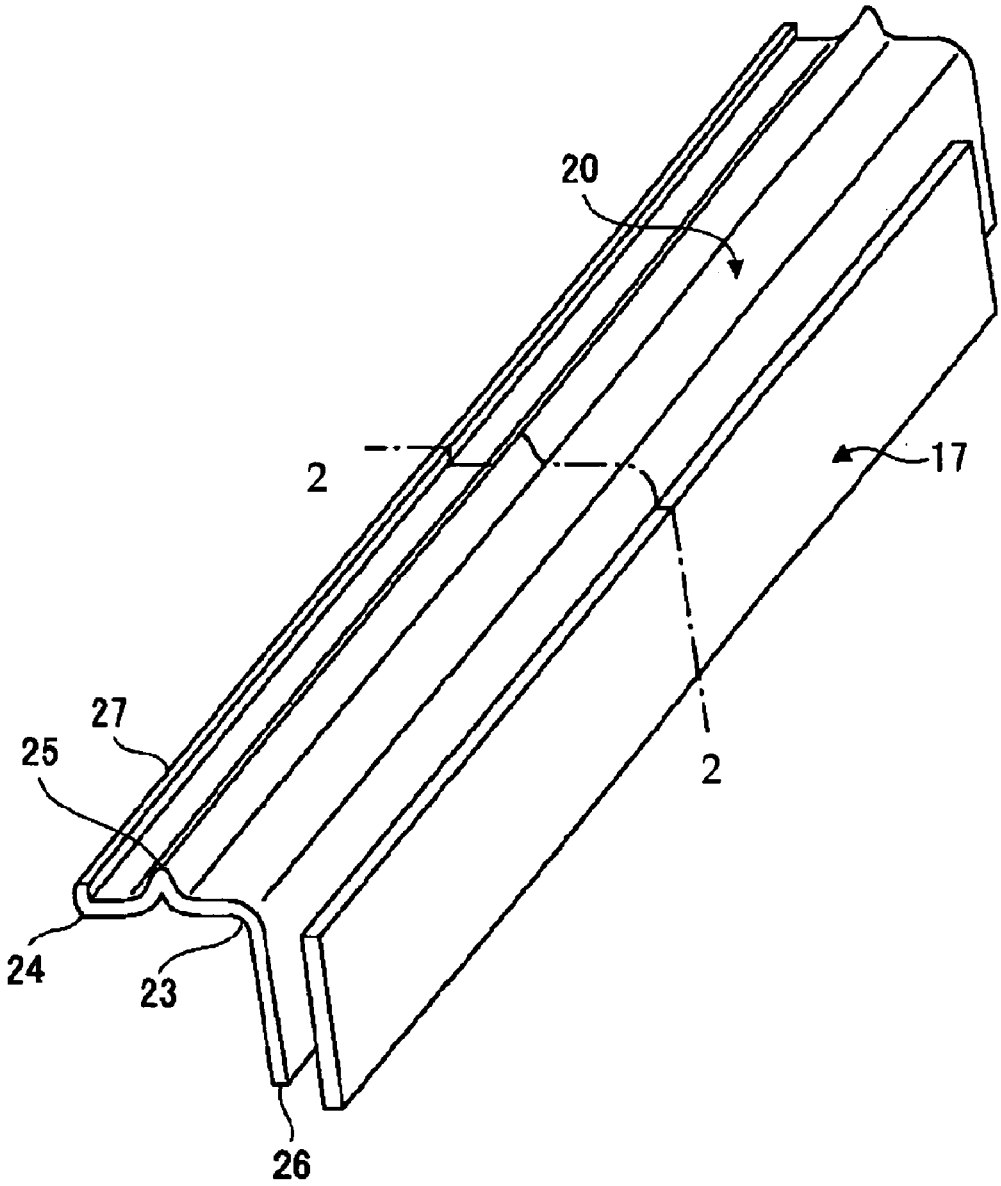
FIGS. 5A and 5B are a perspective view and a sectional view, taken along the line 2—2, respectively, of another cleaning member for use in the image forming apparatus of the present invention.
Figure 5B:
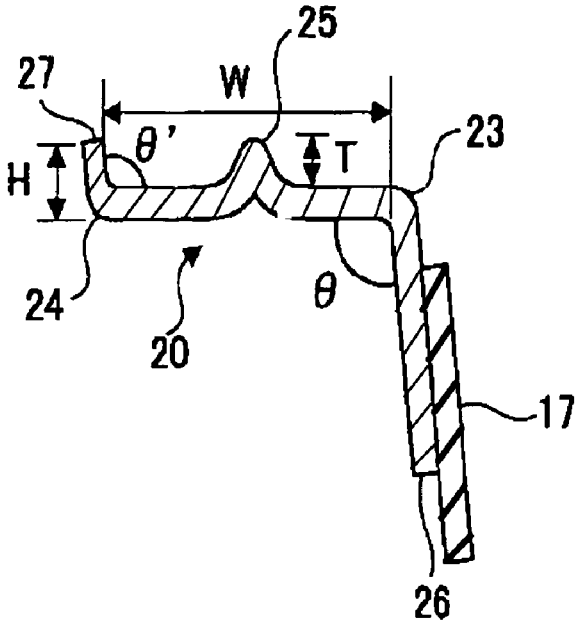

Another cleaning member for use in the image forming apparatus and process cartridge therefor will be illustrated with reference to FIGS. 5A and 5B. FIGS. 5A and 5B are a perspective view and a sectional view taken along the alternate long and short dash lines in FIG. 5A, respectively, of the cleaning member.

The cleaning member shown in FIGS. 5A and 5B has the same configuration as the cleaning member shown in FIGS. 4A and 4B, except for having a protrusion 25 between the first bent portion 23 and the second bent portion 24. The height T of the protrusion 25 from the plane between the first bent portion 23 and the second bent portion is preferably 0.5 mm or more, more preferably 0.7 mm or more, and further preferably 0.8 mm or more and 3 mm or less. The protrusion 25 can have any suitable shape. It preferably extends in parallel with the longitudinal direction of the metallic holder, for easily processing the metallic holder 20. The protrusion 25 may have a convex and/or concave profile in a cross section of a portion between the first bent portion 23 and the second bent portion 24 (FIGS. 5A and 5B). The structure having a convex and/or concave profile may be formed by casting but is preferably formed by bending for more effectively reducing the noise caused by the friction between the cleaning blade 17 and the photoconductor 11. This is because, by bending, the metal in the three bent portions has a structure different from that of the metal in a portion not bent, and the deformation of the metallic holder 20 is thus reduced.

The cleaning member may further comprise one or more convex portions (protrusions) having an optional shape between the first bent portion 23 and the second bent portion 24, in addition to the protrusion shown in FIGS. 5A and 5B.

These additional convex portions (protrusions) can be formed by casting or by bonding shaped articles.

It is preferred that the cleaning member has one or more protrusions being arranged between the first bent portion 23 and the second bent portion 24 and having a height from the plane between the first bent portion 23 and the second bent portion 24 of 0.5 mm or more. The protrusions work to increase the rigidity of a portion between the first bent portion 23 and the second bent portion 24 and to reduce the-vibration of a portion from the first bent portion 23 to the first edge 26. Thus, the noise occurring after the completion of image formation before stop of the photoconductor can be reduced to such a level that users do not significantly aware.

Figure 6:
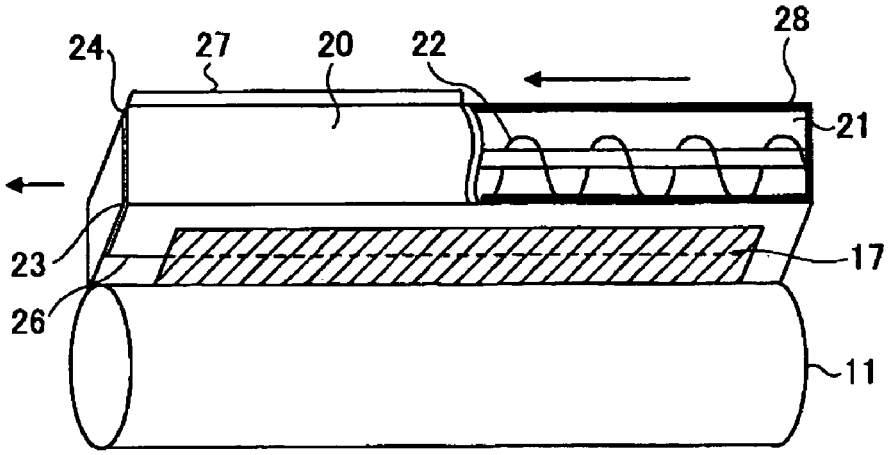
FIG. 6 is a schematic diagram illustrating the functions of the cleaning member for use in the image forming apparatus of the present invention.

The functions of the cleaning member in the image forming apparatus will be illustrated with reference to FIG. 6. The metallic holder 20 preferably has a function as the lid of the developer-recovering device 21 (FIG. 6). In this case, the portion between the first bent portion 23 and the second bent portion 24 of the metallic holder 20 is fixed to a sealing 28 of the developer-recovering device 21. By using the metallic holder 20 as the lid of the developer-recovering device 21, the image forming apparatus occupies less space (miniaturized) and can be composed of parts in a less number.

In the case where the metallic holder 20 of the cleaning member is used as the lid of the developer-recovering device 21, a flexible member is preferably attached to a side of the portion between the first bent portion 23 and the second bent portion 24 facing the developer-recovering device typically using a double-sided adhesive tape or adhesive. Thus, the recovered developer is substantially prevented from scattering out of the developer-recovering device. Examples of such flexible member are urethane foams, Moltoprene (black light-shielding material), felts, films and flexible plastics.

The image forming apparatus may have the developer-recovering device 21 for recovering the developer removed by the cleaning member and conveying the same to a used-developer bottle (waste-toner bottle) or to a developer-feeding section. The residual developer containing the toner on the photoconductor 11 is removed therefrom by the cleaning blade 17 of the cleaning member. The used developer removed from the photoconductor 11 by the cleaning member is recovered into the developer-recovering device 21 having a screw 22, is conveyed to the used-developer bottle or to the developer-feeding section in the developing device by the screw 22 in the developer-recovering device 21. Thus, the developer removed from the photoconductor by the cleaning member can be recycled and reused. In FIG. 6, the direction of the arrow is conveying direction of used developer.

The metallic holders in the embodiments mentioned above and below correspond to blade holder in the appended claims.

The image forming apparatus and process cartridge according to this embodiment have a simple configuration, can reduce noise, are down-sized and are available at low cost.

Another embodiment of the image forming apparatuses according to the present invention will be illustrated with reference to FIGS. 7, 8, 9A and 9B. The image forming apparatus according to this embodiment has a sheet-conveying path (not shown). The sheet-conveying path works to convey a sheet recording member such as a paper from a sheet-feeding section via printer engine to a sheet-ejecting section.

Figure 7:
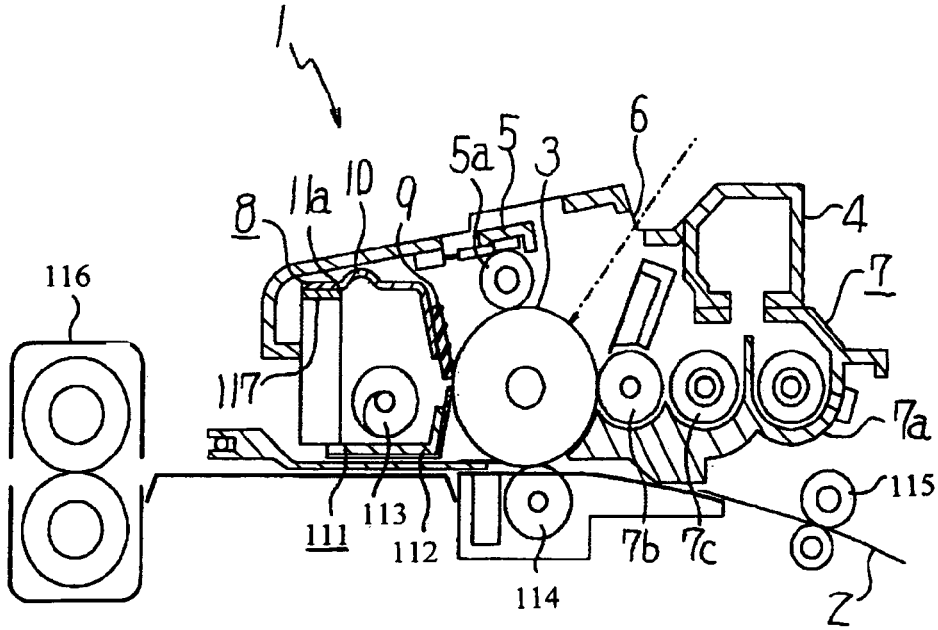
FIG. 7 is a schematic diagram illustrating a printer engine for use in the image forming apparatus as an embodiment of the present invention.

FIG. 7 is a schematic sectional view illustrating a printer engine of the image forming apparatus according to a preferred embodiment of the present invention. With reference to FIG. 7, the printer engine 1 comprises a photoconductor 3 facing a sheet-conveying path 2. The photoconductor 3 is housed in a cartridge casing 4 that is attachable to and detachable from the main body of the image forming apparatus (not shown).

The cartridge casing 4 also houses a charger 5 which works to charge the surface of the photoconductor 3 uniformly.

The charger 5 may charge the photoconductor 3 according to corotron system or scorotron system. Alternatively, the distance between the photoconductor 3 and the charger 5 is preferably set at 0 to 100 μm, more preferably 0 to 60 μm, and further preferably 0 to 30 μm. By setting the distance at 0 to 100 μm, oxidative substances such as ozone and NOx can be reduced in the image forming apparatus. It is also preferred that an alternating current is superimposed onto a bias current to be applied to the charger 5 upon charging. Thus, the voltage of the photoconductor can be easily controlled.

To charge the photoconductor 3 by the charger 5 at a distance from 0 to 100 μm, a contact charging system such as charging with a roller, blush, blade or magnetic blush, or a charging system with micro gap, in which the charger 5 charges the photoconductor 3 with the interposition of a micro gap, can be used.

The charger 5 for use in this embodiment is of contact charging system and has a charger roller 5*a* which is arranged in contact with the surface of the photoconductor 3 (FIG. 7).

The cartridge casing 4 houses a window 6 through which scanning light from a light irradiator (not shown) of the main body of the image forming apparatus. The light irradiator applies the scanning light to the uniformly charged photoconductor 3 based on the image formation to thereby form a latent electrostatic image thereon.

In the cartridge casing 4 is arranged a developing device 7 for applying the developer (toner) to the exposed surface of the photoconductor 3 irradiated by the light irradiator. The developing device 7 typically comprises a toner casing 7*a* for housing the developer containing the toner, a developing roller 7*b* being arranged in contact with the photoconductor 3, and a feeding roller 7*c* for feeding the developer (toner) in the toner casing 7*a* to a developing. roller 7*b*.

The cartridge casing 4 also houses a cleaning mechanism 8 for removing the residual toner from the photoconductor 3. While the details will be mentioned later, the cleaning mechanism 8 typically comprises a cleaning blade 9, a blade holder 10 and a toner-recovering device 111. The cleaning blade 9 is typically made of an elastic material such as urethane rubber. The blade holder 10 works to hold the cleaning blade 9. The toner-recovering device 111 works to recover the toner removed from the photoconductor 3 by the cleaning blade. The toner-recovering device 111 comprises a casing 112, a screw 113 and an opening (not shown). The casing 112 works to house the toner removed from the photoconductor 3. The screw 113 works to convey the scraped toner into the casing 112. The opening works to eject the toner from the casing 112.

According to this embodiment, the cartridge casing 4 and the individual members housed therein constitute a process cartridge.

The printer engine 1 has a transfer device 114 which faces the photoconductor 3 with the interposition of the sheet-conveying path 2. The transfer device 114 works to transfer the toner image from the photoconductor 3 to the recording sheet conveyed in the sheet-conveying path 2.

The printer engine 1 also has a resist roller 115. The resist roller 115 works to convey the recording roller to the transfer position of the transfer device 114 while controlling the conveying timing matching the transfer procedure.

The printer engine 1 further includes an image-fixing device 116 arranged downstream from the photoconductor 3 in the conveying direction of the recording sheet. The image-fixing device 116 works to apply heat and pressure to the recording sheet bearing the transferred toner image to fuse and thereby fix the toner on the recording sheet.

Figure 8:
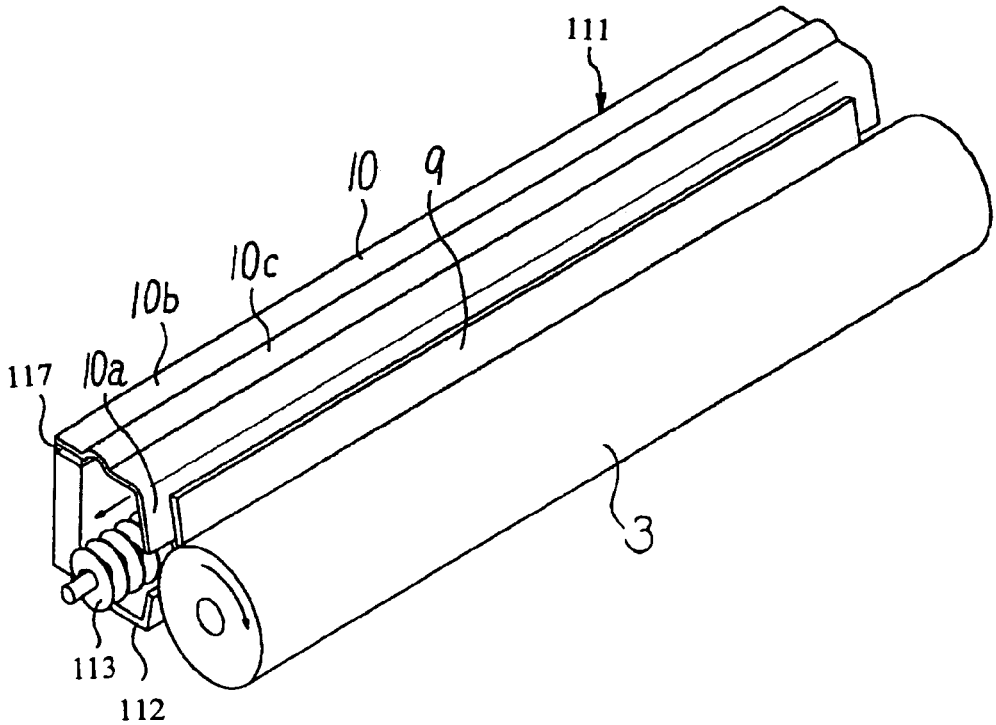
FIG. 8 is a perspective view of a cleaning mechanism.
Figure 9A:
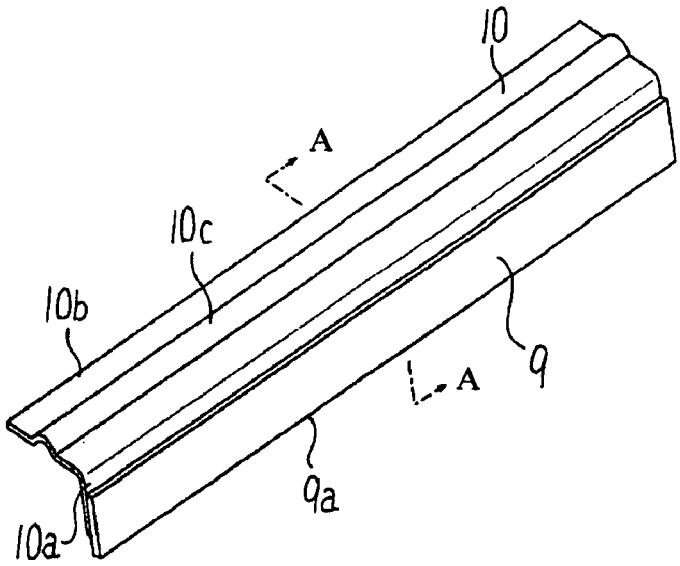
FIGS. 9A and 9B are perspective view and a sectional view taken along the line 3—3, respectively, of a part of the cleaning mechanism.
Figure 9B:
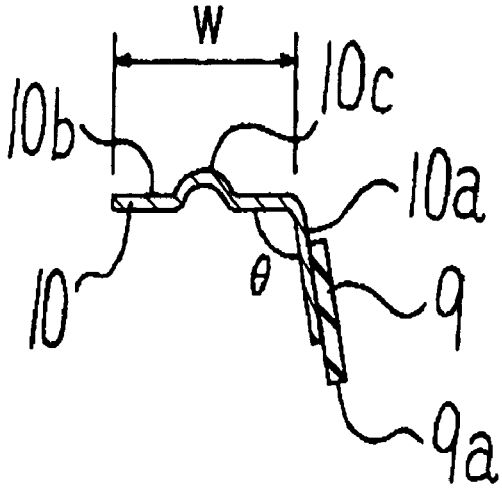

Next, the cleaning mechanism 8 will be illustrated. FIG. 8 is a perspective view of the cleaning mechanism 8, and FIGS. 9A and 9B are a perspective view and a sectional view taken along the line A—A, respectively, of a part of the cleaning mechanism 8. As is described above, the cleaning mechanism 8 comprises the cleaning blade 9, the blade holder 10 for holding the cleaning blade 9, and the toner-recovering device 111 for recovering the toner removed from the photoconductor by the cleaning blade 9.

The cleaning blade 9 has a contact site 9*a* which is in contact with the photoconductor 3 along the axial direction thereof. The cleaning blade 9 according to this embodiment is a rectangular plate member made of an elastic material. One side in a longitudinal direction of the cleaning blade 9 serves as the contact site 9*a* which is arranged in contact with the outer periphery of the photoconductor 3. The cleaning blade 9 according to this embodiment is arranged always in contact with the photoconductor 3 even when image formation is not carried out.

The blade holder 10 is an L-shaped bent metallic plate member. The plate member constituting the blade holder 10 according to this embodiment has a thickness of 1.0 to 2.5 mm. The thickness of the blade holder 10 is preferably from 1.2 to 2.2 mm, and more preferably from 1.4 to 2.0 mm. The blade holder 10 is arranged so that its L-shaped bent portion extends in parallel with the axial direction of the photoconductor 3.

By bending the metallic plate member into L shape, the blade holder 10 has two flat portions 10*a* and 10*b* with a longitudinal direction in parallel with the axial direction of the photoconductor 3 with the interposition of the bent portion. The two flat portions 10*a* and 10*b* in the blade holder 10 form an angle θ in a cross section in a direction perpendicular to the axial direction of the photoconductor 3 (FIG. 9B).

The angle θ shown in FIG. 9B is preferably from 70 to 135 degrees, more preferably from 80 to 120 degrees and further preferably from 85 to 110 degrees.

A long side of the cleaning blade 9 opposite to the contact site 9*a* is fixed to the first flat portion 10*a* of the blade holder 10.

The other second flat portion 10*b* of the blade holder 10 is attached to a part of the casing 112 and serves also as a lid of an opening 11*a* of the toner-recovering device 111. The opening 11*a* is different from the above-mentioned opening for toner recovery. The second flat portion 10*b* of the blade holder 10 has a width w (FIG. 9B) in a direction perpendicular to the contact site 9*a* of 10 mm or more. The width W is preferably 12 mm or more, and more preferably 14 to 20 mm.

The second flat portion 10*b* of the blade holder 10 has a protrusion 10*c*. The protrusion 10*c* projects from the second flat portion 10*b* and extends in parallel with the contact site 9*a*, i.e., the L-shaped bent portion of the blade holder 10. The protrusion 10*c* projects 0.5 mm or more from the second flat portion 10*b* of the blade holder 10 toward above in FIG. 9B. The projection of the protrusion 10*c* from the second flat portion 10*b* of the blade holder 10 is preferably 0.7 mm or more, and more preferably from 0.8 to 3 mm. The protrusion 10*c* in this embodiment has a semicircular profile in a cross section in a direction perpendicular to the axial direction of the photoconductor 3 and the entire protrusion 10*c* has a semicircular cylindrical shape.

If the protrusion 10*c* protrudes less than 0.5 mm from the second flat portion 10*b* of the blade holder 10, the second flat portion 10*b* of the blade holder 10 may significantly vibrate when the rotating photoconductor 3 is stopped.

The protrusion 10*c* in this embodiment has a semicircular profile as shown in FIG. 9B. However, the profile (sectional shape) of the protrusion 10*c* is not specifically limited and can be any profile such as elliptic arc, triangular or polygonal profile. The protrusion 10*c* in this embodiment continuously extends in parallel with the axial direction of the photoconductor 3, but the protrusion 10*c* can have any configuration and is not necessarily continuous. For further improved processability and reproducibility, the protrusion 10*c* preferably continuously extends along the axial direction of the photoconductor 3. For further effectively reducing the noise immediately before stop of the rotation of the photoconductor 3, the protrusion 10*c* preferably has a semicircular or elliptic profile and continuously extends along the axial direction of the photoconductor 3.

The width (size in a width direction or cross direction) of the protrusion 10*c* is preferably from 1 to 7 mm and more preferably from 2 to 6 mm.

If the width of the protrusion 10*c* is less than 1 mm, the noise upon stop of the rotation of the photoconductor 3 may not be effectively reduced. If it exceeds 7 mm or more, the accuracy of finishing may not be increased sufficiently and the toner may possibly scatter from the opening 11*a* of the casing 112 of the toner-recovering device 111. In addition, the blade holder 10 may increasingly vibrate, thus inviting increased noise.

The area ratio of the protrusion 10*c* in this embodiment to flat portions of the second flat portion 10*b* of the blade holder 10 is preferably from 15 to 70 percent, more preferably from 18 to 60 percent, and further preferably from 20 to 50 percent.

The protrusion 10*c* preferably extends and reaches at least one of the short sides of the blade holder 10. In this embodiment, the protrusion 10*c* extends and reaches both the two short sides of the blade holder 10.

The second flat portion 10*b* of the blade holder 10 works as a lid of the opening 11*a* of the toner-recovering device 111 as well as works to fix the position of the cleaning blade 9. Thus, the image forming apparatus can be down-sized.

As is described above, the toner-recovering device 111 comprises the screw 113 and other parts in the casing 112. If the toner-recovering device has a width w of 10 mm or less, it may be difficult to allow the blade holder 10 to serve as the lid of the toner-recovering device 111 and, simultaneously, to house the screw 113 in the toner-recovering device 111.

The second flat portion 10*b* of the blade holder 10 has a flexible member 117 which is made of a flexible material on the side facing the opening 11*a*. Examples of such soft member are urethane foams, Moltoprene (black light-shielding sponge), felts, films and flexible plastics. The flexible member 117 may be bonded to the second flat portion 10*b* typically using a double-sided adhesive tape or adhesive.

In this embodiment, a side of the second flat portion 10*b* of the blade holder 10 facing the opening 11*a* is flat. The flexible member 117 has a thickness in a thickness direction of the second flat portion 10*b* of the blade holder 10 of preferably 1.5 to 5 mm, and more preferably 2 to 4.5 mm.

The image forming apparatus according to this embodiment further comprises a control system for controlling the rotation of the photoconductor 3 upon image formation. The control system controls the rotation speed of the photoconductor 3 so that the time period during which the number of revolutions of the photoconductor 3 decreases to 1 to 10 rpm after image formation and before stop is at a specific level. The time period is preferably 0.2 second or longer, more preferably 0.3 second or longer and further preferably 0.4 to 1.5 second. More specifically, the control system controls the rotation speed of the photoconductor 3 typically by controlling a driving force for rotating the photoconductor 3, such as a motor.

The control system further controls the temperature of the photoconductor 3 so that the highest temperature of the photoconductor 3 during image formation procedure stands at 38° C. to 56° C. The photoconductor 3 has a temperature sensor (not shown) for detecting the temperature of the photoconductor 3. The control system controls the temperature of the photoconductor 3 based on the temperature detected by the temperature sensor. Thus, the control system serves as temperature controlling means.

The control system preferably controls the photoconductor 3 so that the highest temperature thereof stands at 39° C. to 53° C. and more preferably at 40° C. to 52° C.

Although details are omitted, the image forming apparatus produces an image in the following manner. The charger 5 uniformly charges the surface of the photoconductor 3 while rotating the photoconductor 3. The light irradiator scans and applies light to the photoconductor 3 based on the image data. Then, the developing device 7 supplies the toner to the formed latent electrostatic image to thereby form a toner image thereon. The transfer device 114 transfers the toner image from the photoconductor 3 to a recording sheet, and the image-fixing device 116 fixes the transferred image on the recording sheet.

The photoconductor 3 is arranged in contact with the contact site 9*a* of the cleaning blade 9. Thus, the photoconductor 3 is rotated to thereby allow the cleaning blade 9 to scrape off the residual toner remained on the photoconductor 3 after the transfer of the toner image. The scraped residual toner is recovered into the casing 112 of the toner-recovering device 111 and is ejected to a specific portion out of the casing 112 by the action of rotation of the screw 113.

After all the image formation procedures based on the image information, the rotation speed of the photoconductor 3 is gradually decreased to thereby stop the photoconductor 3. Thus, the image formation is completed.

In conventional image forming apparatuses, noise which users feel unpleasant occurs when the photoconductor 3 rotates at a low speed before stop.

The noise is suspected to occur according to the following mechanism.

When the photoconductor rotates at a low speed immediately before stop and the friction between the photoconductor and the cleaning blade increases, the photoconductor pushes and presses the cleaning blade cleaning blade to thereby deform the cleaning blade. At the time when the energy of the strain becomes larger than the friction force, the cleaning blade rapidly returns to its original state and releases the strain energy. When the cleaning blade returns to its original state, significantly large, uneven and irregular friction occurs between the cleaning blade and the photoconductor. Thus, fluttering or chattering sounds occur in the image forming apparatus.

When the cleaning blade is held by a metallic holder as in conventional image forming apparatuses and becomes distorted by the friction with the photoconductor, the metallic holder holding the cleaning blade also bends and deforms. The restoring force caused by the stress in the metallic holder adds to the restoring force of the cleaning blade upon the restoring of the cleaning blade. Thus, the friction force and friction space (length) between the cleaning blade and the photoconductor increase. The chattering sounds in the conventional image forming apparatuses thereby becomes very loud.

In such a conventional image forming apparatus, the metallic plate (blade holder) holding the cleaning blade is bent into an L-shape to reduce the distortion of the blade holder, and a plane of the metallic plate which does not hold the cleaning blade is used as a lid of a toner-recovering device to save the space of the image forming apparatus and decrease the number of its parts. To use the plane of the blade holder as the lid of the toner-recovering device, the plane must have a width at a specific level or more. However, such a large width of the blade holder invites vibration of the plane. Thus, the vibration of the plane of the blade holder travels to the other plane of the blade holder which holds the cleaning blade, thus causing very loud fluttering sounds.

The image forming apparatus according to this embodiment having the following configuration can reduce the noise caused by the friction between the cleaning blade 9 and the photoconductor 3. More specifically, the image forming apparatus comprises the photoconductor 3, the blade holder 10, the cleaning blade 9, the protrusion 10*c* and the toner-recovering device 111. The photoconductor 3 comprises a cylindrical conductive support and a photoconductive layer arranged on the surface of the cylindrical support. The blade holder 10 is formed by bending a metallic plate member into L-shape and has the first and second flat portions 10*a* and 10*b*. The cleaning blade is held by the first flat portion 10*a* of the blade holder 10 and has the contact site 9*a* which extends along the axial direction of the photoconductor 3 and is in contact with the photoconductor 3. The protrusion 10*c* protrudes from the second flat portion 10*b* of the blade holder 10 and continuously extends in parallel with the contact site 9*a*. The toner-recovering device 111 has the opening 11*a* and works to recover the toner removed from the photoconductor 3 by the cleaning blade 9.

The opening 11*a* is covered by the second flat portion 10*b* of the blade holder 10. The width w of the second flat portion 10*b* of the blade holder 10 in a direction perpendicular to the contact site 9*a* is set at 10 mm or more. The protrusion 10*c* protrudes 0.5 mm or more from the second flat portion 10*b* of the blade holder 10. The blade holder 10 can therefore hold the cleaning blade 9 and serve as a lid for the opening 11*a* of the toner-recovering device 111. The protrusion 10*c* can work to reduce the vibration of the second flat portion 10*b* of the blade holder 10 and to prevent travelling of the vibration to the cleaning blade 9. Thus, the friction between the cleaning blade 9 and the photoconductor 3 caused by the vibration can be reduced to thereby reduce the noise.

The protrusion 10*c* which protrudes 0.5 mm or more from the second flat portion 10*b* of the blade holder 10 as in this embodiment can work to reduce the vibration of the blade holder 10 upon stop of the rotation of the photoconductor 3 and thereby to reduce the noise from the image forming apparatus.

The blade holder of the image forming apparatus according to this embodiment is prepared by bending a plate member having a thickness of 1.0 to 2.5 mm into an L shape. Thus, the image forming apparatus can maintain sufficient strength of the blade holder, avoid streaky irregular images due to cleaning failure or band-shaped irregular images due to irregular abrasion of the photoconductor after repetitive image formation procedures and thereby prevent the noise caused by irregular abrasion. In addition, the blade holder can be easily prepared by pressing or punching and is available at lower cost.

If the metallic plate member constituting the blade holder 10 has a thickness less than 1.0 mm, the blade holder 10 may not have sufficient strength, thus causing cleaning failure and thereby streaky irregular images. The photoconductor 3 may be abraded by the cleaning blade 9 irregularly or unevenly after repetitive image formation procedures, thus causing band-shaped irregular images. In addition, the noise caused by the friction immediately before the stop of the photoconductor 3 may become loud.

In contrast, if the metallic plate member constituting the blade holder 10 has a thickness more than 2.5 mm, the blade holder 10 may not be satisfactorily prepared by pressing or punching, thus inviting increased process cost.

The thickness of the metallic plate member constituting the blade holder 10 in this embodiment is set at 1.0 to 2.5 mm, preferably 1.2 to 2.2 mm, and more preferably 1.4 to 2.0 mm. Thus, the blade holder 10 has sufficient strength, and the image forming apparatus can avoid irregular images and reduce the noise occurring immediately before the stop of the rotation of the photoconductor 3. In addition, the blade holder 10 can be prepared by pressing or punching and be available at lower cost.

In the image forming apparatus according to this embodiment, the protrusion 10*c* extends and reaches at least one edge of the second flat portion 10*b* of the blade holder 10. Thus, the noise caused by the friction between the cleaning blade 9 and the photoconductor 3 can be more effectively reduced.

In addition, the image forming apparatus has the flexible member 117 which is arranged in the second flat portion 10*b* of the blade holder 10 near to the opening 11*a* and is made of a flexible material such as urethane foams, Moltoprene (black light-shielding sponge), felts, films and flexible plastics. Thus, the opening 11*a* can be surely covered to thereby prevent the toner recovered by the toner-recovering device 111 from scattering.

The flexible member 117 herein has a thickness of 1.4 to 5 mm in a thickness direction of the second flat portion 10*b* of the blade holder 10. Thus, the opening 11*a* can be more surely covered to thereby prevent the toner recovered by the toner-recovering device 111 from scattering more reliably.

If the thickness of the flexible member 117 is less than 1.5 mm, the toner may often scatter from the casing 112 of the toner-recovering device 111 and deposit in the image forming apparatus. If it exceeds 5 mm, the accuracy of finishing may decrease and the toner thereby may often scatter from the casing 112 of the toner-recovering device 111 and deposit in the image forming apparatus.

In contrast, the thickness of the flexible member 117 according to this embodiment is set at 1.5 to 5 mm, and preferably 2 to 4.5 mm. Thus, the second flat portion 10*b* can more reliably cover the opening 11*a* and avoid the toner recovered by the cleaning blade 9 from scattering out of the casing 112.

The area ratio of the protrusion 10*c* to the flat area of the second flat portion 10*b* of the blade holder 10 is set at 15 to 70 percent according to this embodiment. Thus, the image forming apparatus can surely reduce the vibration of the second flat portion 10*b*, thereby more reliably reduce the friction between the cleaning blade 9 and the photoconductor 3 due to travel of the vibration of the second flat portion 10*b* to the cleaning blade. The apparatus can thereby more reliably reduce the noise caused by the friction between the cleaning blade 9 and the photoconductor 3.

If the area ratio of the protrusion 10*c* to the flat area of the second flat portion 10*b* of the blade holder 10 is less than 15 percent, the second flat portion 10*b* significantly vibrates when the photoconductor 3 comes to a stop, and the noise immediately before the stop of the photoconductor 3 may not be prevented satisfactorily.

If the area ratio of the protrusion 10*c* to the flat area of the second flat portion 10*b* of the blade holder 10 is more than 70 percent, a sufficient accuracy of finishing may not be attained, and the toner may often scatter from the casing 112 of the toner-recovering device 111. In addition, the vibration of the blade holder 10 may be accelerated, thus causing louder noise by contraries.

The area ratio of the protrusion 10*c* according to this embodiment to the flat area of the second flat portion 10*b* of the blade holder 10 is set at 15 to 70 percent, preferably 18 to 60 percent, and more preferably 20 to 50 percent. Thus, the image forming apparatus can reduce the noise upon stop of the photoconductor 3.

The time period during which the number of revolution of the photoconductor 3 falls in a range from 1 to 10 rpm before its stop is set at 0.2 second or longer. Thus, the image forming apparatus can reduce the noise caused by the friction between the cleaning blade 9 and the photoconductor 3 without an extra stopping mechanism for rapidly stopping the rotation of the photoconductor 3.

The noise caused by the friction between the cleaning blade 9 and the photoconductor 3 markedly occurs when the inside temperature of the image forming apparatus rises typically due to repetitive image formation procedures, and the cleaning blade becomes soft and thereby vibrates at a higher amplitude.

In contrast, the image forming apparatus herein is so configured that the highest temperature of the photoconductor 3 during image formation procedure stands at 38° C. to 56° C. Thus, the image forming apparatus can reduce the noise caused by the friction between the cleaning blade 9 and the photoconductor 3 without an extra cooling mechanism for rapidly cooling the photoconductor 3.

In the image forming apparatus, the control system controls so that the highest temperature of the photoconductor 3 during image formation procedure stands at 38° C. to 56° C., preferably 39° C. to 53° C., and more preferably 40° C. to 52° C. Thus, the image forming apparatus can prevent the cleaning blade from softening and having an increased impact resilience and thereby reduce the noise caused by the friction between the cleaning blade 9 and the photoconductor 3.

In the image forming apparatus, the photoconductor 3 comprises a biphenyl derivative and a compound represented by Formula (I) in its photoconductive layer. Thus, the image forming apparatus can reduce the noise caused by the friction between the cleaning blade 9 and the photoconductor 3 even though the photoconductor comprises the compound of Formula (I) in its photoconductive layer. In this connection, it is believed that, if the photoconductive layer comprises the compound of Formula (I) alone, the resulting image forming apparatus may produce noise caused by the friction between the cleaning blade 9 and the photoconductor 3 louder than one in which the photoconductive layer comprises neither the biphenyl derivative nor the compound of Formula (I).

The photoconductor 3 herein comprises 0.5 to 7 percent by weight of a bisbenzylbenzene derivative in its photoconductive layer. Thus, the above-mentioned advantages are more effectively obtained in practice.

It is preferred that the image forming apparatus further comprises the charger 5 for uniformly charging the photoconductor 3 and that the distance between the photoconductor 3 and the charger 5 is set at 100 μm or less. Thus the image forming apparatus can reduce oxidative substances such as ozone and NOx, avoid image deterioration due to invasion of the oxidative substances such as ozone and NOx into the photoconductive layer and more effectively exhibit the above advantages in practice. By incorporating the bisbenzylbenzene derivative into the photoconductive layer, image deterioration can be more effectively avoided, and adverse effects on electrostatic properties of the photoconductor 3 can be prevented.

The image forming apparatus herein has the process cartridge comprising the photoconductor 3, the cleaning blade 9 and the blade holder 10 in the cartridge casing 4. The process cartridge can be easily attached to and detached from the main body of the apparatus, and the image forming apparatus has better operability.

In the blade holder 10 of the image forming apparatus, if the angle θ formed by the first and second flat portions 10*a* and 10*b* is less than 70 degrees, the developer-recovering device 111 and/or the casing 112 for holding the blade holder 10 may have a complex shape in order to control the contact angle formed between the cleaning blade 9 and the photoconductor 3 at an optimal level and to use the blade holder 10 as the lid of the developer-recovering device 111.

If the angle θ is larger than 135 degrees, the blade holder 10 may not have sufficient strength, thus causing streaky irregular images due to cleaning failure of the developer. Upon repetitive image formation, the photoconductor 3 may be worn unevenly by the cleaning blade 9, thus often causing band-shaped irregular images. In addition, the noise immediately before stop of the photoconductor 3 after image formation may become relatively loud.

In contrast, the angle θ is set at 70 to 135 degrees, preferably 80 to 120 degrees and more preferably 85 to 110 degrees according to this embodiment. Thus, the contact angle between the photoconductor 3 and the cleaning blade 9 can be controlled at an optimal level, the blade holder 10 can serve as the lid of the toner-recovering device 111 and have sufficient strength, and sufficient cleaning ability can be maintained.

The image forming apparatus preferably further comprises an insert (vibration damper) inside the photoconductor 3 to prevent irregular rotation of the photoconductor 3 to thereby further reduce the noise occurring upon stop of the photoconductor 3.

The insert arranged inside the photoconductor 3 can be any suitable one that has a high density and high adhesion with the cylindrical support of the photoconductor 3. Examples thereof are metals and alloys, such as aluminum, iron, stainless steel and phosphor bronze, as well as rubbers and plastics containing a filler for increasing the density. The insert can have any suitable shape that allows the insert to be easily arranged into and adhered with the cylindrical support of the photoconductor 3. The insert preferably has a C-shaped profile. Thus, the insert can be easily arranged into the cylindrical support and make good contact therewith. The insert may be compressed to have an area smaller than the sectional inside area of the cylindrical support, be placed into the cylindrical support and be allowed to come in intimate contact with the same by the actin of its own spring action (elasticity) or restoring force. Alternatively or in addition, the insert may be bonded to the cylindrical support using an adhesive for better adhesion.

If the insert (vibration damper) itself does not have spring action, the insert can be bonded to the cylindrical support using an adhesive.

Another preferred embodiment of the present invention will be illustrated with reference to FIG. 10, in which the present invention is applied to a copier.

Figure 10:
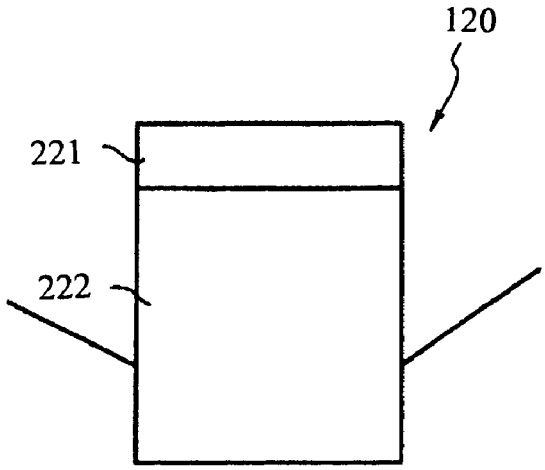
FIG. 10 is a schematic diagram of a copier as an embodiment of the present invention.

FIG. 10 is a schematic diagram of the copier as a preferred embodiment of the present invention. With reference to FIG. 10, the copier 120 comprises a scanner 221 and an image forming apparatus 222. The scanner 221 serves as an image input device for optically reading an original image. The image forming apparatus 222 works to form an image based on the image data read by the scanner 221.

The details of the scanner 221 are not shown in the figure and the description thereof is omitted because it is a conventional technology. Basically, the scanner 221 comprises an image reading optical system that can optically read out the image of the original placed on a contact glass. The image reading optical system typically comprises a scanning optical system for irradiating light and scanning the original placed on the contact glass, and a photoelectric converter for forming digital image data based on the scanning by the scanning optical system.

The image forming apparatus 222 is the image forming apparatus according to any one of the above-mentioned embodiments. The printer engine 1 in this embodiment works to form an image based on the image data produced by the scanner 221.

Thus, the copier 120 can exhibit similar advantages to the image forming apparatus according to any one of the embodiments.

Yet another embodiment of the image forming apparatus of the present invention will be illustrated with reference to FIG. 11. In this image forming apparatus, a contact charger 102 charges a photoconductive drum 101. The charged photoconductive drum 101 is irradiated with light 103 imagewise. The image-wise exposed portions of the photoconductor drum 101 are charged to thereby form a latent electrostatic image thereon. The photoconductive drum 101 bearing the latent electrostatic image then comes into contact with a developer by the action of a developing means 194 to thereby form a toner image. The toner image is transferred from the photoconductive drum 101 to a transfer member 105 such as a recording sheet (paper) by the action of transfer means 106 and the passes through image-fixing means 109 to thereby form a hard copy. The residual toner on the photoconductive drum 101 is removed by cleaning means comprising a metallic blade holder 10 and a cleaning blade 107 held by the blade holder 10. The residual charge of the photoconductive drum 101 is removed by charge-eliminating means 108. Then, another electrophotographic image formation follows.

The image forming apparatus may have a process cartridge integrally composed of charging means, developing means, cleaning means and other means or members. By constituting the process cartridge, the image forming apparatus can be miniaturized, and the process cartridge including these means or members can be easily and conveniently attached to and detached from the main body of the apparatus. The used toner removed by the cleaning means is placed into a toner-recovering device 111 is conveyed by a screw-type conveyer 212 into the developing means 104 and is recycled. A flat portion of the metallic blade holder 10 which does not hold the cleaning blade 107 serves as a lid of the toner-recovering device.

The cleaning device (cleaning means) in the image forming apparatus according to this embodiment will be illustrated with reference to FIGS. 12A and 12B.

The cleaning device comprises the cleaning blade 107 and the metallic blade holder 10 holding the cleaning blade 107. The metallic blade holder 10 has an L-shape profile (FIGS. 12A and 12B). The cleaning blade 107 is fixed to one (first flat portion) of two flat portions constituting the L shape. FIG. 13 shows an embodiment, in which the other flat portion (second flat portion which does not hold the cleaning blade 107) of the blade holder 10 serves as a lid of the toner-recovering device. The thickness of the metallic blade holder 10 and the angle θ formed by the first and second flat portions may be set as above-mentioned embodiments. FIG. 13 also illustrates a sealing 214. In FIG. 13, the direction of the arrow is conveying direction of used developer.

The toner-recovering device 111 works to recover the toner scraped off by the cleaning blade 107. By using the metallic holder 10 holding the cleaning blade 107 as the lid of the toner-recovering device 111, the image forming apparatus can be miniaturized whereas the toner can be recycled.

In this embodiment, the width (w) of the second flat portion of the metallic holder 10 which does not hold the cleaning blade 107 is preferably 10 mm or more, more preferably 12 mm or more, and further preferably from 14 to 20 mm. The toner-recovering device 111 has the screw-type conveyer 212 for conveying the toner and other parts. Thus, if the width w is less than 10 mm, the second flat portion may not serve as the lid of the toner-recovering device 111 housing such screw and other parts. The second flat portion of the metallic blade holder 10 has a flat outer periphery.

In the case where the second flat portion of the metallic blade holder serves as the lid of the toner-recovering device and the outer periphery of the second flat portion is not flat, the toner-recovering device may not be sufficiently sealed, thus inviting the recovered toner to scatter out of the toner-recovering device. The width of the flat outer periphery is preferably 2 mm or more, and more preferably 3 mm or more from the edge. If the width is less than 2 mm, the toner-recovering device may not be sufficiently sealed, thus inviting the recovered toner to scatter out of the toner-recovering device.

The second flat portion of the metallic holder according to this embodiment has a protrusion 213 which protrudes 0.5 mm or more, preferably 0.7 mm or more, and more preferably 0.8 mm to 3 mm from the flat outer periphery. If the height of the protrusion 213 is less than 0.5 mm, the second flat portion which does not hold the cleaning blade may significantly vibrate upon stop of the photoconductor, thus failing to reduce the noise effectively. The area ratio of the protrusion 213 to the total area of the second flat portion is preferably from 15 to 70 percent, more preferably 18 to 60 percent, and further preferably from 20 to 50 percent. If the area ratio is less than 15 percent, the second flat portion which does not hold the cleaning blade may significantly vibrate upon stop of the photoconductor, thus failing to reduce the noise effectively. If it exceeds 70 percent, a sufficient accuracy of finishing may not be obtained, thus inviting scattering of the recovered toner out of the toner-recovering device.

The second flat portion of the metallic holder preferably has an edge bent upward or downward. Thus, the noise caused by the friction between the cleaning blade and the photoconductor can further be reduced.

Figure 12A:
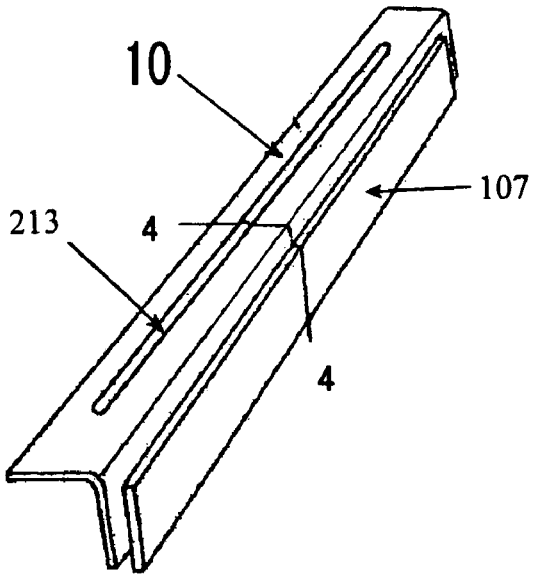
FIGS. 12A and 12B are a schematic perspective view and a sectional view taken along the line 4—4, respectively, of a cleaning member for use in the image forming apparatus.
Figure 12B:
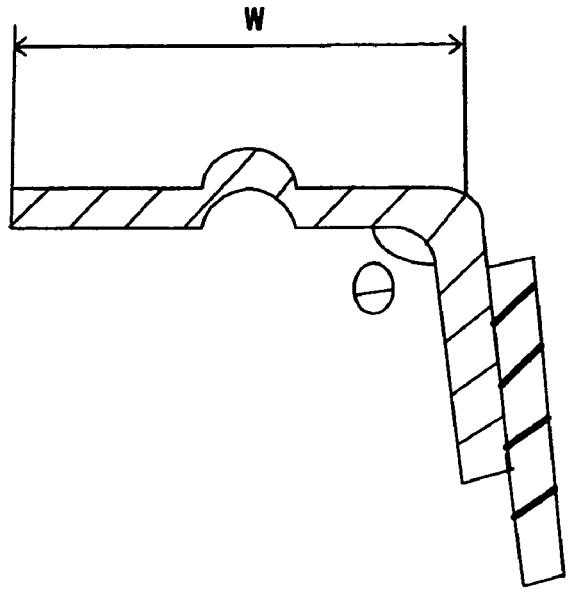
Figure 13:
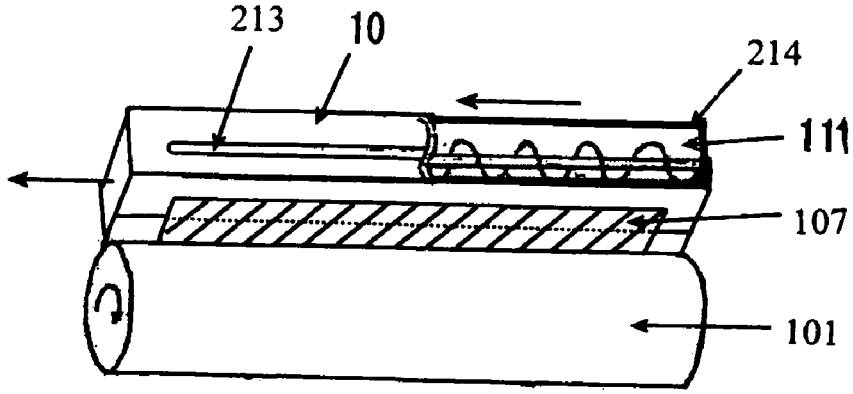
FIG. 13 is a schematic diagram of a cleaning blade which also serves as a lid of a toner recovering device for use in the image forming apparatus.

While the protrusion 213 is illustrated to have a continuous semicylindrical shape in FIGS. 12A and 12B, the sectional shape is not specifically limited and can be any one such as elliptic circular, triangular or polygonal profile, and the protrusion 213 may comprise a plurality of discontinuous sections. However, for better processing, higher reproducibility and further effective prevention of the noise upon stop of the photoconductor, the protrusion 213 is preferably continuous and has a circular or elliptic arc profile. The width of the protrusion 213 is preferably 1 to 7 mm, and more preferably 2 to 6 mm. If the width of the protrusion 213 is less than 1 mm, the protrusion 213 may not effectively work to reduce the noise. If it exceeds 7 mm, a sufficient accuracy of finishing may not be obtained, thus inviting scattering of the recovered toner out of the toner-recovering device.

The second flat portion of the metallic holder preferably carries a flexible member on the downside thereof. Thus, the recovered toner can be significantly prevented from scattering out of the toner-recovering device. The flexible member has a thickness of preferably 0.5 to 3 mm, and more preferably 0.8 to 2.5 mm and is made of, for example, urethane foam, Moltoprene (black light-shielding sponge), felt, film or flexible plastic. The flexible member may be bonded to the second flat portion typically using a double-sided adhesive tape or an adhesive.

Figure 14A:
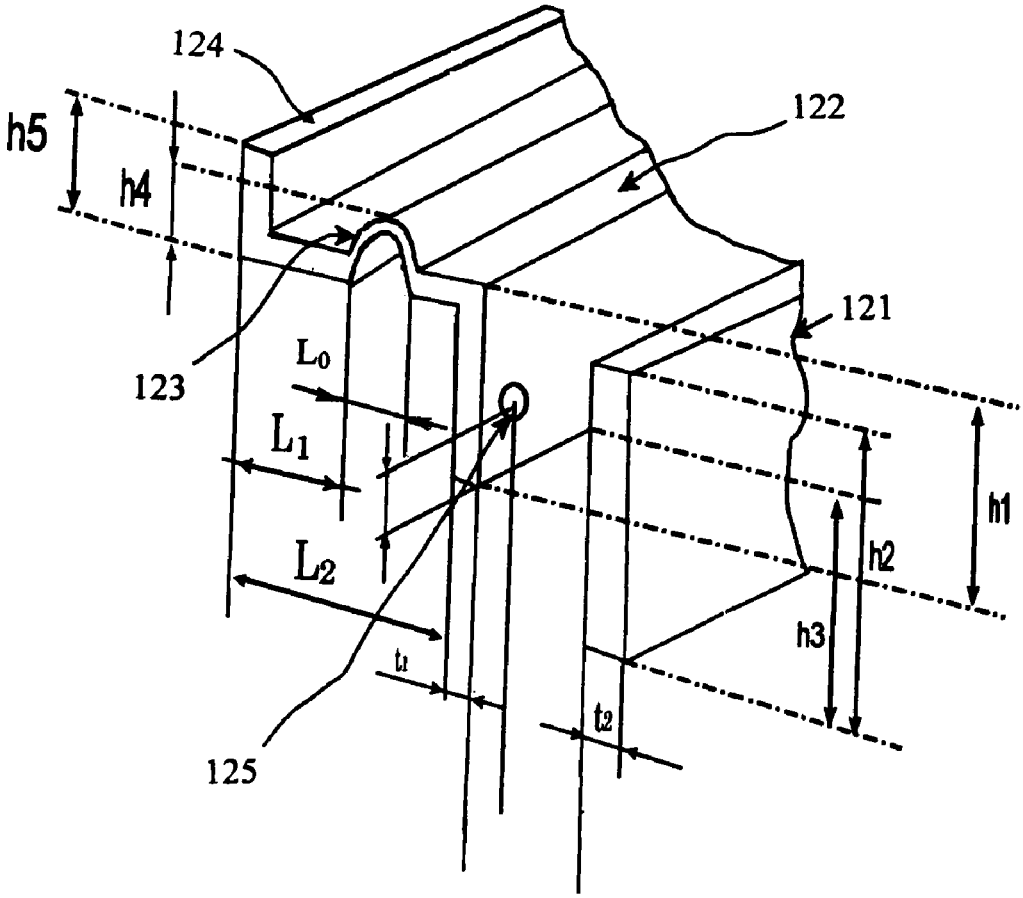
FIGS. 14A and 14B are a perspective view and a side view, respectively, of a cleaning blade 121 bonded to a blade holder 122 having a beaded portion 123 and an L-shaped portion 124.

Another embodiment of the image forming apparatus will be illustrated with reference to FIGS. 14A and 14B. This embodiment is typically effective for reducing the noise in the case where the photoconductive layer comprises the biphenyl derivative and/or the compound of Formula (I) as mentioned below. FIG. 14A is a perspective view in which a cleaning blade 121 is bonded to a blade holder 122 having a beaded portion 123 and a second bent portion 24. The beaded portion 123 preferably has a height h4 of about 0.5 to about 3 mm and a width $L_0$ of about 3 to about 10 mm, while depending on the width L2 of a flat portion (second flat portion) of the blade holder 122. If the height h4 is less than about 0.5 mm, the vibration of the blade holder may not be sufficiently effectively reduced. If it exceeds 3 mm, such a beaded portion may not be satisfactorily molded. If the width $L_0$ is less than 3 mm, the blade holder may not be prepared with a sufficient accuracy of finishing. If it exceeds 20 mm, the vibration of the blade holder may not be sufficiently effectively reduced. The distance L1 of the beaded portion 123 from the edge is preferably 10 to 70 percent of the width L2 of the second flat portion of the blade holder 122.

The height h5 of the second bent portion 24 is preferably 5 to 30 percent of the width L2 of the second flat portion of the blade holder 122. The beaded portion 123 and the second bent portion 24 preferably occupy 70 percent or more of the longitudinal direction of the blade holder 122. The blade holder 122 is preferably made of a material having rigidity, such as steel sheet or stainless steel sheet. The thickness t1 of the blade holder 122 is preferably 0.8 to 3 mm, provided that the length of the blade holder is 350 mm or less, which corresponds to A3-sized sheets placed in portrait configuration. The cleaning blade 121 is bonded to a first flat potion having a width of hi of the blade holder 122 with an extension h3 typically using a hot melt resin or an adhesive. The cleaning blade 121 is made of a urethane rubber and has a thickness t2 of 1 to 3 mm and a width h2 of 8 to 30 mm.

The extension h3 is preferably one-thirds to five-sixths of the width h2 of the cleaning blade 121. The cleaning blade 121 is screwed and fixed to the blade holder 122 at screw portions 125 at both edges in a longitudinal direction.

Figure 14B:
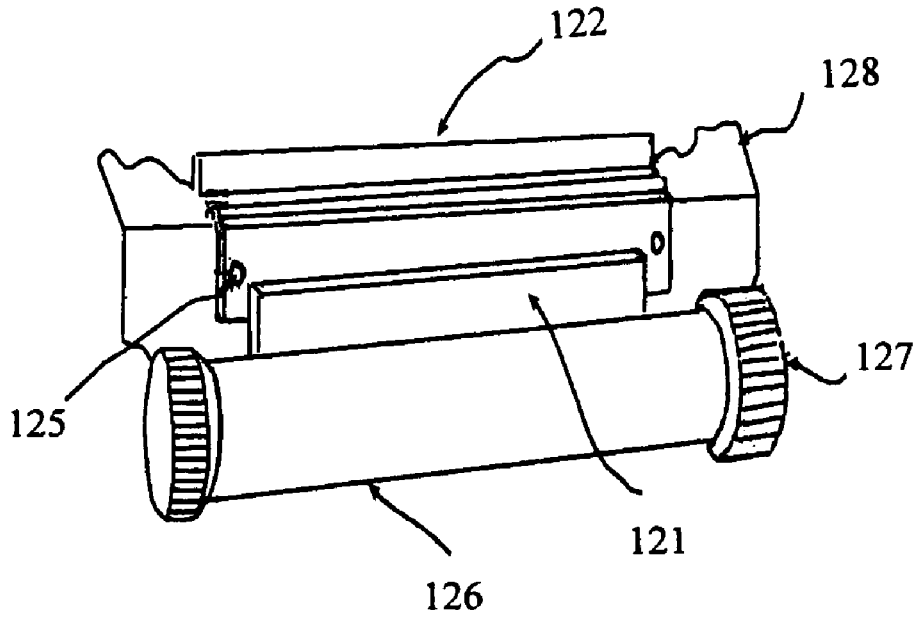

FIG. 14B is a perspective view in which the cleaning blade 121 is in contact with a photoconductive drum 126 having flanges 127 at ends. The cleaning blade 121 fixed to the blade holder 122 using a hot-melt resin is screwed to a process cartridge 128 at the screw portions 125. The screw portions 125 are arranged only at the edges of the blade holder 122, and thus the cleaning blade 121 can be easily replaced.

By allowing the blade holder 122 to have the beaded portion 123 and the L-shaped portion 24, the blade holder has increased strength and is less deformed during cleaning to thereby stably carry out the cleaning. In addition, the cleaning blade 121 applies less load torque upon the photoconductive drum 126, and the abrasion loss of the photoconductive layer of the photoconductive drum 126 after repetitive image formation procedures can be reduced. The image forming apparatus is preferably so configured that the highest temperature of the photoconductive drum during image formation stands at 40° C. to 55° C. and that the torque per unit length of the cleaning blade to the photoconductive drum is 0.95 cN or less at such temperatures. Thus, the vibration sounds of the photoconductive drum and the abrasion of the photoconductive layer can be reduced.

The photoconductor for use in the process cartridge for the image forming apparatus will be illustrated. The photoconductor comprises a photoconductive layer and a cylindrical support supporting the photoconductive layer. The photoconductive layer typically comprises a charge-generating layer and a charge-transport layer and may further comprise an undercoat layer below the charge-generating layer and/or a protective layer on or above the charge-transport layer.

The outer diameter of the cylindrical support of the photoconductor is preferably 60 mm or less, more preferably 50 mm or less, and further preferably 20 mm or more and 40 mm or less. If the outer diameter is more than 60 mm, the photoconductor may have an excessively large size and the image forming apparatus may not be miniaturized, and in addition, the photoconductor may have an excessively large weight and invite higher energy consumption for driving the photoconductor, although the photoconductor has a large heat capacity, the photoconductor and the cleaning blade are hardly raised in temperature excessively, the photoconductor can rotate relatively stably, and the noise caused by the friction between the photoconductor and the cleaning blade can be reduced. In contrast, if the outer diameter of the cylindrical support is 60 mm or less, the photoconductor may have a small heat capacity and may invite the noise caused by the friction between the photoconductor and the cleaning blade. However, using the cleaning member according to this embodiment reduces the noise.

The thickness of the cylindrical support is preferably 0.3 mm to 2 mm, and more preferably 0.4 mm to 1.2 mm. The cylindrical support having a relatively small thickness may have a relatively small heat capacity and invite the noise caused by the friction between the photoconductor and the cleaning blade. However, using the cleaning member according to this embodiment reduces the noise. However, if the thickness of the cylindrical support is less than 0.3 mm, the photoconductor may not have sufficient mechanical strength and require an extra member such as a backup roller in the photoconductor in practical use. If the thickness exceeds 2 mm, the photoconductor may have an excessively large size and the image forming apparatus may not be miniaturized, and in addition, the photoconductor may have an excessively large weight and invite higher energy consumption for driving the photoconductor, although the photoconductor has a large heat capacity, the photoconductor and the cleaning blade are hardly raised in temperature excessively, the photoconductor can rotate relatively stably, and the noise caused by the friction between the photoconductor and the cleaning blade can be reduced. More specifically, at the thickness of the cylindrical support within a range of 0.3 mm or more and 2 mm or less, the photoconductor has sufficient mechanical strength, and the image forming apparatus can reduce the noise upon stop of the photoconductor without increasing number of parts and increasing production cost.

The length (size in the axial direction) of the cylindrical support is preferably 390 mm or less. Thus, the photoconductor rotates more uniformly, and the friction between the photoconductor and the cleaning blade occurs more uniformly, and the fluttering or chattering sounds are reduced. If the length of the cylindrical support is relatively large, the photoconductor may rotate more irregularly, the friction between the photoconductor and the cleaning blade may occur more irregularly and invite fluttering or chattering sounds. The cleaning member according to this embodiment can reduce the noise. However, if the length of the cylindrical support is more than 390 mm, the photoconductor may have an excessively large size, the image forming apparatus may not be miniaturized and the fluttering or chattering sounds may relatively often occur.

The length of the cylindrical support is preferably 310 mm to 390 mm, more preferably 320 mm to 390 mm, and further preferably 330 mm to 390 mm.

The image forming apparatus according to this embodiment preferably further comprise an insert (vibration damper) inside the photoconductor to stabilize the rotation of the photoconductor to thereby further reduce the noise upon stop of the photoconductor after image formation.

The insert arranged inside the photoconductor can be any suitable one that has a high density and high adhesion with the cylindrical support. Examples thereof are metals and alloys, such as aluminum, iron, stainless steel and phosphor bronze, as well as rubbers and plastics containing a filler for increasing the density. The insert can have an O-shaped, C-shaped or any other suitable shape that allows the insert to be easily arranged into and adhered with the cylindrical support of the photoconductor. The insert preferably has a C-shaped profile. Thus, the insert can be easily placed into the cylindrical support and make good contact therewith.

The insert may be compressed to have an area smaller than the sectional inside area of the cylindrical support, be placed into the cylindrical support and be allowed to come in intimate contact with the same by the actin of its own spring action (elasticity) or restoring force. Alternatively or in addition, the insert may be bonded to the cylindrical support using an adhesive for better adhesion. If the insert (vibration damper) itself does not have spring action or elastic force, the insert can be bonded to the cylindrical support using an adhesive.

Figure 15A:
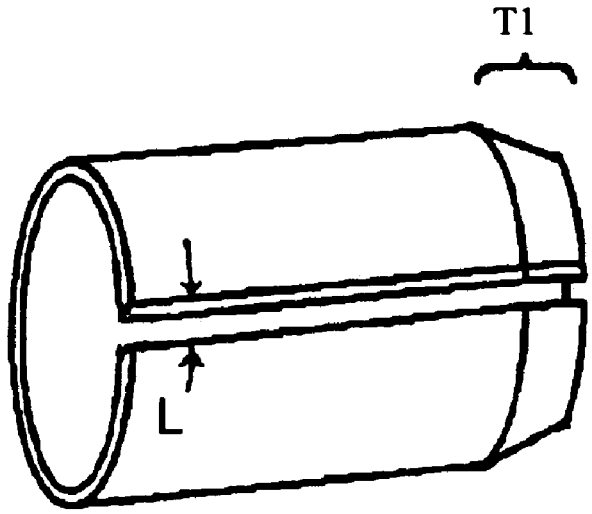
FIGS. 15A, 15B and 15C are a perspective view, a side view and a elevation view, respectively, of a vibration damper for use in the present invention.
Figure 15B:
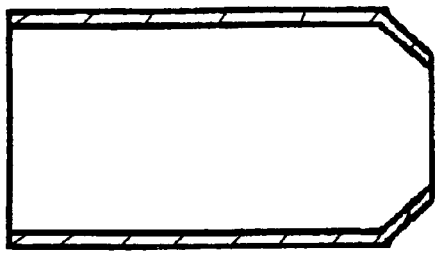
Figure 15C:
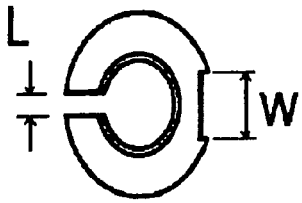

FIGS. 15A, 15B and 15C show a vibration damper for use in the image forming apparatus. The vibration damper preferably has a substantially C-shaped profile. The slit width L of the C-shape preferably occupies 0.5 to 3 percent of the circumference. If the slit width L occupies less than 0.5 percent, the photoconductive drum may deform when the vibration damper is inserted thereinto, due to dimensional tolerances of the inner diameter of the photoconductive drum and the outer diameter of the vibration damper. If the slit width L occupies more than 3 percent, the vibration sounds (noise) upon stop of the photoconductive drum may not be effectively reduced and the photoconductive drum may rotate irregularly. The vibration damper is tapered at one end (see T1 shown in FIG. 15A) and can thereby be inserted smoothly into the cylindrical support of the photoconductive drum.

Preferably, two or more pieces of the vibration damper in the axial direction of inside surface of the photoconductive drum (cylindrical support) for further reducing the vibration sounds (noise). In this case, the plurality of vibration dampers are preferably arranged at certain intervals to avoid the vibration of caused by the vibration dampers themselves. At least one vibration damper is arranged near to a drive motor in the mage forming apparatus for further effectively reducing the vibration sounds (noise). The vibration damper is preferably made from a damping resin. In this case, the vibration damper preferably has a deformable portion having a width W and having a thickness smaller than the other portions (FIG. 15C). Thus, the vibration damper deforms more and can be more easily inserted into the photoconductive drum.

The thickness of the vibration damper is preferably 0.5 mm or more. If the thickness is less than 0.5 mm, the vibration damper may not effectively reduce the vibration. The damping resin mainly comprises a base resin, an active ingredient and an inorganic filler. Examples of the base resin are poly(vinyl chloride), polyethylene, chlorinated polyethylene, polypropylene, ethylene-vinyl acetate copolymer, poly(methyl methacrylate), poly(vinylidene chloride), polyisoprene, polystyrene, styrene-butadiene-acrylonitrile copolymer (ABS resin), styrene-acrylonitrile copolymer (AS resin), polycarbonate, acrylonitrile-butadiene rubber (NBR), styrene-butadiene rubber (SBR), butadiene rubber (BR), naturally-occurring rubber (NR) and isoprene rubber (IR). Each of these resins can be used alone or in combination.

Examples of the active ingredient are vulcanization accelerators containing benzothiazyl group such as N, N-dicyclohexylbenzothiazyl-2-sulfenamide (DCHBSA), 2-mercaptobenzothiazole (MBT), dibenzothiazyl sulfide (MBTS), N-cyclohexylbenzothiazyl-2-sulfenamide (CBS), N-tert-butylbenzothiazyl-2-sulfenamide (BBS), N-oxydiethylenebenzothiazyl-2-sulfenamide (OBS), and N, N-diisopropylbenzothiazyl-2-sulfenamide (DPBS). Each of these can be used alone or in combination.

Examples of the inorganic filler are mica flake, glass flake, glass fibers, carbon fibers, calcium carbonate, barite, and precipitated barium sulfate. These inorganic fillers are used for further effectively reducing the vibration. The amount of the inorganic filler is preferably 10 to 100 parts by weight to 100 parts by weight of the base resin.

The vibration damper may have an elastic resin layer 10 to 100 μm thick on its surface. The elastic resin layer is preferably made from an elastomer having rubber elasticity and having a hardness of 30 to 90 (hardness A according to Japanese Industrial Standards (JIS)), such as EPOFRIEND (trade name, available from Daicel Chemical Industries, Ltd.). The elastic resin layer can be prepared by dissolving the material in an organic solvent and applying the solution to the vibration damper typically by spraying or dipping.

The time period during which the number of revolutions of the photoconductor decreases to 1 to 10 rpm after image formation and before stop is preferably 0.2 second or longer, more preferably 1.5 second or longer. Thus, the above-mentioned advantages are more effectively exhibited. The noise caused by the friction between the photoconductor and the cleaning blade can be reduced by using the cleaning blade having the above configuration even if the time period during which the number of revolutions of the photoconductor decreases to 1 to 10 rpm is longer than 1.5 second.

The highest temperature of the photoconductor during image formation procedure preferably stands at 53° C. or less. If the highest temperature is higher than 53° C., the photoconductor may often have varied electrostatic properties, and the developer and/or parts of the image forming apparatus may often be deteriorated. However, the noise caused by the friction between the photoconductor and the cleaning blade can be reduced by using the cleaning blade even when the highest temperature of the photoconductor is higher than 53° C. The noise caused by the friction between the photoconductor and the cleaning blade does not occur until the photoconductor and the cleaning blade are raised in temperature and the cleaning blade becomes soft. The temperature of the photoconductor at the time when the noise begins to occur is 38° C. or more. Thus, the image forming apparatus can significantly reduce the noise caused by the friction between the photoconductor and the cleaning blade.

The charger for use herein may charge the photoconductor according to a corotron system or scorotron system. Alternatively, the distance between the photoconductor and the charger is preferably set at 0 to 100 μm, more preferably 0 to 60 μm, and further preferably 0 to 30 μm. To charge the photoconductor by the charger at a distance from 0 to 100 μm, a contact charging system such as charging with a roller, blush, blade or magnetic blush, or a charging system with micro gap, in which the charger charges the photoconductor with the interposition of a micro gap.

By setting the distance between the photoconductor and the charger at 0 to 100 μm, the image forming apparatus can be miniaturized and oxidative substances such as ozone and NOx can be reduced in the image forming apparatus. It is also preferred that an alternating current is superimposed onto a bias current to be applied to the charger upon charging. Thus, the voltage of the photoconductor can be easily controlled. However, when the distance between the photoconductor and the charger is set at such a small distance of 0 to 100 μm, the oxidative substances such as ozone and NOx may locally accumulate upon the surface of the photoconductor, thus inviting decreased resolution, blur and other imaging failure of the resulting images.

Therefore, at least one substance selected from biphenyl compounds and compounds represented by following Formula (I) disclosed in above-mentioned JP-A No. 09-265194 is incorporated into the photoconductive layer of the photoconductor.

(I)

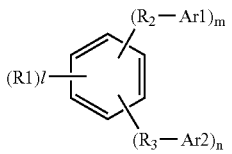

In Formula (I) $R_1$ is a lower alkyl group; $R_2$ and $R_3$ are the same as or different from each other and are each a substituted or unsubstituted methylene or ethylene group; $Ar_1$ and $Ar_2$ are the same as or different from each other and are each a substituted or unsubstituted aryl group; l is an integer of 0 to 4; m is an integer of 0 to 2; and n is an integer of 0 to 2, wherein l, m and n satisfy the following conditions: $m+n \geqq 2$, and l+m+n≦6, and wherein unsubstituted positions in the benzene ring are hydrogen atoms. Examples of the lower alkyl in $R_1$ is methyl group or ethyl group, of which lower alkyl groups having 1 to 6 carbon atoms are preferred. Examples of the substituent(s) in $R_2$ and $R_3$ are alkyl groups such as methyl group and ethyl group; aralkyl groups such as benzyl group; and aryl groups such as phenyl group. Examples of the aryl group(s) in $Ar_1$ and $Ar_2$ are phenyl group, biphenyl group, and naphthyl group. Examples of substituents for the aryl groups are alkyl groups such as methyl group, ethyl group, and propyl group; and aralkyl groups such as benzyl group.

Among the biphenyl compounds and the compounds represented by Formula (I), bisbenzylbenzene derivatives are preferred. The "bisbenzylbenzene derivatives" herein are compounds represented by Formula (I) wherein l is 0; $R_2$ and $R_3$ are independently a substituted or unsubstituted methylene group; and $Ar_1$ and $Ar_2$ are independently a substituted or unsubstituted aryl group.

Specific examples of the compounds represented by Formula (I) are mentioned below as Compounds (I)-1 through (I)-17.

(I)-1

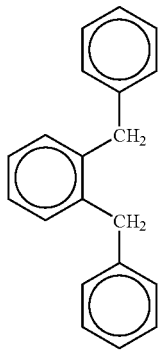

(I)-2

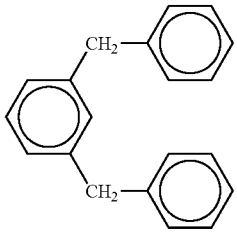

(I)-3

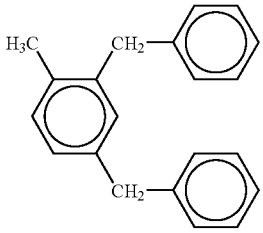

(I)-4

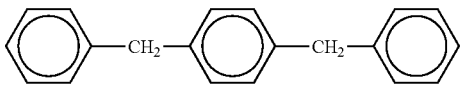

-continued (I)-5

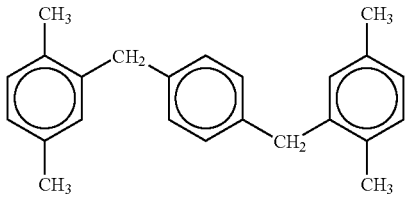

(I)-6

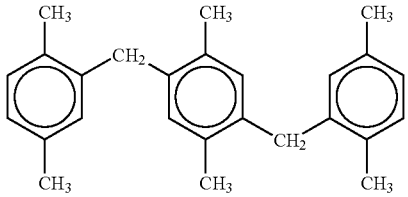

(I)-7

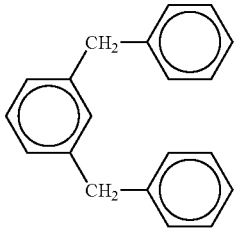

(I)-8

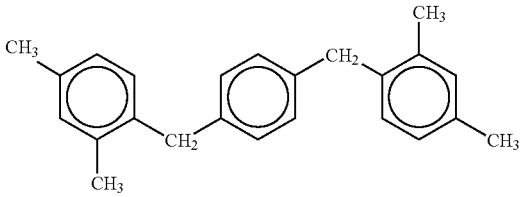

(I)-9

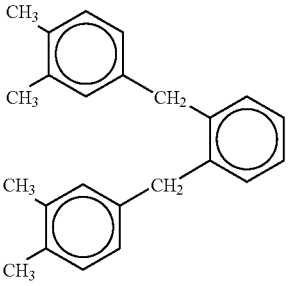

(I)-10

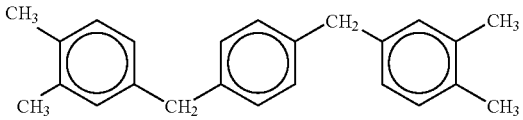

(I)-11

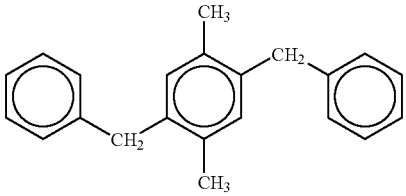

-continued (I)-12

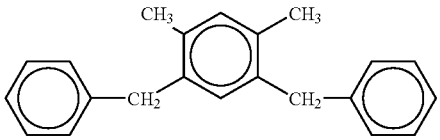

(I)-13

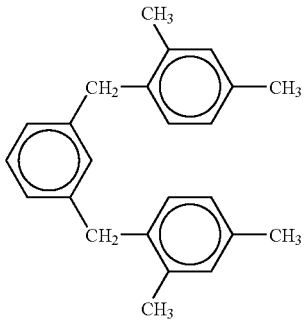

(I)-14

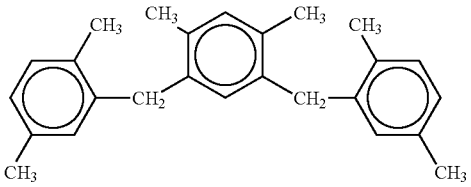

(I)-15

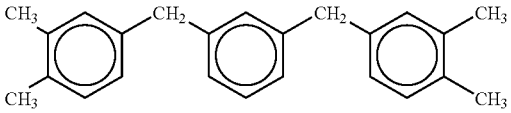

(I)-16

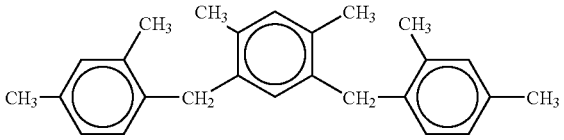

(I)-17

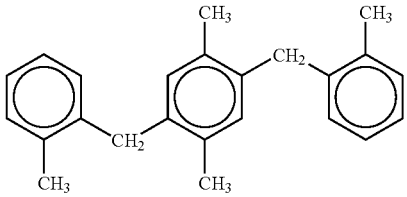

The biphenyl compounds (biphenyl and derivatives thereof) for use in the photoconductive layer include, but are not limited to, the following compounds.

Biphenyl, 2-methylbiphenyl, 3-methylbiphenyl, 4-methylbiphenyl, 2-ethylbiphenyl, 3-ethylbiphenyl, 2,3-dimethylbiphenyl, 2,4-dimethylbiphenyl, 2,5-dimethylbiphenyl, 2,6-dimethylbiphenyl, 2,2'-dimethylbiphenyl, 2,3'-dimethylbiphenyl, 3,5-dimethylbiphenyl, 3,3'-dimethylbiphenyl, 3,4'-dimethylbiphenyl, 2-propylbiphenyl, 4-propylbiphenyl, 2-isopropylbiphenyl, 3-isopropylbiphenyl, 4-isopropylbiphenyl, 2-ethyl-5-methylbiphenyl, 2,4,6-trimethylbiphenyl, 2,4,3'-trimethylbiphenyl, 2,5,3'-trimethylbiphenyl, 2,5,4'-trimethylbiphenyl, 2,6,2'-trimethylbiphenyl, 3,5,4'-trimethylbiphenyl, 2-butylbiphenyl, 4-butylbiphenyl, 2-sec-butylbiphenyl, 4-sec-butylbiphenyl, 2-isobutylbiphenyl, 2-tert-butylbiphenyl, 3-tert-butylbiphenyl, 4-tert-butylbiphenyl, 2,2'-diethylbiphenyl, 3,3'-diethylbiphenyl, 4,4'-diethylbiphenyl, 2,3,2'3'-tetramethylbiphenyl, 2,6,2',6'-tetramethylbiphenyl, 3,4,3'4'-tetramethylbiphenyl, 3,5,3'5'-tetramethylbiphenyl, 4-hexylbiphenyl, 4,4'-dipropylbiphenyl, 2,2'-diisopropylbiphenyl, 4,4'-diisopropylbiphenyl, 2,4,6,2',4',6'-hexamethylbiphenyl, 4,4'-dibutylbiphenyl, 2,5-di-tert-butyl-biphenyl, 2,2'-di-tert-butyl-biphenyl, 4,4'-di-tert-butyl-biphenyl, 2,3,5,6,2',3',5',6'-octamethylbiphenyl, 4,4'-di-tert-pentylbiphenyl, hydrogenated terphenyl, o-terphenyl, m-terphenyl, p-benzylbiphenyl, 5'-methyl-m-terphenyl, 4-phenylbibenzyl, 4',5'-dimethyl-m-terphenyl, 4'6'-dimethyl-m-terphenyl, 1-ethyl-4-benzylbiphenyl, 4-propyl-m-terphenyl, 3',4',6'-trimethyl-o-terphenyl, 2',4',5'-trimethyl-m-terphenyl, 2',4',6'-trimethyl-m-terphenyl, 4-ethyl-4'-phenethyl-biphenyl, 3-pentyl-m-terphenyl, 2-methoxybiphenyl, 2-ethoxybiphenyl, 2-propoxybiphenyl, 2-phenoxybiphenyl, 2-benzyloxybiphenyl, 3-methoxybiphenyl, 4-methoxybiphenyl, 4-ethoxybiphenyl, 4-propoxybiphenyl, 4-isopropoxybiphenyl, 4-butoxybiphenyl, 4-pentyloxybiphenyl, 4-phenoxybiphenyl, 4-m-tolyloxybiphenyl, 4-p-tolyloxybiphenyl, 4-benzyloxybiphenyl, 4'-methoxy-3-methylbiphenyl, 4-methoxy-4'-methyl-biphenyl, 4-cyclohexyloxymethylbiphenyl, 2-ethyl-5-methoxybiphenyl, 4'-methoxy-3,4-dimethylbiphenyl, 3'-methoxy-o-terphenyl, 4'-methoxy-o-terphenyl, 5-benzyl-2-methoxy-biphenyl, 4-benzyl-4'-methoxy-biphenyl, and 4-[(α-methoxybenzyl]biphenyl.

The content of the substance selected from the biphenyl compounds and the compounds represented by Formula (I) in the photoconductive layer is preferably 0.5 percent by weight to 7 percent by weight, more preferably 0.7 percent by weight to 6 percent by weight, and further preferably 1 percent by weight to 5 percent by weight. If the content is less than 0.5 percent by weight, the photoconductive layer may not become sufficiently resistant against the invasion of the oxidative substances such as ozone and NOx, thus inviting decreased resolution, blur and other imaging failure of the resulting images. If it exceeds 7 percent by weight, the photoconductor may have deteriorated electrostatic properties and it is not economical.

When the photoconductive layer comprises the substance selected from the biphenyl compounds and the compounds represented by Formula (I), the photoconductive layer becomes resistant against the invasion of the oxidative substances such as ozone and/or NOx to thereby maintain high image quality. However, if the substance selected from the biphenyl compounds and the compounds represented by Formula (I) in the photoconductive layer used, the noise caused by the friction between the photoconductor and the cleaning blade tends to become loud. However, the use of the cleaning member can reduce the noise caused by the substance selected from the biphenyl compounds and the compounds represented by Formula (I) in the photoconductive layer.

The photoconductive layer of the photoconductor may comprise a charge-generating layer and a charge-transport layer. The charge-generating layer works to generate charges by the action of a charger and light irradiator. The charge-transport layer is arranged on or above the charge-generating layer and works to transport the charges generated in the charge-generating layer to the surface of the photoconductor. The photoconductor may further comprise an undercoat layer between the electroconductive substrate (cylindrical support) and the charge-generating layer. In addition, the photoconductor may have a protective layer on or above the charge-transport layer. These electroconductive substrate, charge-generating layer, charge-transport layer, undercoat layer, and protective layer can be prepared from any suitable materials according to any suitable procedures. These will be briefly illustrated below.

The undercoat layer is arranged typically in order to increase adhesion between the electroconductive substrate and the charge-generating layer, to prevent moire fringes, to make the upper layer (the charge-generating layer) to be applied more satisfactorily and to reduce residual potential. The undercoat layer generally mainly comprises a resin. The resin for use herein is preferably resistant to regular organic solvents, because the upper layer will be applied onto it using a solvent.

Examples of such resins are water-soluble resins such as polyvinyl alcohol, casein and sodium polyacrylate, alcohol-soluble resins such as copolymer nylon and methoxymethylated nylon, and curing resins which form a three-dimensional network such as polyurethane, melamine resin, alkyd-melamine resin and epoxy resin. Fine powder of metal oxide such as titanium oxide, silica, alumina, zirconium oxide, tin oxide or indium oxide, as well as metal sulfide or metal nitride may also be added to the undercoat layer. The undercoat layer can be prepared by using a suitable solvent according to a suitable procedure.

The undercoat layer can also be a metal oxide layer prepared typically by sol-gel method using a silane coupling agent, titanium coupling agent or chromium coupling agent.

Alternatively or in addition, $Al_2O_3$ prepared by anodic oxidation, organic materials such as polyparaxylylene (parylene) and inorganic materials such as, $SnO_2$, $TiO_2$, ITO, $CeO_2$ prepared by the vacuum thin film-forming method, can be used for the undercoat layer. The undercoat layer preferably has a thickness of 0.1 to 10 μm.

The charge-generating layer mainly comprises at least one charge-generating substance and may further comprise a binder resin according to necessity. The charge-generating substance can be any of inorganic materials and organic materials.

Examples of the inorganic materials are crystalline selenium, amorphous selenium, selenium-tellurium, selenium-tellurium-halogen, and selenium-arsenic compound.

Examples of the organic materials are known organic materials in the art including phthalocyanine pigments such metal phthalocyanine, non-metal phthalocyanine, azulenium salt pigments, squaric acid-methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene piegments, anthraquinone or polycyclic quinone pigments, quinoneimine pigments, diphenylmethane and triphenylmethane pigments, benzoquinone and naphthoquinone pigments, cyanine and azomethine pigments, indigoid pigments, and bisbenzimidazole pigments. Each of these charge-generating materials can be used alone or in combination.

Examples of the binder resin for use in the charge-generating layer are a polyamide, polyurethane, epoxy resin, polyketone, polycarbonate resin, silicone resin, acrylic resin, polyvinyl butyral, polyvinyl formal, polyvinyl ketone, polystyrene, poly-N-vinyl carbazole or polyacrylamide. Each of these binder resins can be used alone or in combination.

If necessary, the charge-generating layer may further comprise a charge-transport substance. The binder resin used in the charge-generating layer may also include polymeric charge-transport materials.

Broadly speaking, the charge-generating layer may be formed by vacuum thin film-forming methods or by the method of casting from a solution dispersion.

The former method includes the vacuum deposition method, glow discharge polymerization, ion plating, sputtering, reactive-sputtering and chemical vapor deposition (CVD), which satisfactorily form a film of the inorganic material or organic material.

To provide the charge-generating layer by the casting method, the inorganic or organic charge-generating material is dispersed, together with a binder resin if necessary, by a ball mill, attritor or sand mill using a solvent such as tetrahydrofuran, cyclohexanone, dioxane, dichloromethane or butanone, suitably diluting the dispersion, and applying it. The application can be performed using known methods, such as impregnation coating, spray coating or bead coating.

The thickness of the charge-generating layer is preferably from about 0.01 to about 5 μm, and more preferably from about 0.05 to about 2 μm.

The charge-transport layer works to hold an electrified charge, to transport the charge generated in the charge-generating layer to thereby combine the same with the held electrified charge. The charge-transport layer must have a high electric resistance to hold the electrified charge and have a low dielectric constant and good charge-transfer ability to yield a high surface voltage by the action of the held electrified charge.

To satisfy these requirements, the charge-transport layer comprises a charge-transport material and a binder resin. The layer can be prepared by dissolving or dispersing these materials in a suitable solvent, applying the solution or dispersion and drying it. Examples of the solvent are tetrahydrofuran, dioxane, toluene, cyclohexanone, methyl ethyl ketone and acetone.

If necessary, the charge-transport layer may further comprise suitable amounts of additives such as a plasticizer, antioxidant and leveling agent, in addition to the charge-transport material and binder resin.

The charge transport material may be a positive hole transport material or electron transport material.

Examples of the electron transport material are electron acceptors such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one and 1,3,7-trinitrodibenzothiophene-5,5-dioxide. Each of these electron transport materials can be used alone or in combination.

The positive hole transport material may be any of the following electron donor materials. Examples of such positive hole transport material are oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazone derivatives, α-phenylstilbene derivatives, thiazole derivatives, triazole derivatives, phenazine derivatives, acridine derivatives, benzofuran derivatives, benzimidazole derivatives and thiophene derivatives. Each of these positive hole transport materials can be used alone or in combination.

Examples of the polymeric charge-transport material are as follows.

(a) Polymers having a carbazole ring, such as poly-N-vinylcarbazole, and compounds disclosed JP-A No. 50-82056, No. 54-9632, No. 54-11737, No. 04-175337, No. 04-183719 and No. 06-234841.

(b) Polymers having a hydrazone structure, such as compounds disclosed in JP-A No. 57-78402, No. 61-20953, No. 61-296358, No. 01-134456, No. 01-179164, No. 03-180851, No. 03-180852, No. 03-50555, No. 05-310904 and No. 06-234840.

(c) Polysilanes such as compounds disclosed in JP-A No. 63-285552, No. 01-88461, No. 04-264130, No. 04-264131, No. 04-264132, No. 04-264133 and No. 04-289867.

(d) Polymers having a triarylamine structure, such as N, N-bis(4-methylphenyl)-4-aminopolystyrene, and compounds disclosed JP-A No. 01-134457, No. 02-282264, No. 02-304456, No. 04-133065, No. 04-133066, No. 05-40350 and No. 05-202135.

(e) Other polymers such as formaldehyde condensate of nitropyrene, and compounds disclosed in JP-A No. 51-73888, No. 56-150749, No. 06-234836 and No. 06-234837.

Such polymers having an electron donating group also include copolymers, block polymers, graft polymers or star polymers of conventional monomers, as well as crosslinked polymers having an lectron donating group as described typically in JP-A No. 03-109406.

Polycarbonates having a triarylamine structure, polyurethanes, polyesters and polyethers are also effective as the polymeric charge-transport material.

Examples of such materials are compounds described in, for example, JP-A No. 64-1728, No. 64-13061, No. 64-19049, No. 04-11627, No. 04-225014, No. 04-230767, No. 04-320420, No. 05-232727, No. 07-56374, No. 09-127713, No. 09-222740, No. 09-265197, No. 09-211877 and No. 09-304956.

Examples of the binder resin for use in the charge-transport layer are polycarbonates including bisphenol A type and bisphenol Z type, polyesters, methacrylic resins, acrylic resins, polyethylenes, poly(vinyl chloride)s, poly (vinyl acetate)s, polystyrenes, phenol resins, epoxy resins, polyurethanes, poly(vinylidene chloride)s, alkyd resins, silicone resins, poly(vinylcarbazole)s, polyvinylbutyrals, polyvinylformals, polyacrylates, polyacrylamides, and phenoxy resins. Each of these binder resins can be used alone or in combination.

The charge-transport layer preferably has a thickness of about 5 to about 100 μm.

Examples of the antioxidant are as follows.

Monophenol compounds: 2,6-di-t-butyl-p-cresol, butylated hydroxyanisole, 2,6-di-t-butyl-4-ethylphenol, stearyl-α-(3,5-di-t-butyl-4-hydroxyphenyl) propionate, and 3-t-butyl-4-hydroxyanisole.

Bisphenol compounds: 2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidene-bis-(3-methyl-6-t-butylphenol).

Polyphenol compounds: 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3', 5'-di-t-butyl-4'-hydroxyphenyl)propionate]m ethane, bis[3, 3'-bis(4'-hydroxy-3'-t-butylphenyl) butyric acid] glycol ester, and tocophenols.

Paraphenylenediamines: N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinones: 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organosulfur compounds: dilauryl-3,3'-thiodipropionate, distearyl-3,3'-thiodipropionate, and ditetradecyl-3,3'-thiodipropionate.

Organophosphorus compounds: triphenylphosphine, tri (nonylphenyl)phosphine, tri(dinonylphenyl)phosphine, tricresylphosphine, and tri(2,4-dibutylphenoxy)phosphine.

Examples of the plasticizer are those used as plasticizers for resins, such as dibutyl phthalate and dioctyl phthalate. The amount of the plasticizer is preferably 0 to 30 parts by weight to 100 parts by weight of the binder resin.

The charge-transport layer may further comprise a leveling agent. Examples of the leveling agent are silicone oils such as dimethylsilicone oil and methylphenylsilicone oil; and polymers or oligomers having a perfluoroalkyl group in the side chain. The amount of the leveling agent is preferably 0 to 1 part by weight to 100 parts by weight of the binder resin.

The protective layer generally comprises a binder resin and fine particles of metal or metal oxide dispersed in the binder resin. The binder resin herein is preferably optically transparent to visible rays and/or infrared rays and has satisfactory electric insulating property, mechanical strength and adhesion.

Examples of the binder resin for the protective layer are ABS resins, ACS resins, olefin-vinyl monomer copolymers, chlorinated polyether, allyl resins, phenol resins, polyacetals, polyamides, polyamideimides, polyacrylates, polyarylsulfone, polybutylenes, poly(butylene terephthalate)s, polycarbonates, poly(ether sulfone)s, polyethylenes, poly (ethylene terephthalate)s, polyimides, acrylic resins, poly (methylpentene)s, polypropylenes, poly(phenylene oxide)s, polysulfones, polystyrenes, AS resins, butadiene-styrene copolymers, polyurethanes, poly(vinyl chloride)s, poly(vinylidene chloride)s, and epoxy resins.

Examples of the metal oxide are titanium oxide, tin oxide, potassium titanate, TiO, TiN, zinc oxide, indium oxide, andantimony oxide. The protective layer may further comprise a fluorocarbon resin such as polytetrafluoroethylene, a silicone resin, or these resins further comprising dispersed inorganic material for improving the abrasion resistance. The protective layer can be prepared according to a conventional coating procedure. The thickness of the protective layer is preferably from about 0.1 to about 10 μm.

EXAMPLES

The present invention will be illustrated in further detail with reference to several examples and comparative examples below, which are not intended to limit the scope of the present invention.

Example C-1 and Comparative Example C-1

A total of 15 parts by weight of an acrylic resin (Acrydic A-460-60, available from Dainippon Ink & Chemicals, Inc., Japan) and 10 parts by weight of a melamine resin (Super Beckamine L-121-60, available from Dainippon Ink & Chemicals, Inc., Japan) were dissolved in 80 parts by weight of ethyl methyl ketone. To the solution was added 90 parts by weight of a titanium oxide powder (TM-1, available from Fuji Titanium Industry Co., Ltd., Japan). The mixture was dispersed in a ball mill for 12 hours to prepare a coating composition for an undercoat layer. An aluminum drum having an outer diameter of 30 mm, an inner diameter of 28.5 mm and a length of 330 mm was immersed in the coating composition for an undercoat layer and was then vertically drawn up at a constant rate to coat the drum with the coating composition. The aluminum drum was moved to a drying room with its attitude maintained and was dried therein at 140° C. for 23 minutes to form an undercoat layer having a thickness of 3.4 μm thereon.

In 150 parts by weight of cyclohexanone was dissolved 15 parts by weight of a butyral resin (S-LEC BLS, available from Sekisui Chemical Co., Ltd., Japan). To the solution was added 10 parts by weight of a trisazo pigment having a structure represented by the following structural formula, and the resulting mixture was dispersed in a ball mill for 48 hours to yield a coating composition for a charge-generating layer.

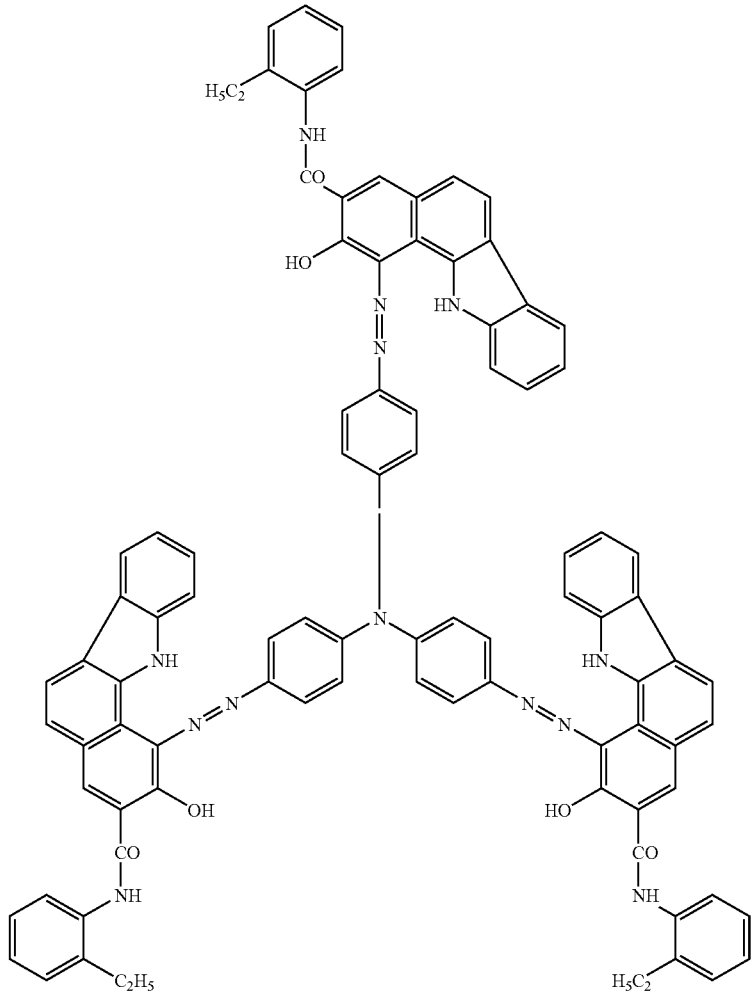

The aluminum drum bearing the undercoat layer was immersed in the above-prepared coating composition for a charge-generating layer and was vertically drawn up at a constant rate to coat the drum with the coating composition and then was dried in the same manner as in the undercoat layer at 120° C. for 20 minutes to form a charge-generating layer having a thickness of about 0.2 μm thereon.

Separately, a coating composition for a charge-transport layer was prepared by dissolving 6 parts by weight of a charge-transport material having a structure represented by the following structural formula, 10 parts by weight of a polycarbonate resin (Panlite K-1300, available from Teijin Chemicals, Ltd., Japan), 0.7 part by weight of 1,4-bis(2,5-dimethylbenzyl)benzene as a bisbenzylbenzene derivative of Formula (I), and 0.002 parts by weight of a silicone oil (KF-50, available from Shin-Etsu Chemical Co., Ltd., Japan) in 90 parts by weight of methylene chloride.

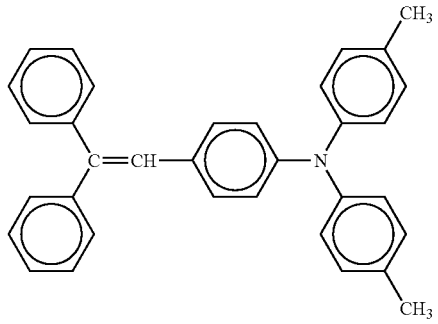

The aluminum drum bearing the undercoat layer and the charge-generating layer was then immersed in the above-prepared coating composition for a charge-transport layer and was vertically drawn up at a constant rate to coat the drum with the coating composition and then was dried in the same manner as in the undercoat layer at 120° C. for 20 minutes to form a charge-transport layer having a thickness of about 32 μm thereon. Thus, a photoconductor was prepared.

One aluminum vibration damper 60 mm long was placed and bonded at the center of the above-prepared photoconductor (drum) using an acrylic adhesive. The resulting photoconductor was mounted to a process cartridge for imagio MF-200 including a charger roller of DC contact charging system, a developing device and a cleaning member, and the process cartridge was set in an image forming apparatus. This image forming apparatus was a modified model of imagio MF-200 (available from Ricoh Company Limited, Japan) in which the time period during which the number of revolutions of the photoconductor fell down to 1 to 10 rpm before stop was set at 0.6 to 0.7 second.

The steel holder shown in FIG. 4B was used as the metallic holder for holding the cleaning blade in the cleaning member. The steel holder had an angle θ of 93 degrees, a width W of 25 mm, an angle θ of 90 degrees and a height H of 7 mm (Example C-1).

As a comparison, a process cartridge was prepared by the above procedure, except for using a steel holder having no second bent portion (Comparative Example C-1).

Using the image forming apparatus equipped with the steel holders according to Example C-1 and Comparative Example C-1, respectively, an A4-sized image in landscape orientation was repetitively formed at a room temperature of 28° C. at time intervals of 15 seconds for a total of 60 minutes. After 60-minutes image formation, the temperature of the photoconductor stood at 39° C. A microphone was placed in the vicinity of the right side of the image forming apparatus, and the noise immediately before the photoconductor came to a stop was determined. The noise was measured with an Electret Condenser Microphone ECM-T 115 (available from Sony Corporation, Japan) as the microphone and was recorded on a personal computer using a recording software Sound Monitor FFT Wave Ver. 7.0 (available from E.N. Software, Japan). The sound level of the recorded noise was increased to 17 dB using SoundEngine Free Ver. 2.90 (available from Cycle of 5th, Japan). The frequency properties of the resulting noise were determined using the Sound Monitor FFT Wave and was found to have a large peak in the vicinity of 500 Hz at the time when noise occurred. Sounds of 450 to 550 Hz alone were extracted, were heard and were found to be the noise in question. Thus, the maximum sound level in the vicinity of 500 Hz was defined as an index of the noise.

In sensory tests, the sound levels are assessed as follows. At a maximum sound level around 500 Hz of −20 dB or lower, one does not perceive noise even in close vicinity to the image forming apparatus; at −16 dB or lower, one does not perceive noise at a distance of 1 m from the image forming apparatus in an office where an air conditioner is not working; at −14 dB or lower, one hardly perceives noise at a distance of 1 m from the image forming apparatus in an office where the air conditioner is working; at −10 dB or lower, one perceives noise but does not feel unpleasant at a distance of 1 m from the image forming apparatus in an office where the air conditioner is working; and at −10 dB or higher, one feels noise unpleasant even at a distance of 1 m from the image forming apparatus in an office where the air conditioner is working.

The maximum sound levels in the vicinity of 500 Hz of the image forming apparatus using steel holders according to Example C-1 and Comparative Example C-1, respectively, are shown in Table C-1.

TABLE C-1

| | Maximum sound level in the vicinity of 500 Hz (dB) |
|---|---|
| Example C-1 | −20.5 |
| Com. Ex. C-1 | −6.4 |

The maximum sound level in the vicinity of 500 Hz of the image forming apparatus using the steel holder according to Comparative Example C-1 is −6.4 dB, at which one feels noise unpleasant even at a distance of 1 m from the image forming apparatus in an office where the air conditioner is working. In contrast, the maximum sound level in the vicinity of 500 Hz of the image forming apparatus using the steel holder according to Example C-1 is −20.5 dB, at which one does not perceive noise even in close vicinity to the image forming apparatus.

Examples C-2, C-3 and C-4, and Comparative Example C-2

Photoconductors were prepared by the procedure of Example C-1, except for using 1,4-bis(2,5-dimethylbenzyl) benzene in amounts of 0.1 (Example C-2), 0.5 (Example C-3 and Comparative Example C-2), and 1.1 part by weight (Example C-4), respectively, in the coating composition for a charge-transport layer. Process cartridges were prepared and were mounted into the image forming apparatus by the procedure of Example C-1, except for using the photoconductors corresponding to Examples C-2, C-3 and C-4, respectively, and using a charger of alternating-current charging system. Separately, a process cartridge according to Comparative Example C-2 was prepared by the procedure of Example C-1, except for using the photoconductor comprising 0.5 part by weight of 1,4-bis(2,5-dimethylbenzyl) benzene in the coating composition for a charge-transport layer and using the same steel holder as in Comparative Example C-1.

Using the image forming apparatus housing the respective process cartridges, an A4-sized image in landscape orientation was repetitively formed in an office at a room temperature of 30° C. at time intervals of 15 seconds for a total of 10 minutes. After 10-minutes image formation, the temperatures of the photoconductors in the respective image forming apparatuses stood at 40° C. A microphone was placed in the vicinity of the right side of the image. forming apparatus, and the noise immediately before the photoconductor came to a stop was determined.

Thus, the maximum sound levels in the vicinity of 500 Hz of the image forming apparatus housing the process cartridges according to Examples C-2, C-3 and C-4, and Comparative Example C-2 were determined, and the results are shown in Table C-2.

TABLE C-2

| | Amount of 1,4-bis(2,5-dimethylbenzylbenzene (part by weight) | Shape of steel holder | Maximum sound level in the vicinity of 500 Hz (dB) |
|---|---|---|---|
| Ex. C-2 | 0.1 | Ex. C-1 | −19.3 |
| Ex. C-3 | 0.5 | Ex. C-1 | −18.8 |
| Ex. C-4 | 1.1 | Ex. C-1 | −18.0 |
| Com. Ex. C-2 | 0.5 | Com. Ex. C-1 | −4.1 |

maximum sound level in the vicinity of 500 Hz from the image forming apparatus of Comparative Example C-2 using the steel holder according to Comparative Example C-1 is −4.1 dB, at which one feels noise unpleasant even at a distance of 1 m from the image forming apparatus in an office where the air conditioner is working. In contrast, the maximum sound levels in the vicinity of 500 Hz from the image forming apparatus of Examples C-2, C-3 and C-4 using the steel holder according to Example C-1 are −19.3 dB, −18.8 dB and −18.0 dB, respectively, at which one does not perceive noise at a distance of 1 m from the image forming apparatus in an office where the air conditioner is not working, regardless of the amounts of 1,4-bis(2,5-dimethylbenzyl)benzene in the photoconductors.

Examples C-5, C-6 and C-7, and Reference Example C-1

Process cartridges were prepared and were mounted into the image forming apparatus by the procedure of Example C-3, except for using steel holders having angles θ' shown in FIG. 4B of 45 degrees, 70 degrees, 120 degrees and 150 degrees (corresponding to Examples C-5, C-6 and C-7, and Reference Example C-1, respectively).

Using the image forming apparatus housing the respective process cartridges, an A4-sized image in landscape orientation was repetitively formed at a room temperature of 30° C. at time intervals of 15 seconds for a total of 10 minutes. After 10-minutes image formation, the temperatures of the photoconductors in the respective image forming apparatuses stood at 40° C. A microphone was placed in the vicinity of the right side of the image forming apparatus, and lo the noise immediately before the photoconductor came to a stop was determined.

Thus, the maximum sound levels of the image forming apparatus according to Examples C-6, C-6 and C-7, and Reference Example C-1 were determined. The results are shown in Table C-3.

TABLE C-3

| | θ' (degree) | Maximum sound level in the vicinity of 500 Hz (dB) |
|---|---|---|
| Example C-5 | 45 | −17.5 |
| Example C-6 | 70 | −18.5 |

TABLE C-3-continued

| | θ' (degree) | Maximum sound level in the vicinity of 500 Hz (dB) |
|---|---|---|
| Example C-7 | 120 | −17.2 |
| Ref. Ex. C-1 | 150 | −8.0 |

The maximum sound levels of the image forming apparatus according to Examples C-5, C-6 and C-7 using the steel holders having relatively small angles θ' of 45, 70 and 120 degrees are −17.5, −18.5 and −17.2 dB, respectively, at which one does not perceive noise at a distance of 1 m from the image forming apparatus in an office where the air conditioner is not working. In contrast, the maximum sound level of the image forming apparatus according to Reference Example C-1 using the steel holder having a relatively large angle θ of 150 degrees is −8.0 dB, at which one feels noise unpleasant at a distance of 1 m from the image forming apparatus in an office where the air conditioner is working.

Example C-8 and Comparative Example C-3

Using the image forming apparatuses according to Example C-3 and Comparative Example C-1, respectively, an A4-sized image in landscape orientation was continuously formed on 99 sheets at a room temperature of 30° C. and humidity of 90 percent. This procedure was repeated 200 times, and a total of 19800 copies were produced. Thus, an entirely uniform halftone image was printed. As a result, the image forming apparatus according to Example C-3 using the steel holder having two bent portions in the cleaning member produced a normal image (Example C-8). In contrast, the image forming apparatus according to Comparative Example C-1 using the steel blade having no second bent portion in the cleaning member produced an image with low resolution and invited some blur (Comparative Example C-3).

Example A-1 and Comparative Example A-1

A total of 15 parts by weight of an acrylic resin (Acrydic A-460-60, available from Dainippon Ink & Chemicals, Inc., Japan) and 10 parts by weight of a melamine resin (Super Beckamine L-121-60, available from Dainippon Ink & Chemicals, Inc., Japan) were dissolved in 80 parts by weight of methyl ethyl ketone. To the solution was added 90 parts by weight of a titanium oxide powder (TM-1, available from Fuji Titanium Industry Co., Ltd., Japan). The mixture was dispersed in a ball mill for 12 hours to prepare a coating composition for an undercoat layer. An aluminum drum having an outer diameter of 30 mm, an inner diameter of 28.5 mm and a length of 330 mm was immersed in the coating composition for an undercoat layer and was then vertically drawn up at a constant rate to coat the drum with the coating composition. The aluminum drum was moved to a drying room with its attitude maintained and was dried therein at 140° C. for 23 minutes to form an undercoat layer having a thickness of 3.4 μm thereon.

In 150 parts by weight of cyclohexanone was dissolved 15 parts by weight of a butyral resin (S-LEC BLS, available from Sekisui Chemical Co., Ltd., Japan). To the solution was added 10 parts by weight of a trisazo pigment having a structure represented by the following structural formula, and the resulting mixture was dispersed in a ball mill for 48 hours.

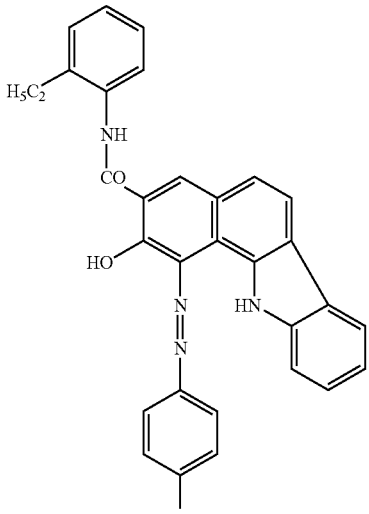

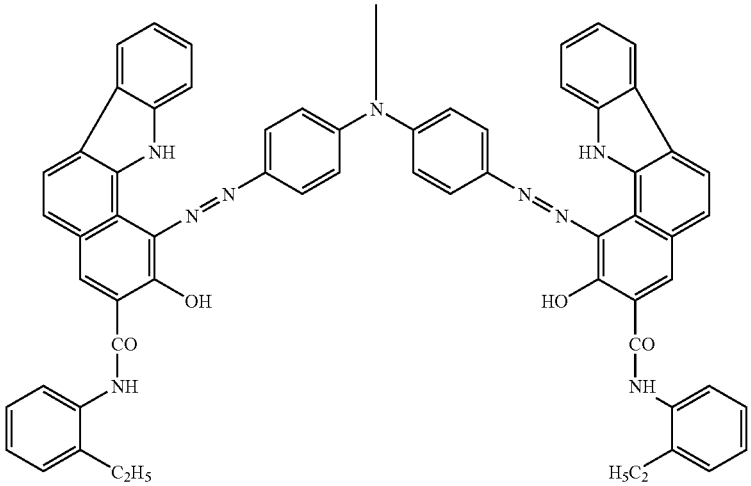

The aluminum drum bearing the undercoat layer was immersed in the above-prepared coating composition for a charge-generating layer and was vertically drawn up at a constant rate to coat the drum with the coating composition and then was dried in the same manner as in the undercoat layer at 120° C. for 20 minutes to form a charge-generating layer having a thickness of about 0.2 μm. Separately, a coating composition for a charge-transport layer was prepared by dissolving 6 parts by weight of a charge-transport material having a structure represented by the following structural formula, 10 parts by weight of a polycarbonate resin (Panlite K-1300, available from Teijin Chemicals, Ltd., Japan), 0.7 part by weight of 1,4-bis(2,5-dimethylbenzyl) benzene and 0.002 parts by weight of a silicone oil (KF-50, available from Shin-Etsu Chemical Co., Ltd., Japan) in 90 parts by weight of methylene chloride.

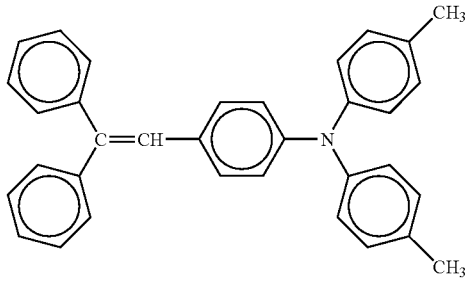

The aluminum drum bearing the undercoat layer and the charge-generating layer was then immersed in the above-prepared coating composition for a charge-transport layer and was vertically drawn up at a constant rate to coat the drum with the coating composition and then was dried in the same manner as in the undercoat layer at 120° C. for 20 minutes to form a charge-transport layer having a thickness of about 32 μm. Thus, a photoconductor was prepared. One aluminum vibration damper 60 mm long was placed and bonded at the center of the above-prepared photoconductor (drum) using an acrylic adhesive. The resulting photoconductor was mounted to a process cartridge for imagio MF-200 (available from Ricoh Company Limited, Japan) including a charger roller of DC contact charging system, a developing device and a cleaning blade, and the process cartridge was set in an image forming apparatus. This image forming apparatus was a modified model of imagio MF-200 (available from Ricoh Company Limited, Japan) in which the time period during which the number of revolutions of the photoconductor fell down to 1 to 10 rpm before stop was set at 0.6 to 0.7 second.

Figure 11:
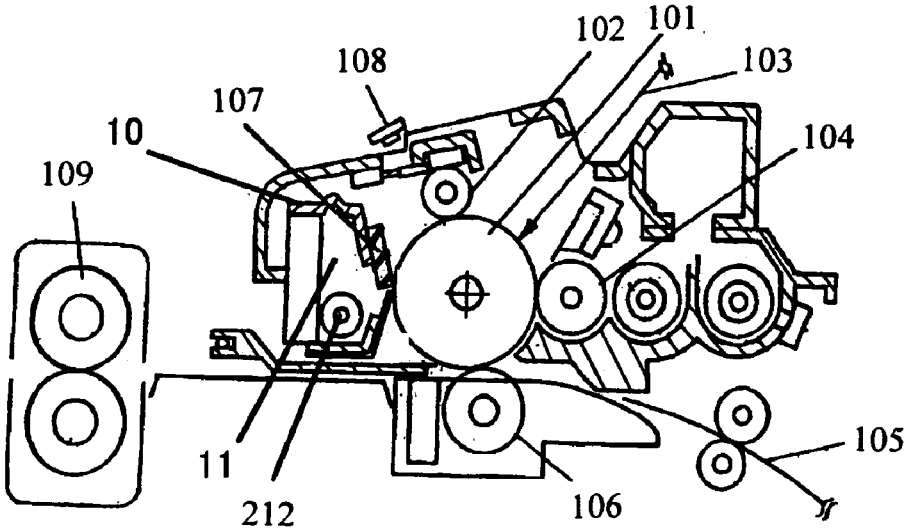
FIG. 11 is a schematic sectional view illustrating a configuration of the image forming apparatus used in the copier of FIG. 10.

The process cartridge used herein had a shape shown in FIG. 11, and the angle θ of the (first) bent portion of the L-shaped bent steel blade holder 10 holding the cleaning blade 107 was set at 93 degrees (see FIG. 9B).

Figure 16:
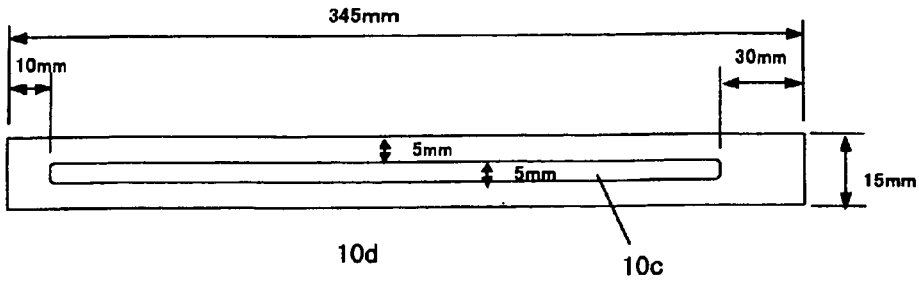
FIG. 16 is a schematic view of a blade holder used in Example A-1.

FIG. 16 is a top view of a second flat portion of the metallic blade holder at which the cleaning blade is not held. The metallic blade holder (steel blade holder) used herein had a continuous protrusion 10*c* having a semicircular profile 5 mm wide and 2 mm high. In FIG. 16, 10*d* is cleaning blade side.

As Comparative Example A-1, a process cartridge was prepared by the procedure of Example A-1, except for using a metallic blade holder having no protrusion. The process cartridge was set in the image forming apparatus by the procedure of Example A-1.

An A4-sized image in landscape orientation was repetitively formed at a room temperature of 32° C. at time intervals of 15 seconds for a total of 60 minutes using the image forming apparatus. After 60-minutes image formation, the temperatures of the photoconductors stood at 42° C. A microphone was placed in the vicinity of the right lo side of the image forming apparatuses, and the noise immediately before the photoconductor came to a stop was determined. The noise was measured with an Electret Condenser Microphone ECM-T 115 (available from Sony Corporation, Japan) as the microphone and was recorded on a personal computer using a recording software Sound Monitor FFT Wave Ver. 7.0 (available from E.N. Software, Japan). The sound level of the recorded noise was increased to 17 dB using SoundEngine Free Ver. 2.90 (available from Cycle of 5th, Japan). The frequency properties of the resulting noise were determined using the Sound Monitor FFT Wave and were found to have a large peak in the vicinity of 500 Hz at the time when noise occurred. Sounds of 450 to 550 Hz alone were extracted, were heard and were found to be the noise in question. Thus, the maximum sound level in the vicinity of 500 Hz was defined as an index of noise. The maximum sound levels in the vicinity of 500 Hz of the image forming apparatus of Example A-1 and Comparative Example A-1 are shown in Table A-1.

In sensory tests, the sound levels are assessed as follows. At a maximum sound level around 500 Hz of −20 dB or lower, one does not perceive noise even in close vicinity to the image forming apparatus; at −16 dB or lower, one does not perceive noise at a distance of 1 m from the image forming apparatus in an office where the air conditioner is not working; at −14 dB or lower, one hardly perceives noise at a distance of 1 m from the image forming apparatus in an office where the air conditioner is working; at −10 dB or lower, one perceives noise but does not feel unpleasant at a distance of 1 m from the image forming apparatus in an office where the air conditioner is working; and at −10 dB or higher, one feels noise unpleasant at a distance of 1 m from the image forming apparatus in an office where the air conditioner is working.

TABLE A-1

| | Maximum sound level in the vicinity of 500 Hz |
|---|---|
| Example A-1 | −21.5 dB |
| Comparative Example A-1 | −1.8 dB |

Example A-2

Figure 17:
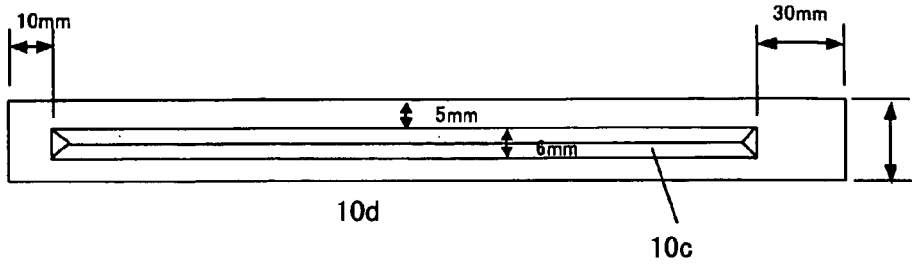
FIG. 17 is a schematic view of a blade holder used in Example A-2.

An image forming apparatus was prepared and the noise in the vicinity of 500 Hz was determined by the procedure of Example A-1, except for using a blade holder shown in FIG. 17. The metallic blade holder used herein had a continuous protrusion having a triangular profile 6 mm wide and 2.5 mm high. The result is shown in Table A-2.

TABLE A-2

| | Maximum sound level in the vicinity of 500 Hz |
|---|---|
| Example A-2 | −20.8 dB |

Examples A-3, A-4 and A-5, and Comparative Example A-2

Photoconductors were prepared by the procedure of Example A-1, except for using 1,4-bis(2,5-dimethylbenzyl) benzene in amounts of 0.1, 0.5, 1.1 and 0 part by weight, respectively, in the coating composition for a charge-transport layer.

Figure 18:
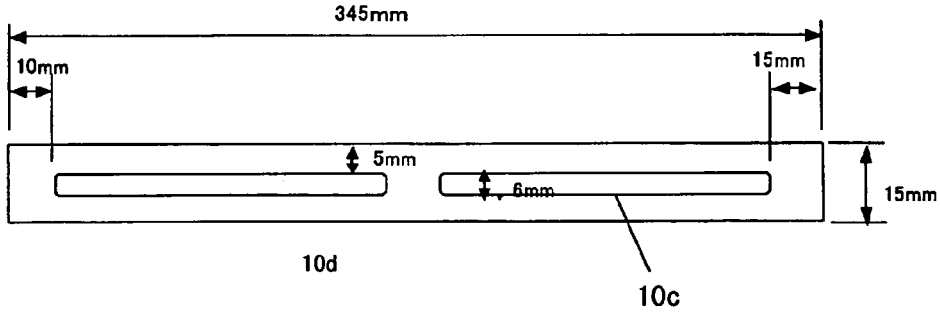
FIG. 18 is a schematic view of a blade holder used in Example A-3.

Protrusions 10*c* shown in FIG. 18 were formed on the steel holders in image forming apparatus using the photoconductors comprising 0.1, 0.5 and 1.1 part by weight of 1,4-bis(2,5-dimethylbenzyl)benzene in the coating composition for a charge-transport layer coating composition for a charge-transport layer (Examples A-3, A-4 and A-5). The metallic blade holder used herein had protrusion having a semicircular profile 2.2 mm high. In FIG. 18, 10*d* is cleaning blade side.

In Comparative Example A-2, the photoconductor comprising no 1,4-bis(2,5-dimethylbenzyl)benzene in the coating composition for a charge-transport layer and the same steel holder as in Comparative Example A-1 were used.

The image forming apparatus used in Example A-2 was modified to carry out electrification by alternating current system. An A4-sized image in landscape orientation was repetitively formed in an office at a room temperature of 27° C. at time intervals of 15 seconds for a total of 20 minutes using the image forming apparatus. After 20-minutes image formation, the temperatures of the photoconductors stood at 43° C. A microphone was placed in the vicinity of the right side of the image forming apparatus, and the noise immediately before the photoconductor came to a stop was determined. The results are shown in Table A-3.

TABLE A-3

| | Maximum sound level in the vicinity of 500 Hz |
|---|---|
| Example A-3 | −17.2 dB |
| Example A-4 | −16.5 dB |
| Example A-5 | −16.4 dB |
| Comparative Example A-2 | −14.5 dB |

Example A-6 and Comparative Example A-3

A process cartridge using the photoconductor used in Example A-4 and the steel holder used in Example A-1 was placed into the image forming apparatus used in Example A-3 (Example A-6).

In Comparative Example A-3, the procedure of Example A-6 was repeated, except for using the same steel holder and photoconductor as Comparative Example A-1.

An A4-sized image in landscape orientation was repetitively formed at a room temperature of 30° C. and humidity of 40 percent at time intervals of 15 seconds for a total of 60 minutes using the image forming apparatuses. A microphone was placed in the vicinity of the right side of the image forming apparatuses, and the noise immediately before the photoconductor came to a stop was determined. The results are shown in Table A-4.

TABLE A-4

| | Maximum sound level in the vicinity of 500 Hz |
|---|---|
| Example A-6 | −17.0 dB |
| Comparative Example A-3 | −2.9 dB |

Using these image forming apparatuses, an A4-sized image in landscape orientation was continuously formed on 99 sheets at a room temperature of 30° C. and humidity of 90 percent. This procedure was repeated 200 times, and a total of 19800 copies were formed. The image forming apparatus according to Example A-6 produced normal images, but the image forming apparatus according to Comparative Example A-3 invited blur in some images.

Example D-1 and Comparative Example D-1

A total of 15 parts by weight of an acrylic resin (Acrydic A-460-60, available from Dainippon Ink & Chemicals, Inc., Japan) and 10 parts by weight of a melamine resin (Super Beckamine L-121-60, available from Dainippon Ink & Chemicals, Inc., Japan) were dissolved in 80 parts by weight of methyl ethyl ketone. To the solution was added 90 parts by weight of a titanium oxide powder (TM-1, available from Fuji Titanium Industry Co., Ltd., Japan). The mixture was dispersed in a ball mill for 12 hours to prepare a coating composition for an undercoat layer. An aluminum drum having an outer diameter of 30 mm, an inner diameter of 28.5 mm and a length of 330 mm was immersed in the coating composition for an undercoat layer and was then vertically drawn up at a constant rate to coat the drum with the coating composition. The aluminum drum was moved to a drying room with its attitude maintained and was dried therein at 140° C. for 23 minutes to form an undercoat layer having a thickness of 3.4 μm thereon.

In 150 parts by weight of cyclohexanone was dissolved 15 parts by weight of a butyral resin (S-LEC BLS, available from Sekisui Chemical Co., Ltd., Japan). To the solution was added 10 parts by weight of a trisazo pigment having a structure represented by following Formula (II), and the resulting mixture was dispersed in a ball mill for 48 hours to yield a coating composition for a charge-generating layer.

(II)

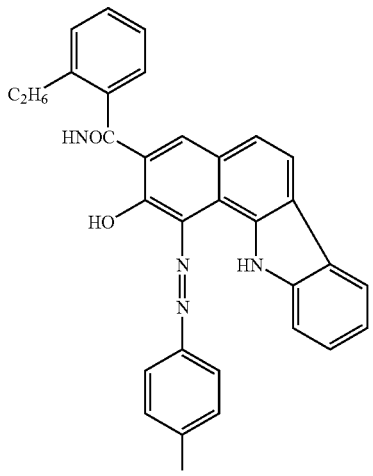

-continued

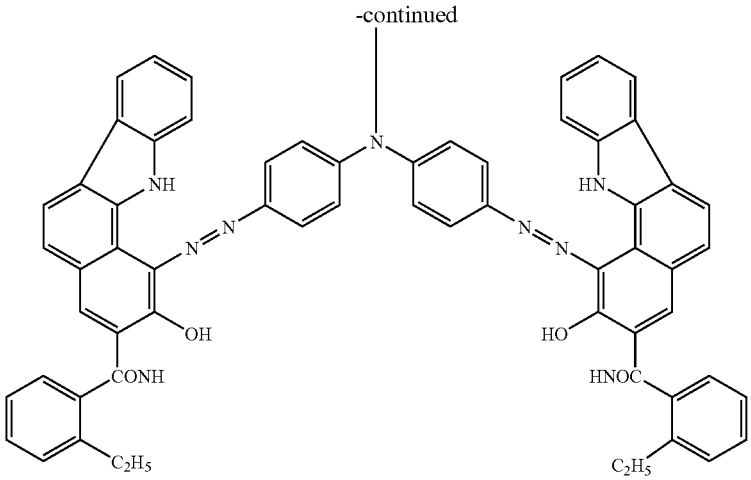

The aluminum drum bearing the undercoat layer was immersed in the above-prepared coating composition for a charge-generating layer and was vertically drawn up at a constant rate to coat the drum with the coating composition and then was dried in the same manner as in the undercoat layer at 120° C. for 20 minutes to form a charge-generating layer having a thickness of about 0.2 μm. Separately, a coating composition for a charge-transport layer was prepared by dissolving 6 parts by weight of a charge-transport material having a structure represented by following Formula (III), 10 parts by weight of a polycarbonate resin (Panlite K-1300, available from Teijin Chemicals, Ltd., Japan), 0.7 part by weight of 1,4-bis(2,5-dimethylbenzyl) benzene, and 0.002 parts by weight of a silicone oil (KF-50, available from Shin-Etsu Chemical Co., Ltd., Japan) in 90 parts by weight of methylene chloride.

(III)

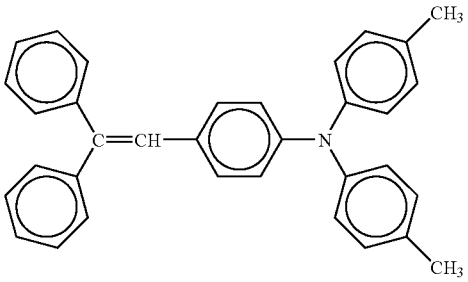

The aluminum drum bearing the undercoat layer and the charge-generating layer was then immersed in the above-prepared coating composition for a charge-transport layer and was vertically drawn up at a constant rate to coat the drum with the coating composition and then was dried in the same manner as in the undercoat layer at 120° C. for 20 minutes to form a charge-transport layer having a thickness of about 32 μm. Thus, a photoconductor was prepared.

One aluminum vibration damper 60 mm long was placed and bonded at the center of the above-prepared photoconductor (drum) using an acrylic adhesive.

The resulting photoconductor was mounted to an image forming apparatus imagio MF-200 (available from Ricoh Company Limited), and the time period during which the number of revolutions of the photoconductor fell down to 1 to 10 rpm before stop was set at 0.6 to 0.7 second.

The charger used herein was of DC contact charging system, and the process cartridge included a developing device and a cleaning blade for imagio MF-200.

Figure 19:
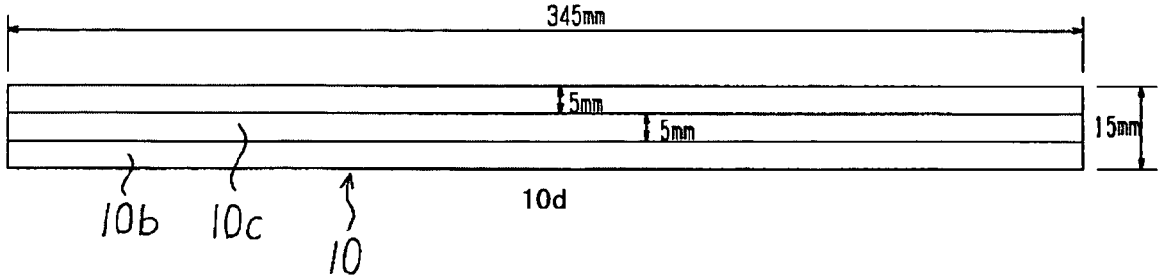
FIG. 19 is a top view of a blade holder used in Example D-1.

The blade holder 10 was an L-shaped steel holder having a first bent portion which forms an angle θ of 93 degrees and having a continuous protrusion 10*c* with a semicircular profile 5 mm wide and 2 mm high (FIG. 19). 10*b* and 10*d* is a flat portion and a cleaning blade side, respectively.

As Comparative Example D-1, a process cartridge was prepared by the procedure of Example D-1, except that the protrusion was not formed in the blade holder. The process cartridge was set in the image forming apparatus imagio MF-200 (available from Ricoh Company Limited, Japan) by the procedure of Example D-1.

An A4-sized image in landscape orientation was repetitively formed at a room temperature of 33° C. at time intervals of 15 seconds for a total of 60 minutes using each of the image forming apparatuses. After 60-minutes image formation, the temperature of the photoconductor stood at 44° C.

A microphone was placed in the vicinity of one side of the image forming apparatus, and the noise immediately before the photoconductor came to a stop was determined. The noise was measured with an Electret condenser Microphone ECM-T 115 (available from Sony Corporation, Japan) as the microphone and was recorded on a versatile personal computer using a recording software Sound Monitor FFT Wave Ver. 7.0 (available from E.N. Software, Japan). The sound level of the recorded noise was increased to 17 dB lo using SoundEngine Free Ver. 2.90 available from Cycle of 5th, Japan). The frequency properties of the resulting noise were determined using the Sound Monitor FFT Wave. The results are shown in Table D-1.

TABLE D-1

| | Maximum sound level in the vicinity of 500 Hz |
|---|---|
| Example D-1 | −20.3 dB |
| Comparative Example D-1 | −1.2 dB |

Table D-1 shows that a great peak in the vicinity of 500 Hz is observed upon occurring of noise.

Sounds of 450 to 550 Hz alone were extracted, were heard and were found that it was noise which most of users feel unpleasant.

Thus, the maximum sound level in the vicinity of 500 Hz was defined as an index of the noise.

In sensory tests, the sound levels are assessed as follows. At a maximum sound level around 500 Hz of −20 dB or lower, one does not perceive noise even in close vicinity to the image forming apparatus; at −16 dB or lower, one does not perceive noise at a distance of 1 m from the image forming apparatus in an office where the air conditioner is not working; at −14 dB or lower, one hardly perceives noise at a distance of 1 m from the image forming apparatus in an office where the air conditioner is working; at −10 dB or lower, one perceives noise but does not feel unpleasant at a distance of 1 m from the image forming apparatus in an office where the air conditioner is working; and at −10 dB or higher, one feels noise unpleasant even at a distance of 1 m from the image forming apparatus in an office where the air conditioner is working.

Example D-2

Figure 20:
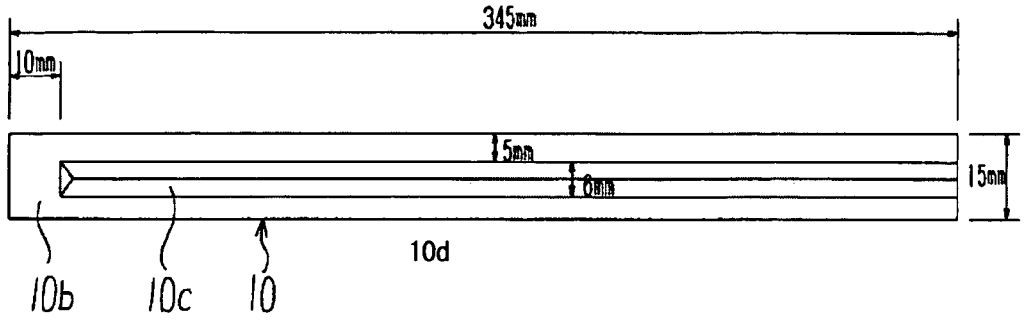
FIG. 20 is a top view of a blade holder used in Example D-2.

An image forming apparatus was prepared and the maximum sound level in the vicinity of 500 Hz thereof was determined by the procedure of Example D-1, except for using a steel blade holder having a shape shown in FIG. 20 in the cleaning blade. The blade holder 10 had a continuous protrusion 10*c* with a triangular profile 2.5 mm high. In FIG. 20, 10*b* and 10*d* is a flat portion and a cleaning blade side, respectively.

The result is shown in Table D-2.

TABLE D-2

| | Maximum sound level in the vicinity of 500 Hz |
|---|---|
| Example D-2 | −19.4 dB |

Examples D-3, D-4 and D-5, and Comparative Example D-2

Photoconductors were prepared by the procedure of Example D-1, except for using 1,4-bis(2,5-dimethylbenzyl) benzene in amounts of 0.1, 0.5, 1.1 and 0 part by weight in the coating composition for a charge-transport layer (corresponding to Examples D-3, D-4 and D-5, and Comparative Example D-2, respectively).

In Comparative Example D-2 using no 1,4-bis(2,5-dimethylbenzyl)benzene in the coating composition for a charge-transport layer, the same steel holder as Comparative Example D-1 was used.

The steel blade holders used in Example D-3, D-4 and D-5 had a protrusion extending to both short side ends of the second flat portion of the blade holder. The blade holder herein had a protrusion with a semicircular profile 5 mm wide and 2 mm high.

The image forming apparatus used in Example D-2 was modified to carry out electrification by alternating current system. An A4-sized image in landscape orientation was repetitively formed in an office at a room temperature of 27° C. at time intervals of 15 seconds for a total of 15 minutes using each of the image forming apparatuses. After 15-minutes image formation, the temperature of the photoconductor stood at 47° C. A microphone was placed in the vicinity of a side of the image forming apparatus, and the noise immediately before the photoconductor came to a stop was determined. The results are shown in Table D-3.

TABLE D-3

| | Maximum sound level in the vicinity of 500 Hz |
|---|---|
| Example D-3 | −16.8 dB |
| Example D-4 | −16.0 dB |
| Example D-5 | −14.7 dB |
| Comparative Example D-2 | 0.5 dB |

Example D-6 and Comparative Example D-3

Figure 21:
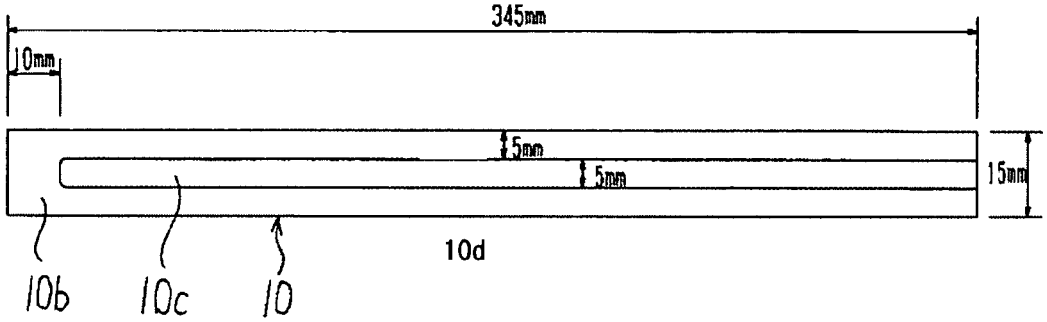
FIG. 21 is a top view of a blade holders used in Examples D-3, D-4, D-5 and D-6.

The image forming apparatus was prepared by the procedure of Example D-4, except for forming a protrusion 10*c* shown in FIG. 21 on the steel holder 10. In FIGS. 21, 10*b* and 10*d* is a flat portion and a cleaning blade side, respectively.

Using the above-prepared image forming apparatus (corresponding to Example D-6) and one used in Comparative Example D-2 (corresponding to Comparative Example D-3), an A4-sized image in landscape orientation was repetitively formed at a room temperature of 30° C. and humidity of 90 percent at time intervals of 15 seconds for a total of 60 minutes. After 60-minutes image formation, the temperature of the photoconductor stood at 45° C. A microphone was placed in the vicinity of a side of the image forming apparatus, and the noise immediately before the photoconductor came to a stop was determined. The results are shown in Table D-4.

TABLE D-4

| | Maximum sound level in the vicinity of 500 Hz |
|---|---|
| Example D-6 | −20.1 dB |
| Comparative Example D-3 | −3.2 dB |

Using each of these image forming apparatuses, an A4-sized lo image in landscape orientation was continuously formed on 99 sheets at a room temperature of 30° C. and humidity of 90 percent. This procedure was repeated 200 times, and a total of 19800 copies were produced. The image forming apparatus according to Example D-6 produced normal images, but the image forming apparatus according to Comparative Example D-3 invited blur in some images.

In the following examples and comparative examples, all parts are by weight.

Example B-1

Preparation Example of Photoconductive Drum

The following composition was placed in a ball mill pot together with alumina balls with a diameter of 10 mm and was milled for 72 hours.

| | |
|---|---|
| Titanium dioxide (CR-60; Ishihara Sangyo Kaisha, Ltd., Japan) | 50 parts |
| Alkyd resin (Beckolite M6401-50, Dainippon Ink & Chemicals, Inc., Japan) | 15 parts |

-continued

| | |
|---|---|
| Melamine resin (Super Beckamine L-121-60, Dainippon Ink & Chemicals, Inc., Japan) | 8.3 parts |
| Methyl ethyl ketone (Kanto Kagaku Co., Ltd., Japan) | 31.7 parts |

The milled mixture was further mixed with 105 parts of cyclohexanone (available from Kanto Kagaku Co., Ltd., Japan) in a ball mill for 2 hours and thereby yielded a coating composition for an undercoat layer. The coating composition was applied to a surface of an aluminium drum according to JIS A3003 having a diameter of 30 mm, length of 340 mm and a thickness of 0.75 mm by dipping, and the coating was dried at 135° C. for 25 minutes and thereby yielded an undercoat layer having a thickness of 4.5 μm thereon.

A mixture of 2 parts of a charge-generating material represented by following Formula (II) (available from Ricoh Company, Ltd., Japan), 1 part of a charge-generating material represented by following Formula (III) (available from Ricoh Company, Ltd., Japan), 1 part of a poly(vinyl butyral) resin (S-LEC BLS, available from Sekisui Chemical Co., Ltd., Japan), and 80 parts of cyclohexanone (available from Kanto Kagaku Co., Ltd., Japan) was placed in a ball mill pot together with partially stabilized zirconia (YTZ) balls with a diameter of 10 mm and was milled for 120 hours. The mixture was further milled with 78.4 parts of cyclohexanone and 237.6 parts of methyl ethyl ketone with the balls for 20 hours and thereby yielded a coating composition for a charge-generating layer. The coating composition was applied to the undercoat layer by dipping, was dried at 130° C. for 20 minutes and thereby yielded a charge-generating layer having a thickness of 0.1 μm thereon.

(II)

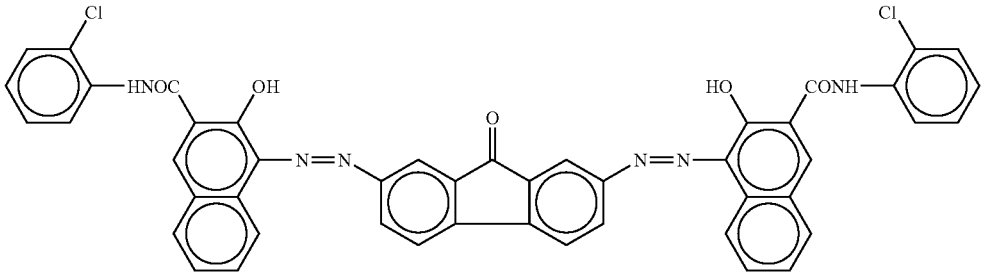

(III)

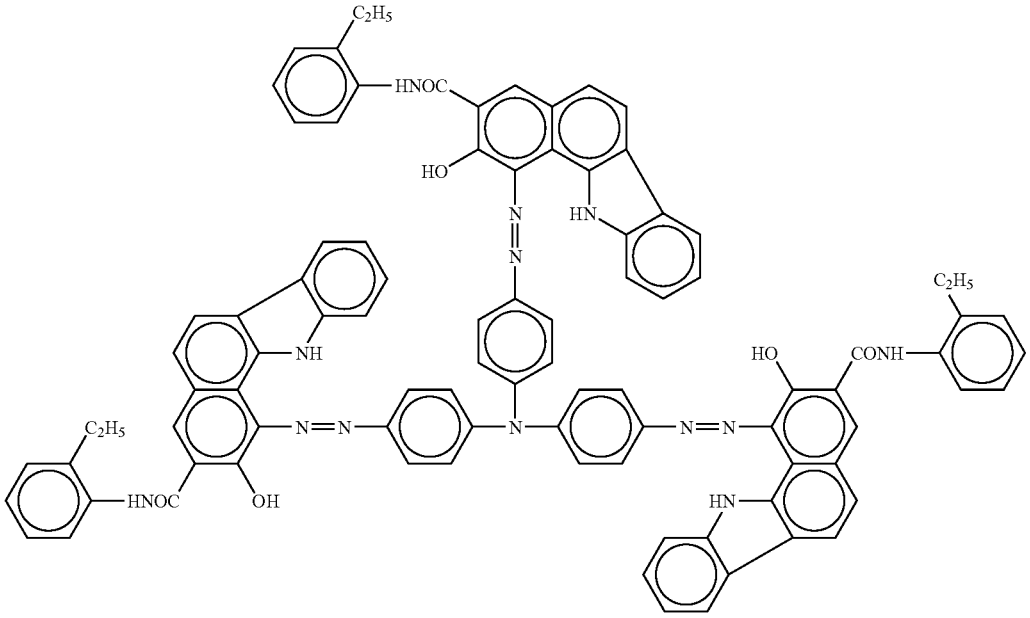

Next, a coating composition for a charge-transport layer having the following composition was prepared, was applied to the charge-generating layer by dipping, was dried at 135° C. for 25 minutes and thereby yielded a charge-transport layer having a thickness of 31 μm thereon.

| | |
|---|---|
| Charge-transport material of following Formula (IV) (Ricoh Company, Ltd.) | 6.5 parts |
| 3,3'-Dimethylbiphenyl (Tokyo Chemical Industry Co., Ltd.) | 0.5 part |

-continued

| | |
|---|---|
| Polycarbonate resin (TS-2050, Teijin Chemicals, Ltd.) | 10 parts |
| Silicone oil (KF-50, Shin-Etsu Chemical Co., Ltd.) | 0.002 part |
| Tetrahydrofuran (Kanto Kagaku Co., Ltd.) | 77.4 parts |
| 2,5-di-tert-butylhydroquinone (Tokyo Chemical Industry Co., Ltd.) | 0.02 part |

(IV)

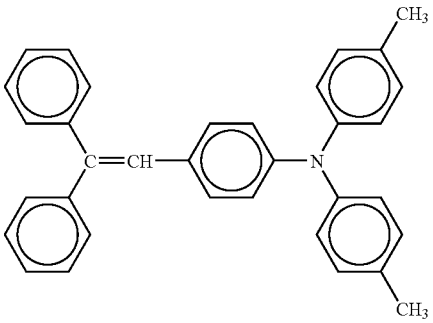

A vibration damping resin comprising 75 parts of ABS resin (GA-704, available from Nippon A&L Inc., Japan), 20 parts of mica lo (60C, available from Kuraray Co., Ltd., Japan), and 5 parts of N-tert-butylbenzothiazyl-2-sulfenamide (Sanceler NS-G, available from Sanshin Chemical Industry Co., Ltd., Japan) as an activating agent was formed into a vibration damper having a slit width of 2 mm, an outer diameter of 28.6 mm, a thickness of 3 mm and a length of 100 mm and having a tapered shape on one side. Two pieces of the vibration damper were placed into the photoconductive drum, and a resin flange was mounted at both ends.

A cleaning member was prepared by bonding a urethane rubber blade having a thickness of 2 mm, a width of 13 mm and a length of 320 mm to a first flat portion 13 mm wide of a blade holder with an adhesion width of 4 mm. The blade holder was made of a zinc-treated steel sheet having a shape shown in FIG. 14A and a thickness t1 of 1.6 mm and had a bead (beaded protrusion) height h4 of 3 mm, a bead width (bead protrusion width) 1 of 4 mm, a height of the second bent portion h5 of 5 mm, a width of the second flat portion L2 of 16 mm, a distance L1 of the bead from the long-side edge L1 of 6 mm and a blade length of 360 mm. The prepared cleaning member, the photoconductive drum and a charger roller were set into the unit shown in FIG. 14B and thereby yielded a process cartridge.

Example B-2

A process cartridge was prepared by the procedure of Example B-1, except that the thickness of the blade holder t1 and the height of the second bent portion h5 were changed to 2 mm and 4 mm, respectively.

Example B-3

A process cartridge was prepared by the procedure of Example B-1, except for using the compound of Formula (I-11) instead of 3,3'-dimethylbiphenyl in the charge-transport layer, using a blade holder having a bead width $L_0$ of 5 mm and a height of the second bent portion h5 of 4 mm, and using a vibration damper having a slit width of 2.5 mm.

Example B-4

A process cartridge was prepared by the procedure of Example B-1, except for using the compound of Formula (I-5) instead of 3,3'-dimethylbiphenyl in the charge-transport layer, and using one piece of a vibration damper having a thickness of 5 mm and a slit width of 2.5 mm instead of the two pieces of the vibration damper.

Example B-5

A process cartridge was prepared by the procedure of Example B-4, except for using a blade holder having a bead width $L_0$ of 6 mm and a height of the second bent portion h5 of 3 mm and using a vibration damper having a thickness of 5 mm.

Example B-6

A process cartridge was prepared by the procedure of Example B-1, except for using no vibration damper.

Example B-7

A process cartridge was prepared by the procedure of Example B-1, except that no 3,3'-dimethylbiphenyl was used in the charge-transport layer.

Reference Example B-1

A process cartridge was prepared by the procedure of Example B-1, except for using a blade holder having no beaded portion (protrusion).

Reference Example B-2

A process cartridge was prepared by the procedure of Example B-1, except for using a blade holder having no second bent portion.

Comparative Example B-1

A process cartridge was prepared by the procedure of Example B-1, except for using a blade holder having neither beaded portion nor second bent portion.

Comparative Example B-2

A process cartridge was prepared by the procedure of Example B-1, except for using a blade holder having neither beaded portion nor second bent portion and using no vibration damper.

Each of the above-prepared process cartridges was set into an electrostatic copier imagio MF 200 (available from Ricoh Company Limited, Japan) capable of copying at a linear velocity of 90 mm/s. A gray halftone image was then copied using the copier. A microphone was placed in the vicinity of a side of the copier, and the noise (vibration sounds) immediately before the photoconductor came to a stop was determined. The noise was measured with an Electret Capacitor Microphone ECM-145 (available from Sony Corporation, Japan) as the microphone and was recorded on a notebook computer. In the copier, the time period during which the number of revolutions of the photoconductor fell down to 1 to 10 rpm before stop was 0.3 second or longer.

The noise was recorded using a recording software Sound Monitor FFT Wave Ver. 7.0 (available from E.N. Software, Japan). The sound level of the recorded noise was increased to 17 dB using SoundEngine Free Ver. 2.90 (available from Cycle of 5th, Japan). The frequency properties of the resulting noise were determined using the Sound Monitor FFT Wave, and the maximum sound levels (dB) in the vicinity of 500 Hz of the copier were determined.

Using the electrostatic copier imagio MF 200 (available from Ricoh Company Limited, Japan), a total of 30000 copies of an A4-sized image in landscape orientation was repetitively formed at a room temperature of 30° C. and humidity of 30 percent at time intervals of 15 seconds, and the vibration noise upon stop of the photoconductor was determined. In addition, a gray halftone image was printed every 5000 copies of the above A4-sized image, and streaks at the front and end portion of the image were observed as an index of cleaning failure. The torque of the photoconductor was determined using a manual torque meter (BTG36CN, available from Tohnichi Mfg. Co., Ltd., Japan) five times about every 200 copies from the beginning of copying to about 1000 copies at 2 to 3 rpm. The average of five measurements was defined as the torque of the photoconductor.

The abrasion loss of the photoconductor was determined by measuring the thickness of the photoconductor using Fisherscope mms (available from Paul N. Gardner Company, Inc.) before and after 30000-sheets copying and calculating the difference therebetween.

The temperature of the photoconductor during image formation was determined with a thermistor housed in the electrostatic copier imagio MF 200 (available from Ricoh Company Limited, Japan) and was found to be about 42° C. to 45° C.

The results are shown in Table B-1.

TABLE B-1

| | Initial | | | | After 30000-sheets copying | | | |
|---|---|---|---|---|---|---|---|---|
| | Noise (dB) | Image irregularity | Cleaning failure | Torque (cN) | Noise (dB) | Image irregularity | Cleaning failure | Abrasion loss (μm) |
| Ex. B-1 | −17 | none | none | 0.91 | −18 | none | none | 10.5 |
| Ex. B-2 | −16 | none | none | 0.89 | −17 | none | none | 9.52 |
| Ex. B-3 | −17 | none | none | 0.85 | −18 | none | none | 8.1 |
| Ex. B-4 | −19 | none | none | 0.75 | −20 | none | none | 7.5 |
| Ex. B-5 | −16 | none | none | 0.92 | −17 | none | none | 9.3 |
| Ex. B-6 | −13 | none | none | 0.91 | −14 | none | none | 10.5 |
| Ex. B-7 | −19 | none | none | 0.82 | −20 | *1 | — | — |
| Ref. Ex. B-1 | −8 | none | none | 1.13 | −9 | none | none | 11.1 |
| Ref. Ex. B-2 | −11 | *2 | none | 1.05 | −12 | *3 | none | 10.8 |
| Com. Ex. B-1 | −7 | none | none | 1.25 | −8 | none | *4 | 11.7 |
| Com. Ex. B-2 | −2 | none | none | 1.25 | −5 | none | *4 | 12 |

*1: Image blur occurred after about 20 copying procedures, and the successive image assessments were not carried out.
*2: Streaks in halftone image.
*3: Irregular images were formed after about 25000 copying procedures.
*4: Cleaning failure occurred after about 20000 copying procedures.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a photoconductor; and a cleaning member, wherein the cleaning member comprises:

a cleaning blade which cleans the photoconductor; and a blade holder which holds the cleaning blade, wherein the blade holder comprises a first flat portion including a first edge extending in a longitudinal direction, a second flat portion including a second edge extending in the longitudinal direction, and a first bent portion connecting the first flat portion and the second flat portion, the cleaning blade is fixed on the plate of the first flat portion, and the second flat portion of the blade holder comprises a second bent portion, and wherein a distance between a line of bend of the second bent portion and the second edge is between 2 mm and 15 mm.

2. An image forming apparatus according to claim 1, wherein the second bent portion is formed by bending.

3. An image forming apparatus according to claim 1, wherein an angle which the second bent portion forms is 140 degrees or less.

4. An image forming apparatus according to claim 1, wherein the blade holder has one or more protrusions between the first bent portion and the second bent portion.

5. An image forming apparatus according to claim 4, wherein the one or more protrusions are formed by drawing.

6. An image forming apparatus according to claim 1, wherein the blade holder has a thickness of 1.0 mm or more and 2.5 mm or less.

7. An image forming apparatus according to claim 1, wherein an angle which the first bent portion forms is from 70 degrees to 135 degrees.

8. An image forming apparatus according to claim 1, comprising a developer-recovering device which recovers a developer on the photoconductor, wherein the blade holder serves as a lid of the developer-recovering device.

9. An image forming apparatus according to claim 1, wherein the photoconductor comprises a cylindrical electroconductive support and a photoconductive layer arranged on or above the electroconductive support, wherein the blade holder has the first and second flat portions formed by bending a metallic plate member into an L shape, wherein the cleaning blade has a contact site to be in contact with the photoconductor along the axial direction of the photoconductor, wherein the configuration for increasing the rigidity is at least one protrusion being protruded from the second flat portion of the blade holder and continuously extending in parallel with the contact site, wherein the image forming apparatus comprises a toner-recovering device having an opening and working to recover a toner removed from the photoconductor by the action of the cleaning blade, wherein the opening is to be covered by the second flat portion of the blade holder, wherein the second flat portion of the blade holder has a size in a direction perpendicular to the contact site of 10 mm or more, and wherein the at least one protrusion protrudes 0.5 mm or more from the second flat portion.

10. An image forming apparatus according to claim 9, wherein the electroconductive support has an outer diameter of 60 mm or less, a thickness of 0.3 to 2 mm and a length in an axial direction of 310 mm or more.

11. An image forming apparatus according to claim 9, wherein the blade holder is formed by bending a plate member having a thickness of 1.0 to 2.5 mm into an L shape.

12. An image forming apparatus according to claim 9, wherein the at least one protrusion extends and reaches at least one short side of the second flat portion of the blade holder.

13. An image forming apparatus according to claim 9, further comprising a flexible member, wherein the flexible member is arranged on the second flat portion of the blade holder, faces the opening of the toner-recovering device, and comprises a flexible material.

14. An image forming apparatus according to claim 12, wherein the flexible material constituting the flexible member is at least one selected from the group consisting of a urethane foam, a Moltoprene (black light-shieding material), a felt, a film or a flexible plastic.

15. An image forming apparatus according to claim 13, wherein the flexible member has a size of 1.5 to 5 mm in a thickness direction of the second flat portion of the blade holder.

16. An image forming apparatus according to claim 9, wherein the area ratio of the at least one protrusion to a flat area of the second flat portion of the blade holder is 15 to 70 percent.

17. An image forming apparatus according to claim 9, further comprising a controller which controls the rotation of the photoconductor so that the time period during which the number of revolutions of the photoconductor before stop falls within a range from 1 to 10 rpm is 0.2 second or longer.

18. An image forming apparatus according to claim 9, further comprising a controller which controls a temperature so that the highest temperature of the photoconductor during image formation procedures is from 38° C. to 56° C.

19. An image forming apparatus according to claim 9, wherein the photoconductive layer of the photoconductor comprises a biphenyl derivative and a compound represented by following Formula (I):

(I)

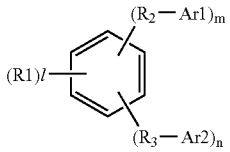

wherein $R_1$ is a lower alkyl group; $R_2$ and $R_3$ are the same as or different from each other and are each a substituted or unsubstituted methylene or ethylene group; $Ar_1$ and $Ar_2$ are the same as or different from each other and are each a substituted or unsubstituted aryl group; 1 is an integer of 0 to 4; m is an integer of 0 to 2; and n is an integer of 0 to 2, wherein 1, m and n satisfy the following conditions: $m+n \geqq 2$, and $1+m+n \leqq 6$, and wherein unsubstituted positions in the benzene ring represent hydrogen atoms.

20. An image forming apparatus according to claim 19, wherein the compound represented by Formula (I) is a bisbenzylbenzene derivative, and wherein the photoconductive layer of the photoconductor comprises 0.5 to 7 percent by weight of the bisbenzylbenzene derivative.

21. An image forming apparatus according to claim 19, further comprising a charger for charges a surface of the photoconductor, wherein the distance between the photoconductor and the charger is 100 μm or less.

22. An image forming apparatus according to claim 9, further comprising a process cartridge, wherein the process cartridge houses the photoconductor, the cleaning blade and the blade holder in a cartridge casing.

23. An image forming apparatus according to claim 1, wherein the photoconductor comprises a cylindrical support having an outer diameter of 60 mm or less, a thickness of 0.3 to 2 mm and a length of 310 mm or more, and a photoconductive layer arranged on the cylindrical support, wherein the cleaning blade is in contact with the photoconductor even when no image formation is carrying out, wherein the blade holder is a metallic blade holder, has an L-shaped profile, has a thickness of 1.0 to 2.5 mm and has first and second flat portions, and wherein the second flat portion of the blade holder has a width of 10 mm or more, has a flat outer periphery and comprises at least one protrusion protruding 0.5 mm or more from the level of the flat outer periphery as the configuration for increasing the rigidity.

24. An image forming apparatus according to claim 23, wherein the at least one protrusion continuously extends inside the flat outer periphery in the second flat portion.

25. An image forming apparatus according to claim 23, wherein the area ratio of the at least one protrusion to the second flat portion of the blade holder is 15 to 70 percent.

26. An image forming apparatus according to claim 23, further comprising a toner-recovering device which recovers a toner removed from the photoconductor by the action of the cleaning blade, wherein the second flat portion of the blade holder serves as a lid of the toner-recovering device.

27. An image forming apparatus according to claim 23, wherein the image forming apparatus is so configured that the time period during which the number of revolutions of the photoconductor after image formation and before stop falls within a range from 1 to 10 rpm is 0.2 second or longer.

28. An image forming apparatus according to claim 23, wherein the image forming apparatus is so configured that the highest temperature of the photoconductor during image formation is from 38° C. to 53° C.

29. An image forming apparatus according to claim 23, wherein the photoconductive layer of the photoconductor comprises a biphenyl compound and a compound represented by following Formula (I):

(I)

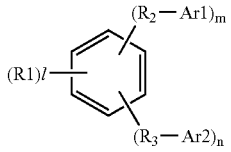

wherein $R_1$ is a lower alkyl group; $R_2$ and $R_3$ are the same as or different from each other and are each a substituted or unsubstituted methylene or ethylene group; $Ar_1$ and $Ar_2$ are the same as or different from each other and are each a substituted or unsubstituted aryl group; 1 is an integer of 0 to 4; m is an integer of 0 to 2; and n is an integer of 0 to 2, wherein 1, m and n satisfy the following conditions: $m+n \geqq 2$, and $1+m+n \leqq 6$, and wherein unsubstituted positions in the benzene ring represent hydrogen atoms.

30. An image forming apparatus according to claim 29, wherein the compound represented by Formula (I) is a bisbenzylbenzene derivative, and wherein the photoconductive layer of the photoconductor comprises 0.5 to 7 percent by weight of the bisbenzylbenzene derivative.

31. An image forming apparatus according to claim 29, further comprising a charger which charges the photoconductor, wherein the distance between the charger and the photoconductor is 100μm or less.

32. An image forming apparatus comprising:

a photoconductor; and a cleaning member, wherein the cleaning member comprises:

a cleaning blade which cleans the photoconductor; and a blade holder which holds the cleaning blade, wherein the blade holder comprises a first flat portion, a second flat portion, and a first bent portion connecting the first flat portion and the second flat portion, the cleaning blade is fixed on the plate of the first flat portion, and the second flat portion of the blade holder comprises a second bent portion, and wherein a distance between the first bent portion and the second bent portion is 10 mm or more.

33. An image forming apparatus according to claim 32, wherein the distance between the first bent portion and the second bent portion is 12 mm or more.

34. An image forming apparatus according to claim 32, wherein the distance between the first bent portion and the second bent portion is between 14 mm and 20 mm.

35. A process cartridge for image forming apparatus, comprising an integrated cleaning unit and being attachable to and detachable from a main body of the image forming apparatus, wherein a cleaning member comprises:

a cleaning blade which cleans a photoconductor; and a blade holder which holds the cleaning blade, wherein the blade holder comprises a first flat portion including a first edge extending in a longitudinal direction, a second flat portion including a second edge extending in the longitudinal direction, and a first bent portion connecting the first flat portion and the second flat portion, and the second flat portion of the blade holder comprises a second bent portion, and wherein a distance between a line of bend of the second bent portion and the second edge is from 2 mm to 15 mm.

36. A process cartridge according to claim 35, wherein the blade holder is a metallic blade holder, has an L-shaped profile, has a thickness of 1.0 to 2.5 mm and has first and second flat portions, and wherein the second flat portion of the blade holder has a width of 10 mm or more, has a flat outer periphery and comprises at least one protrusion protruding 0.5 mm or more from the level of the flat outer periphery.

37. A copier comprising:

an image reading device which reads an original image;

an image forming apparatus which carries out image formation based on the image read out by the image reading device; and an image forming apparatus, wherein the image forming apparatus comprises:

a photoconductor; and a cleaning member, wherein the cleaning member comprises:

a cleaning blade which cleans the photoconductor; and a blade holder which holds the cleaning blade, wherein the blade holder comprises a first flat portion including a first edge extending in a longitudinal direction, a second flat portion including a second edge extending in the longitudinal direction, and a first bent portion connecting the first flat portion and the second flat portion, the cleaning blade is fixed on the plate of the first flat portion, and the second flat portion of the blade holder comprises a second bent portion, and wherein a distance between a line of bend of the second bent portion and the second edge is from 2 mm to 15 mm.

* * * * *

UNITED STATES PATENT AND TRADEMARK OFFICE

CERTIFICATE OF CORRECTION

PATENT NO. : 7,181,156 B2
APPLICATION NO. : 10/897202
DATED : February 20, 2007
INVENTOR(S) : Kabata et al.

It is certified that error appears in the above-identified patent and that said Letters Patent is hereby corrected as shown below:

On the title page, Item (54), and Column 1, the Title information is incorrect. Item (54) and Column 1 should read:

-- (54) IMAGE FORMING APPARATUS USING A CLEANING MEMBER WITH THE INCREASED RIGIDITY AND PROCESS CARTRIDGE THEREFOR --

Signed and Sealed this

Tenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,181,156 B2
APPLICATION NO. : 10/897202
DATED : February 20, 2007
INVENTOR(S) : Kabata et al.

It is certified that error appears in the above-identified patent and that said Letters Patent is hereby corrected as shown below:

On the title page, Item (54), and Column 1, the Title information is incorrect. Item (54) and Column 1 should read:

-- (54) IMAGE FORMING APPARATUS USING A CLEANING MEMBER FOR PREVENTING NOISES AND PROCESS CARTRIDGE THEREFOR --

This certificate supersedes Certificate of Correction issued April 10, 2007.

Signed and Sealed this

Fourteenth Day of August, 2007

JON W. DUDAS
*Director of the United States Patent and Trademark Office*